US011216869B2

(12) United States Patent
Allen et al.

(10) Patent No.: US 11,216,869 B2
(45) Date of Patent: Jan. 4, 2022

(54) USER INTERFACE TO AUGMENT AN IMAGE USING GEOLOCATION

(71) Applicant: Snap Inc., Santa Monica, CA (US)

(72) Inventors: Nicholas Richard Allen, Santa Monica, CA (US); Sheldon Chang, Venice, CA (US); Timothy Michael Sehn, Marina Del Ray, CA (US); William Wu, Orinda, CA (US)

(73) Assignee: Snap Inc., Santa Monica, CA (US)

( * ) Notice: Subject to any disclaimer, the term of this patent is extended or adjusted under 35 U.S.C. 154(b) by 705 days.

(21) Appl. No.: 14/494,226

(22) Filed: Sep. 23, 2014

(65) Prior Publication Data

US 2016/0085863 A1 Mar. 24, 2016

(51) Int. Cl.
*G06Q 30/08* (2012.01)

(52) U.S. Cl.
CPC ..... *G06Q 30/08* (2013.01)

(58) Field of Classification Search
CPC ..... G06Q 30/0251
See application file for complete search history.

(56) References Cited

U.S. PATENT DOCUMENTS

| | | | |
|---|---|---|---|
| 666,223 | A | 1/1901 | Shedlock |
| 4,581,634 | A | 4/1986 | Williams |
| 4,975,690 | A | 12/1990 | Torres |
| 5,072,412 | A | 12/1991 | Henderson, Jr. et al. |
| 5,493,692 | A | 2/1996 | Theimer et al. |
| 5,713,073 | A | 1/1998 | Warsta |
| 5,754,939 | A | 5/1998 | Herz et al. |
| 5,855,008 | A | 12/1998 | Goldhaber et al. |
| 5,883,639 | A | 3/1999 | Walton et al. |
| 5,999,932 | A | 12/1999 | Paul |
| 6,012,098 | A | 1/2000 | Bayeh et al. |
| 6,014,090 | A | 1/2000 | Rosen et al. |
| 6,029,141 | A | 2/2000 | Bezos et al. |
| 6,038,295 | A | 3/2000 | Mattes |
| 6,049,711 | A | 4/2000 | Yehezkel et al. |
| 6,154,764 | A | 11/2000 | Nitta et al. |
| 6,167,435 | A | 12/2000 | Druckenmiller et al. |
| 6,204,840 | B1 | 3/2001 | Petelycky et al. |
| 6,205,432 | B1 | 3/2001 | Gabbard et al. |
| 6,216,141 | B1 | 4/2001 | Straub et al. |

(Continued)

FOREIGN PATENT DOCUMENTS

| | | | |
|---|---|---|---|
| CA | 2887596 | A1 | 7/2015 |
| CN | 102930107 | A | 2/2013 |

(Continued)

OTHER PUBLICATIONS

US 10,484,394 B2, 11/2019, Allen et al. (withdrawn)

(Continued)

*Primary Examiner* — Mark D Featherstone
*Assistant Examiner* — Ranjit P Doraiswamy
(74) *Attorney, Agent, or Firm* — Schwegman Lundberg & Woessner, P.A.

(57) ABSTRACT

A system and method for a media filter publication application are described. The media filter publication application receives a content item and a selected geolocation, generates a media filter based on the content item and the selected geolocation, and supplies the media filter to a client device located at the selected geolocation.

20 Claims, 30 Drawing Sheets

(56) References Cited

U.S. PATENT DOCUMENTS 6,285,381 B1 9/2001 Sawano et al.
6,285,987 B1 9/2001 Roth et al.
6,310,694 B1 10/2001 Okimoto et al.
6,317,789 B1 11/2001 Rakavy et al.
6,334,149 B1 12/2001 Davis, Jr. et al.
6,349,203 B1 2/2002 Asaoka et al.
6,353,170 B1 3/2002 Eyzaguirre et al.
6,446,004 B1 9/2002 Cao et al.
6,449,657 B2 9/2002 Stanbach et al.
6,456,852 B2 9/2002 Bar et al.
6,484,196 B1 11/2002 Maurille
6,487,601 B1 11/2002 Hubacher et al.
6,523,008 B1 2/2003 Avrunin
6,542,749 B2 4/2003 Tanaka et al.
6,549,768 B1 4/2003 Fraccaroli
6,618,593 B1 9/2003 Drutman et al.
6,622,174 B1 9/2003 Ukita et al.
6,631,463 B1 10/2003 Floyd et al.
6,636,247 B1 10/2003 Hamzy et al.
6,636,855 B2 10/2003 Holloway et al.
6,643,684 B1 11/2003 Malkin et al.
6,658,095 B1 12/2003 Yoakum et al.
6,665,531 B1 12/2003 Soderbacka et al.
6,668,173 B2 12/2003 Greene
6,684,238 B1 1/2004 Dutta
6,684,257 B1 1/2004 Camut et al.
6,698,020 B1 2/2004 Zigmond et al.
6,700,506 B1 3/2004 Winkler
6,720,860 B1 4/2004 Narayanaswami
6,724,403 B1 4/2004 Santoro et al.
6,757,713 B1 6/2004 Ogilvie et al.
6,832,222 B1 12/2004 Zimowski
6,834,195 B2 12/2004 Brandenberg et al.
6,836,792 B1 12/2004 Chen
6,898,626 B2 5/2005 Ohashi
6,922,634 B2 7/2005 Odakura et al.
6,959,324 B1 10/2005 Kubik et al.
6,970,088 B2 11/2005 Kovach
6,970,907 B1 11/2005 Ullmann et al.
6,980,909 B2 12/2005 Root et al.
6,981,040 B1 12/2005 Konig et al.
7,020,494 B2 3/2006 Spriestersbach et al.
7,027,124 B2 4/2006 Foote et al.
7,072,963 B2 7/2006 Anderson et al.
7,085,571 B2 8/2006 Kalhan et al.
7,110,744 B2 9/2006 Freeny, Jr.
7,124,091 B1 10/2006 Khoo et al.
7,124,164 B1 10/2006 Chemtob
7,149,893 B1 12/2006 Leonard et al.
7,173,651 B1 2/2007 Knowles
7,188,143 B2 3/2007 Szeto
7,203,380 B2 4/2007 Chiu et al.
7,206,568 B2 4/2007 Sudit
7,227,937 B1 6/2007 Yoakum et al.
7,237,002 B1 6/2007 Estrada et al.
7,240,025 B2 7/2007 Stone et al.
7,240,089 B2 7/2007 Boudreau
7,269,426 B2 9/2007 Kokkonen et al.
7,280,658 B2 10/2007 Amini et al.
7,315,823 B2 1/2008 Bröndrup
7,349,768 B2 3/2008 Bruce et al.
7,356,564 B2 4/2008 Hartselle et al.
7,394,345 B1 7/2008 Ehlinger et al.
7,411,493 B2 8/2008 Smith
7,423,580 B2 9/2008 Markhovsky et al.
7,454,442 B2 11/2008 Cobleigh et al.
7,508,419 B2 3/2009 Toyama et al.
7,512,649 B2 3/2009 Faybishenko et al.
7,519,670 B2 4/2009 Hagale et al.
7,535,890 B2 5/2009 Rojas
7,546,554 B2 6/2009 Chiu et al.
7,607,096 B2 10/2009 Oreizy et al.
7,630,724 B2 12/2009 Beyer, Jr. et al.
7,639,943 B1 12/2009 Kalajan
7,650,231 B2 1/2010 Gadler
7,668,537 B2 2/2010 DeVries
7,770,137 B2 8/2010 Forbes et al.
7,778,973 B2 8/2010 Choi
7,779,444 B2 8/2010 Glad
7,787,886 B2 8/2010 Markhovsky et al.
7,796,946 B2 9/2010 Eisenbach
7,801,954 B2 9/2010 Cadiz et al.
7,856,360 B2 12/2010 Kramer et al.
7,991,638 B1 8/2011 House et al.
8,001,204 B2 8/2011 Burtner et al.
8,014,762 B2 9/2011 Chmaytelli et al.
8,032,586 B2 10/2011 Challenger et al.
8,082,255 B1 12/2011 Carlson, Jr. et al.
8,090,351 B2 1/2012 Klein
8,098,904 B2 1/2012 Ioffe et al.
8,099,109 B2 1/2012 Altman et al.
8,112,716 B2 2/2012 Kobayashi
8,131,597 B2 3/2012 Hudetz
8,135,166 B2 3/2012 Rhoads
8,136,028 B1 3/2012 Loeb et al.
8,146,001 B1 3/2012 Reese
8,161,115 B2 4/2012 Yamamoto
8,161,417 B1 4/2012 Lee
8,195,203 B1 6/2012 Tseng
8,199,747 B2 6/2012 Rojas et al.
8,208,943 B2 6/2012 Petersen
8,214,443 B2 7/2012 Hamburg
8,234,350 B1 7/2012 Gu et al.
8,276,092 B1 9/2012 Narayanan et al.
8,279,319 B2 10/2012 Date
8,280,406 B2 10/2012 Ziskind et al.
8,285,199 B2 10/2012 Hsu et al.
8,287,380 B2 10/2012 Nguyen et al.
8,290,513 B2 10/2012 Forstall et al.
8,301,159 B2 10/2012 Hamynen et al.
8,306,922 B1 11/2012 Kunal et al.
8,312,086 B2 11/2012 Velusamy et al.
8,312,097 B1 11/2012 Siegel et al.
8,326,315 B2 12/2012 Phillips et al.
8,326,327 B2 12/2012 Hymel et al.
8,332,402 B2 12/2012 Forstall et al.
8,332,475 B2 12/2012 Rosen et al.
8,352,546 B1 1/2013 Dollard
8,369,866 B2 2/2013 Ashley, Jr. et al.
8,379,130 B2 2/2013 Forutanpour et al.
8,385,950 B1 2/2013 Wagner et al.
8,402,097 B2 3/2013 Szeto
8,405,773 B2 3/2013 Hayashi et al.
8,418,067 B2 4/2013 Cheng et al.
8,423,409 B2 4/2013 Rao
8,433,296 B2 4/2013 Hardin et al.
8,471,914 B2 6/2013 Sakiyama et al.
8,472,935 B1 6/2013 Fujisaki
8,494,481 B1 7/2013 Bacco et al.
8,510,383 B2 8/2013 Hurley et al.
8,527,345 B2 9/2013 Rothschild et al.
8,548,735 B2 10/2013 Forstall et al.
8,554,627 B2 10/2013 Svendsen et al.
8,559,980 B2 10/2013 Pujol
8,560,612 B2 10/2013 Kilmer et al.
8,594,680 B2 11/2013 Ledlie et al.
8,613,089 B1 12/2013 Holloway et al.
8,626,187 B2 1/2014 Grosman et al.
8,649,803 B1 2/2014 Hamill
8,660,358 B1 2/2014 Bergboer et al.
8,660,369 B2 2/2014 Llano et al.
8,660,793 B2 2/2014 Ngo et al.
8,682,350 B2 3/2014 Altman et al.
8,688,519 B1 4/2014 Lin et al.
8,694,026 B2 4/2014 Forstall et al.
8,718,333 B2 5/2014 Wolf et al.
8,724,622 B2 5/2014 Rojas
8,732,168 B2 5/2014 Johnson
8,744,523 B2 6/2014 Fan et al.
8,745,132 B2 6/2014 Obradovich
8,751,310 B2 6/2014 Van Datta et al.
8,761,800 B2 6/2014 Kuwahara
8,762,201 B1 6/2014 Noonan
8,768,876 B2 7/2014 Shim et al.

(56) References Cited

U.S. PATENT DOCUMENTS 8,775,972 B2 7/2014 Spiegel
8,788,680 B1 7/2014 Naik
8,790,187 B2 7/2014 Walker et al.
8,797,415 B2 8/2014 Arnold
8,798,646 B1 8/2014 Wang et al.
8,838,140 B1 9/2014 Ledet
8,856,349 B2 10/2014 Jain et al.
8,874,677 B2 10/2014 Rosen et al.
8,886,227 B2 11/2014 Schmidt et al.
8,909,679 B2 12/2014 Roote et al.
8,909,725 B1 12/2014 Sehn
8,923,823 B1 12/2014 Wilde
8,924,144 B2 12/2014 Forstall et al.
8,972,357 B2 3/2015 Shim et al.
8,977,296 B1 3/2015 Briggs et al.
8,995,433 B2 3/2015 Rojas
9,015,285 B1 4/2015 Ebsen et al.
9,020,745 B2 4/2015 Johnston et al.
9,040,574 B2 5/2015 Wang et al.
9,043,329 B1 5/2015 Patton et al.
9,055,416 B2 6/2015 Rosen et al.
9,080,877 B2 7/2015 Dave et al.
9,094,137 B1 7/2015 Sehn et al.
9,100,806 B2 8/2015 Rosen et al.
9,100,807 B2 8/2015 Rosen et al.
9,113,301 B1 8/2015 Spiegel et al.
9,119,027 B2 8/2015 Sharon et al.
9,123,074 B2 9/2015 Jacobs
9,137,700 B2 9/2015 Elefant et al.
9,143,382 B2 9/2015 Bhogal et al.
9,143,681 B1 9/2015 Ebsen et al.
9,152,477 B1 10/2015 Campbell et al.
9,191,776 B2 11/2015 Root et al.
9,204,252 B2 12/2015 Root
9,225,897 B1 12/2015 Sehn et al.
9,258,459 B2 2/2016 Hartley
9,277,365 B1 3/2016 Wilden et al.
9,344,606 B2 5/2016 Hartley et al.
9,385,983 B1 7/2016 Sehn
9,396,354 B1 7/2016 Murphy et al.
9,407,712 B1 8/2016 Sehn
9,407,816 B1 8/2016 Sehn
9,430,783 B1 8/2016 Sehn
9,439,041 B2 9/2016 Parvizi et al.
9,443,227 B2 9/2016 Evans et al.
9,450,907 B2 9/2016 Pridmore et al.
9,459,778 B2 10/2016 Hogeg et al.
9,489,661 B2 11/2016 Evans et al.
9,491,134 B2 11/2016 Rosen et al.
9,532,171 B2 12/2016 Allen et al.
9,537,811 B2 1/2017 Allen et al.
9,544,379 B2 1/2017 Gauglitz et al.
9,591,445 B2 3/2017 Zises
9,628,950 B1 4/2017 Noeth et al.
9,648,581 B1 5/2017 Vaynblat et al.
9,672,538 B1 6/2017 Vaynblat et al.
9,674,660 B1 6/2017 Vaynblat et al.
9,706,355 B1 7/2017 Cali et al.
9,710,821 B2 7/2017 Heath
9,710,969 B2 7/2017 Malamud et al.
9,802,121 B2 10/2017 Ackley et al.
9,823,724 B2 11/2017 Vaccari et al.
9,843,720 B1 12/2017 Ebsen et al.
9,854,219 B2 12/2017 Sehn
9,866,999 B1 1/2018 Noeth
9,894,478 B1 2/2018 Deluca et al.
9,961,535 B2 5/2018 Bucchieri
10,080,102 B1 9/2018 Noeth et al.
10,176,195 B2 1/2019 Patel
10,200,813 B1 2/2019 Allen et al.
10,282,753 B2 5/2019 Cheung
10,285,002 B2 5/2019 Colonna et al.
10,285,006 B2 5/2019 Colonna et al.
10,349,209 B1 7/2019 Noeth et al.
10,395,519 B2 8/2019 Colonna et al.
10,445,777 B2 10/2019 McDevitt et al.
10,524,087 B1 12/2019 Allen et al.
10,565,795 B2 2/2020 Charlton et al.
10,616,239 B2 4/2020 Allen et al.
10,616,476 B1 4/2020 Ebsen et al.
10,659,914 B1 5/2020 Allen et al.
10,694,317 B2 6/2020 Cheung
10,824,654 B2 11/2020 Chang et al.
10,893,055 B2 1/2021 Allen et al.
10,915,911 B2 2/2021 Ahmed et al.
2002/0032771 A1 3/2002 Gledje
2002/0047868 A1 4/2002 Miyazawa
2002/0078456 A1 6/2002 Hudson et al.
2002/0087631 A1 7/2002 Sharma
2002/0097257 A1 7/2002 Miller et al.
2002/0098850 A1 7/2002 Akhteruzzaman et al.
2002/0122659 A1 9/2002 Mcgrath et al.
2002/0123327 A1 9/2002 Vataja
2002/0128047 A1 9/2002 Gates
2002/0144154 A1 10/2002 Tomkow
2003/0001846 A1 1/2003 Davis et al.
2003/0016247 A1 1/2003 Lai et al.
2003/0017823 A1 1/2003 Mager et al.
2003/0020623 A1 1/2003 Cao et al.
2003/0023874 A1 1/2003 Prokupets et al.
2003/0037124 A1 2/2003 Yamaura et al.
2003/0052925 A1 3/2003 Daimon et al.
2003/0083929 A1 5/2003 Springer et al.
2003/0101230 A1 5/2003 Benschoter et al.
2003/0110503 A1 6/2003 Perkes
2003/0126215 A1 7/2003 Udell
2003/0148773 A1 8/2003 Spriestersbach et al.
2003/0164856 A1 9/2003 Prager et al.
2003/0229607 A1 12/2003 Zellweger et al.
2004/0027371 A1 2/2004 Jaeger
2004/0064429 A1 4/2004 Hirstius et al.
2004/0078367 A1 4/2004 Anderson et al.
2004/0091116 A1 5/2004 Staddon et al.
2004/0111467 A1 6/2004 Willis
2004/0158739 A1 8/2004 Wakai et al.
2004/0185877 A1 9/2004 Asthana et al.
2004/0189465 A1 9/2004 Capobianco et al.
2004/0193488 A1 9/2004 Khoo et al.
2004/0203959 A1 10/2004 Coombes
2004/0215625 A1 10/2004 Svendsen et al.
2004/0243531 A1 12/2004 Dean
2004/0243688 A1 12/2004 Wugofski
2004/0243704 A1 12/2004 Botelho et al.
2005/0021444 A1 1/2005 Bauer et al.
2005/0022211 A1 1/2005 Veselov et al.
2005/0032527 A1 2/2005 Sheha et al.
2005/0048989 A1 3/2005 Jung
2005/0078804 A1 4/2005 Yomoda
2005/0097176 A1 5/2005 Schatz et al.
2005/0102180 A1 5/2005 Gailey et al.
2005/0102381 A1 5/2005 Jiang et al.
2005/0104976 A1 5/2005 Currans
2005/0114783 A1 5/2005 Szeto
2005/0119936 A1 6/2005 Buchanan et al.
2005/0122405 A1 6/2005 Voss et al.
2005/0193340 A1 9/2005 Amburgey et al.
2005/0193345 A1 9/2005 Klassen et al.
2005/0198128 A1 9/2005 Anderson
2005/0223066 A1 10/2005 Buchheit et al.
2005/0288954 A1 12/2005 McCarthy et al.
2006/0026067 A1* 2/2006 Nicholas ..... G06Q 30/00 705/14.58
2006/0107297 A1 5/2006 Toyama et al.
2006/0114338 A1 6/2006 Rothschild
2006/0119882 A1 6/2006 Harris et al.
2006/0136297 A1 6/2006 Willis et al.
2006/0242239 A1 10/2006 Morishima et al.
2006/0252438 A1 11/2006 Ansamaa et al.
2006/0259359 A1 11/2006 Gogel
2006/0265417 A1 11/2006 Amato et al.
2006/0270419 A1 11/2006 Crowley et al.
2006/0287878 A1 12/2006 Wadhwa et al.
2007/0004426 A1 1/2007 Pfleging et al.
2007/0038715 A1 2/2007 Collins et al.

(56) References Cited

U.S. PATENT DOCUMENTS

2007/0040931 A1 2/2007 Nishizawa
2007/0073517 A1 3/2007 Panje
2007/0073823 A1 3/2007 Cohen et al.
2007/0075898 A1 4/2007 Markhovsky et al.
2007/0082707 A1 4/2007 Flynt et al.
2007/0136228 A1 6/2007 Petersen
2007/0092668 A1 8/2007 Harris et al.
2007/0192128 A1 8/2007 Celestini
2007/0198340 A1 8/2007 Lucovsky et al.
2007/0198495 A1 8/2007 Buron et al.
2007/0208751 A1 9/2007 Cowan et al.
2007/0210936 A1 9/2007 Nicholson
2007/0214180 A1 9/2007 Crawford
2007/0214216 A1 9/2007 Carrer et al.
2007/0233556 A1 10/2007 Koningstein
2007/0233801 A1 10/2007 Eren et al.
2007/0233859 A1 10/2007 Zhao et al.
2007/0243887 A1 10/2007 Bandhole et al.
2007/0244750 A1 10/2007 Grannan et al.
2007/0255456 A1 11/2007 Funayama
2007/0260741 A1 11/2007 Bezancon
2007/0262860 A1 11/2007 Salinas et al.
2007/0268988 A1 11/2007 Hedayat et al.
2007/0281690 A1 12/2007 Altman et al.
2008/0012987 A1 1/2008 Hirata et al.
2008/0022329 A1 1/2008 Glad
2008/0025701 A1 1/2008 Ikeda
2008/0032703 A1 2/2008 Krumm et al.
2008/0033795 A1 2/2008 Wishnow et al.
2008/0033930 A1 2/2008 Warren
2008/0043041 A2 2/2008 Hedenstroem et al.
2008/0049704 A1 2/2008 Witteman et al.
2008/0062141 A1 3/2008 Chandhri
2008/0076505 A1 3/2008 Ngyen et al.
2008/0092233 A1 4/2008 Tian et al.
2008/0094387 A1 4/2008 Chen
2008/0104503 A1 5/2008 Beall et al.
2008/0109844 A1 5/2008 Baldeschweiler et al.
2008/0120409 A1 5/2008 Sun et al.
2008/0147730 A1 6/2008 Lee et al.
2008/0148150 A1 6/2008 Mall
2008/0158230 A1 7/2008 Sharma et al.
2008/0160956 A1 7/2008 Jackson et al.
2008/0167106 A1 7/2008 Lutnick
2008/0168033 A1 7/2008 Ott et al.
2008/0168489 A1 7/2008 Schraga
2008/0189177 A1 8/2008 Anderton et al.
2008/0200189 A1 8/2008 Lagerstedt et al.
2008/0207176 A1 8/2008 Brackbill et al.
2008/0208692 A1 8/2008 Garaventi et al.
2008/0214210 A1 9/2008 Rasanen et al.
2008/0222545 A1 9/2008 Lemay
2008/0255976 A1 10/2008 Altberg et al.
2008/0256446 A1 10/2008 Yamamoto
2008/0256577 A1 10/2008 Funaki et al.
2008/0266421 A1 10/2008 Takahata et al.
2008/0270938 A1 10/2008 Carlson
2008/0284587 A1 11/2008 Saigh et al.
2008/0288338 A1 11/2008 Wiseman et al.
2008/0306826 A1 12/2008 Kramer et al.
2008/0313329 A1 12/2008 Wang et al.
2008/0313346 A1 12/2008 Kujawa et al.
2008/0318616 A1 12/2008 Chipalkatti et al.
2009/0006191 A1 1/2009 Arankalle et al.
2009/0006565 A1 1/2009 Velusamy et al.
2009/0015703 A1 1/2009 Kim et al.
2009/0019472 A1 1/2009 Cleland et al.
2009/0024956 A1 1/2009 Kobayashi
2009/0030774 A1 1/2009 Rothschild et al.
2009/0030999 A1 1/2009 Gatzke et al.
2009/0040324 A1 2/2009 Nonaka
2009/0042588 A1 2/2009 Lottin et al.
2009/0058822 A1 3/2009 Chaudhri
2009/0079846 A1 3/2009 Chou
2009/0089169 A1 4/2009 Gupta et al.
2009/0089678 A1 4/2009 Sacco et al.
2009/0089710 A1 4/2009 Wood et al.
2009/0093261 A1 4/2009 Ziskind
2009/0132341 A1 5/2009 Klinger
2009/0132453 A1 5/2009 Hangartner et al.
2009/0132665 A1 5/2009 Thomsen et al.
2009/0148045 A1 6/2009 Lee et al.
2009/0153492 A1* 6/2009 Popp ..... G06F 3/04883 345/173
2009/0157450 A1 6/2009 Athsani et al.
2009/0157752 A1 6/2009 Gonzalez
2009/0160970 A1 6/2009 Fredlund et al.
2009/0163182 A1 6/2009 Gatti et al.
2009/0177299 A1 7/2009 Van De Sluis
2009/0177588 A1 7/2009 Marchese
2009/0177730 A1 7/2009 Annamalai et al.
2009/0192900 A1 7/2009 Collision
2009/0197582 A1 8/2009 Lewis et al.
2009/0197616 A1 8/2009 Lewis et al.
2009/0199242 A1 8/2009 Johnson et al.
2009/0215469 A1 8/2009 Fisher et al.
2009/0232354 A1 9/2009 Camp, Jr. et al.
2009/0234815 A1 9/2009 Boerries et al.
2009/0239552 A1 9/2009 Churchill et al.
2009/0249222 A1 10/2009 Schmidt et al.
2009/0249244 A1 10/2009 Robinson et al.
2009/0265647 A1 10/2009 Martin et al.
2009/0288022 A1 11/2009 Almstrand et al.
2009/0291672 A1 11/2009 Treves et al.
2009/0292608 A1* 11/2009 Polachek ..... G06Q 30/02 705/14.44
2009/0299857 A1 12/2009 Brubaker
2009/0319607 A1 12/2009 Belz et al.
2009/0327073 A1 12/2009 Li
2010/0004003 A1 1/2010 Duggal et al.
2010/0041378 A1 2/2010 Aceves et al.
2010/0062794 A1 3/2010 Han
2010/0082427 A1 4/2010 Burgener et al.
2010/0082693 A1 4/2010 Hugg et al.
2010/0100568 A1 4/2010 Papin et al.
2010/0113065 A1 5/2010 Narayan et al.
2010/0113066 A1 5/2010 Dingler et al.
2010/0115281 A1 5/2010 Camenisch et al.
2010/0130233 A1 5/2010 Lansing
2010/0131880 A1 5/2010 Lee et al.
2010/0131895 A1 5/2010 Wohlert
2010/0153144 A1 6/2010 Miller et al.
2010/0153197 A1 6/2010 Byon
2010/0159944 A1 6/2010 Pascal et al.
2010/0161658 A1 6/2010 Hamynen et al.
2010/0161831 A1 6/2010 Haas et al.
2010/0162149 A1 6/2010 Sheleheda et al.
2010/0183280 A1 7/2010 Beauregard et al.
2010/0185552 A1 7/2010 Deluca et al.
2010/0185665 A1 7/2010 Horn et al.
2010/0191631 A1 7/2010 Weidmann
2010/0197318 A1 8/2010 Petersen et al.
2010/0197319 A1 8/2010 Petersen et al.
2010/0198683 A1 8/2010 Aarabi
2010/0198694 A1 8/2010 Muthukrishnan
2010/0198826 A1 8/2010 Petersen
2010/0198828 A1 8/2010 Petersen et al.
2010/0198862 A1 8/2010 Jennings et al.
2010/0198870 A1 8/2010 Petersen et al.
2010/0198917 A1 8/2010 Petersen et al.
2010/0201482 A1 8/2010 Robertson et al.
2010/0201536 A1 8/2010 Robertson et al.
2010/0211431 A1 8/2010 Lutnick et al.
2010/0214436 A1 8/2010 Kim et al.
2010/0223128 A1 9/2010 Dukellis et al.
2010/0223343 A1 9/2010 Bosan et al.
2010/0250109 A1 9/2010 Johnston et al.
2010/0257196 A1 10/2010 Waters et al.
2010/0259386 A1 10/2010 Holley et al.
2010/0262461 A1 10/2010 Bohannon
2010/0273509 A1 10/2010 Sweeney et al.
2010/0281045 A1 11/2010 Dean
2010/0306669 A1 12/2010 Della Pasqua
2010/0318628 A1 12/2010 Pacella et al.

(56) References Cited

U.S. PATENT DOCUMENTS

2010/0323666 A1 12/2010 Cai et al.
2011/0004071 A1 1/2011 Faiola et al.
2011/0010205 A1 1/2011 Richards
2011/0029512 A1 2/2011 Folgner et al.
2011/0035284 A1 2/2011 Moshfeghi
2011/0040783 A1 2/2011 Uemichi et al.
2011/0040804 A1 2/2011 Peirce et al.
2011/0050909 A1 3/2011 Ellenby et al.
2011/0050915 A1 3/2011 Wang et al.
2011/0064388 A1 3/2011 Brown et al.
2011/0066743 A1 3/2011 Hurley et al.
2011/0083101 A1 4/2011 Sharon et al.
2011/0098061 A1 4/2011 Yoon
2011/0102630 A1 5/2011 Rukes
2011/0119133 A1 5/2011 Igelman et al.
2011/0131633 A1 6/2011 Macaskill et al.
2011/0137881 A1 6/2011 Cheng et al.
2011/0145564 A1 6/2011 Moshir et al.
2011/0159890 A1 6/2011 Fortescue et al.
2011/0164163 A1 7/2011 Bilbrey et al.
2011/0170838 A1 7/2011 Rosengart et al.
2011/0197194 A1 8/2011 D'Angelo et al.
2011/0202598 A1 8/2011 Evans et al.
2011/0202968 A1 8/2011 Nurmi
2011/0211534 A1 9/2011 Schmidt et al.
2011/0213845 A1 9/2011 Logan et al.
2011/0215966 A1 9/2011 Kim et al.
2011/0225048 A1 9/2011 Nair
2011/0238300 A1 9/2011 Schenken
2011/0238762 A1 9/2011 Soni et al.
2011/0238763 A1 9/2011 Shin et al.
2011/0251790 A1 10/2011 Liotopoulos et al.
2011/0255736 A1 10/2011 Thompson et al.
2011/0256881 A1 10/2011 Huang et al.
2011/0258260 A1 10/2011 Isaacson
2011/0269479 A1 11/2011 Ledlie
2011/0273575 A1 11/2011 Lee
2011/0282799 A1 11/2011 Huston
2011/0283188 A1 11/2011 Farrenkopf
2011/0288917 A1 11/2011 Wanek
2011/0294541 A1 12/2011 Zheng et al.
2011/0295577 A1 12/2011 Ramachandran
2011/0295677 A1 12/2011 Dhingra et al.
2011/0295719 A1 12/2011 Chen et al.
2011/0314419 A1 12/2011 Dunn et al.
2011/0320373 A1 12/2011 Lee et al.
2012/0023522 A1 1/2012 Anderson et al.
2012/0150978 A1 1/2012 Monaco
2012/0028659 A1 2/2012 Whitney et al.
2012/0033718 A1 2/2012 Kauffman et al.
2012/0036443 A1 2/2012 Ohmori et al.
2012/0054001 A1 3/2012 Zivkovic et al.
2012/0054797 A1 3/2012 Skog et al.
2012/0059722 A1 3/2012 Rao
2012/0062805 A1 3/2012 Candelore
2012/0084731 A1 4/2012 Filman et al.
2012/0084835 A1 4/2012 Thomas et al.
2012/0099800 A1* 4/2012 Llano ..... G06F 17/3087 382/224
2012/0108293 A1 5/2012 Law et al.
2012/0110096 A1 5/2012 Smarr et al.
2012/0113143 A1 5/2012 Adhikari et al.
2012/0113272 A1 5/2012 Hata
2012/0123830 A1 5/2012 Svendsen et al.
2012/0123867 A1 5/2012 Hannan
2012/0123871 A1 5/2012 Svendsen et al.
2012/0123875 A1 5/2012 Svendsen et al.
2012/0124126 A1 5/2012 Alcazar et al.
2012/0124176 A1 5/2012 Curtis et al.
2012/0124458 A1 5/2012 Cruzada
2012/0129548 A1 5/2012 Rao et al.
2012/0131507 A1 5/2012 Sparandara et al.
2012/0131512 A1 5/2012 Takeuchi et al.
2012/0143760 A1 6/2012 Abulafia et al.
2012/0165100 A1 6/2012 Lalancette et al.
2012/0166468 A1 6/2012 Gupta et al.
2012/0166971 A1 6/2012 Sachson et al.
2012/0169855 A1 7/2012 Oh
2012/0172062 A1 7/2012 Altman et al.
2012/0173991 A1 7/2012 Roberts et al.
2012/0176401 A1 7/2012 Hayward et al.
2012/0179549 A1 7/2012 Sigmund et al.
2012/0184248 A1 7/2012 Speede
2012/0197690 A1 8/2012 Agulnek
2012/0197724 A1* 8/2012 Kendall ..... G06Q 30/0261 705/14.58
2012/0200743 A1 8/2012 Blanchflower et al.
2012/0208564 A1 8/2012 Clark et al.
2012/0209892 A1 8/2012 Macaskill et al.
2012/0209924 A1 8/2012 Evans et al.
2012/0210244 A1 8/2012 De Francisco et al.
2012/0212632 A1 8/2012 Mate et al.
2012/0220264 A1 8/2012 Kawabata
2012/0226748 A1 9/2012 Bosworth et al.
2012/0233000 A1 9/2012 Fisher et al.
2012/0236162 A1 9/2012 Imamura
2012/0239761 A1 9/2012 Linner et al.
2012/0250951 A1 10/2012 Chen
2012/0252418 A1 10/2012 Kandekar et al.
2012/0254325 A1 10/2012 Majeti et al.
2012/0270563 A1 10/2012 Sayed
2012/0271684 A1 10/2012 Shutter
2012/0278387 A1 11/2012 Garcia et al.
2012/0278692 A1 11/2012 Shi
2012/0290637 A1 11/2012 Perantatos et al.
2012/0299954 A1 11/2012 Wada et al.
2012/0304052 A1 11/2012 Tanaka et al.
2012/0304080 A1 11/2012 Wormald et al.
2012/0307096 A1 12/2012 Bray et al.
2012/0307112 A1 12/2012 Kunishige et al.
2012/0319904 A1 12/2012 Lee et al.
2012/0323933 A1 12/2012 He et al.
2012/0324018 A1 12/2012 Metcalf et al.
2013/0006759 A1 1/2013 Srivastava et al.
2013/0006777 A1 1/2013 Krishnareddy et al.
2013/0008238 A1 1/2013 Hogeg et al.
2013/0017802 A1 1/2013 Adibi et al.
2013/0024757 A1 1/2013 Doll et al.
2013/0036364 A1 2/2013 Johnson
2013/0045753 A1 2/2013 Obermeyer et al.
2013/0050260 A1 2/2013 Reitan
2013/0055083 A1 2/2013 Fino
2013/0057587 A1 3/2013 Leonard et al.
2013/0059607 A1 3/2013 Herz et al.
2013/0060690 A1 3/2013 Oskolkov et al.
2013/0063369 A1 3/2013 Malhotra et al.
2013/0067027 A1 3/2013 Song et al.
2013/0071093 A1 3/2013 Hanks et al.
2013/0080254 A1* 3/2013 Thramann ..... G06Q 50/06 705/14.57
2013/0085790 A1 4/2013 Palmer et al.
2013/0086072 A1 4/2013 Peng et al.
2013/0090171 A1 4/2013 Holton et al.
2013/0095857 A1 4/2013 Garcia et al.
2013/0104053 A1 4/2013 Thornton et al.
2013/0110885 A1 5/2013 Brundrett, III
2013/0111514 A1 5/2013 Slavin et al.
2013/0115872 A1 5/2013 Huang et al.
2013/0122862 A1 5/2013 Horn et al.
2013/0122929 A1 5/2013 Al-mufti et al.
2013/0124297 A1 5/2013 Hegeman et al.
2013/0128059 A1 5/2013 Kristensson
2013/0129252 A1 5/2013 Lauper
2013/0132194 A1 5/2013 Rajaram
2013/0132477 A1 5/2013 Bosworth et al.
2013/0145286 A1 6/2013 Feng et al.
2013/0157684 A1 6/2013 Moser
2013/0159110 A1 6/2013 Rajaram et al.
2013/0159919 A1 6/2013 Leydon
2013/0169822 A1 7/2013 Zhu et al.
2013/0173380 A1 7/2013 Akbari et al.
2013/0173729 A1 7/2013 Starenky et al.
2013/0182133 A1 7/2013 Tanabe
2013/0185131 A1 7/2013 Sinha et al.

(56) References Cited

U.S. PATENT DOCUMENTS

2013/0191198 A1 7/2013 Carlson et al.
2013/0194301 A1 8/2013 Robbins et al.
2013/0198176 A1 8/2013 Kim
2013/0203373 A1 8/2013 Edge
2013/0217366 A1 8/2013 Kolodziej
2013/0218965 A1 8/2013 Abrol et al.
2013/0218968 A1* 8/2013 McEvilly ..... G06Q 30/0261 709/204
2013/0222323 A1 8/2013 Mckenzie
2013/0227476 A1 8/2013 Frey
2013/0232194 A1 9/2013 Knapp et al.
2013/0254227 A1 9/2013 Shim et al.
2013/0263031 A1 10/2013 Oshiro et al.
2013/0265450 A1 10/2013 Barnes, Jr.
2013/0267253 A1 10/2013 Case et al.
2013/0275505 A1 10/2013 Gauglitz et al.
2013/0290443 A1 10/2013 Collins et al.
2013/0304527 A1 11/2013 Santos, III
2013/0304646 A1 11/2013 De Geer
2013/0311255 A1* 11/2013 Cummins ..... G06Q 30/0235 705/14.13
2013/0325964 A1 12/2013 Berberat
2013/0344896 A1 12/2013 Kirmse et al.
2013/0346869 A1 12/2013 Asver et al.
2013/0346877 A1 12/2013 Borovoy et al.
2014/0006129 A1 1/2014 Heath
2014/0011538 A1 1/2014 Mulcahy et al.
2014/0019264 A1 1/2014 Wachman et al.
2014/0032682 A1 1/2014 Prado et al.
2014/0043204 A1 2/2014 Basnayake et al.
2014/0045530 A1 2/2014 Gordon et al.
2014/0047016 A1 2/2014 Rao
2014/0047045 A1 2/2014 Baldwin et al.
2014/0047335 A1 2/2014 Lewis et al.
2014/0049652 A1 2/2014 Moon et al.
2014/0052485 A1 2/2014 Shidfar
2014/0052633 A1 2/2014 Gandhi
2014/0057648 A1 2/2014 Lyman et al.
2014/0057660 A1 2/2014 Wager
2014/0066106 A1 3/2014 Ngo et al.
2014/0082651 A1 3/2014 Sharifi
2014/0092130 A1 4/2014 Anderson et al.
2014/0095296 A1 4/2014 Angell et al.
2014/0096029 A1 4/2014 Schultz
2014/0114565 A1 4/2014 Aziz et al.
2014/0122658 A1 5/2014 Haeger et al.
2014/0122787 A1 5/2014 Shalvi et al.
2014/0129627 A1 5/2014 Baldwin et al.
2014/0129953 A1 5/2014 Spiegel
2014/0143143 A1 5/2014 Fasoli et al.
2014/0149519 A1 5/2014 Redfern et al.
2014/0153837 A1 6/2014 Steiner
2014/0155102 A1 6/2014 Cooper et al.
2014/0156410 A1 6/2014 Wuersch et al.
2014/0164118 A1 6/2014 Polachi
2014/0172542 A1 6/2014 Poncz et al.
2014/0173424 A1 6/2014 Hogeg et al.
2014/0173457 A1 6/2014 Wang et al.
2014/0180829 A1 6/2014 Umeda
2014/0189592 A1 7/2014 Benchenaa et al.
2014/0207679 A1 7/2014 Cho
2014/0214471 A1 7/2014 Schreiner, III
2014/0222564 A1 8/2014 Kranendonk et al.
2014/0222570 A1 8/2014 Devolites et al.
2014/0258405 A1 9/2014 Perkin
2014/0265359 A1 9/2014 Cheng et al.
2014/0266703 A1 9/2014 Dalley, Jr. et al.
2014/0279040 A1 9/2014 Kuboyama
2014/0279061 A1 9/2014 Elimeliah et al.
2014/0279436 A1 9/2014 Dorsey et al.
2014/0279540 A1 9/2014 Jackson
2014/0280537 A1 9/2014 Pridmore et al.
2014/0282096 A1 9/2014 Rubinstein et al.
2014/0287779 A1 9/2014 O'keefe et al.
2014/0289833 A1 9/2014 Briceno
2014/0306986 A1 10/2014 Gottesman et al.
2014/0317302 A1 10/2014 Naik
2014/0324627 A1 10/2014 Haver et al.
2014/0324629 A1 10/2014 Jacobs
2014/0325383 A1 10/2014 Brown et al.
2014/0337123 A1 11/2014 Nuernberg et al.
2015/0020086 A1 1/2015 Chen et al.
2015/0046278 A1 2/2015 Pei et al.
2015/0071619 A1 3/2015 Brough
2015/0087263 A1 3/2015 Branscomb et al.
2015/0088622 A1 3/2015 Ganschow et al.
2015/0094093 A1 4/2015 Pierce et al.
2015/0095020 A1 4/2015 Leydon
2015/0096042 A1 4/2015 Mizrachi
2015/0116529 A1 4/2015 Wu et al.
2015/0130178 A1 5/2015 Clements
2015/0142753 A1 5/2015 Soon-shiong
2015/0149091 A1 5/2015 Milton et al.
2015/0154650 A1 6/2015 Umeda
2015/0163629 A1 6/2015 Cheung
2015/0169827 A1 6/2015 Laborde
2015/0172534 A1 6/2015 Miyakawaa et al.
2015/0178260 A1 6/2015 Brunson
2015/0186497 A1 7/2015 Patton et al.
2015/0222814 A1 8/2015 Li et al.
2015/0237472 A1 8/2015 Alsina et al.
2015/0237473 A1 8/2015 Koepke
2015/0024971 A1 9/2015 Stefansson et al.
2015/0254704 A1 9/2015 Kothe et al.
2015/0261917 A1 9/2015 Smith
2015/0262208 A1 9/2015 Bjontegard
2015/0269624 A1 9/2015 Cheng et al.
2015/0271779 A1 9/2015 Alavudin
2015/0287072 A1 10/2015 Golden et al.
2015/0294367 A1 10/2015 Oberbrunner et al.
2015/0312184 A1 10/2015 Langholz et al.
2015/0033231 A1 11/2015 Cui et al.
2015/0332317 A1 11/2015 Cui et al.
2015/0332325 A1 11/2015 Sharma et al.
2015/0332329 A1 11/2015 Luo et al.
2015/0341747 A1 11/2015 Barrand et al.
2015/0350136 A1 12/2015 Flynn, III et al.
2015/0358806 A1 12/2015 Salqvist
2015/0365795 A1 12/2015 Allen et al.
2015/0378502 A1 12/2015 Hu et al.
2016/0006927 A1 1/2016 Sehn
2016/0014063 A1 1/2016 Hogeg et al.
2016/0019592 A1 1/2016 Muttineni et al.
2016/0034712 A1 2/2016 Patton et al.
2016/0085773 A1 3/2016 Chang et al.
2016/0098742 A1 4/2016 Minicucci et al.
2016/0099901 A1 4/2016 Allen et al.
2016/0127871 A1 5/2016 Smith et al.
2016/0180887 A1 6/2016 Sehn
2016/0182422 A1 6/2016 Sehn et al.
2016/0182875 A1 6/2016 Sehn
2016/0210657 A1 7/2016 Chittilappilly et al.
2016/0239248 A1 8/2016 Sehn
2016/0277419 A1 9/2016 Allen et al.
2016/0292735 A1 10/2016 Kim
2016/0321708 A1 11/2016 Sehn
2017/0006094 A1 1/2017 Abou Mahmoud et al.
2017/0026786 A1 1/2017 Barron et al.
2017/0061308 A1 3/2017 Chen et al.
2017/0078760 A1 3/2017 Christoph et al.
2017/0091795 A1 3/2017 Mansour et al.
2017/0127233 A1 5/2017 Liang et al.
2017/0132647 A1 5/2017 Bostick et al.
2017/0164161 A1 6/2017 Gupta et al.
2017/0186038 A1 6/2017 Glover et al.
2017/0222962 A1 8/2017 Gauglitz et al.
2017/0230315 A1 8/2017 Zubas et al.
2017/0287006 A1 10/2017 Azmoodeh et al.
2017/0339521 A1 11/2017 Colonna et al.
2017/0359686 A1 12/2017 Colonna et al.
2018/0121957 A1 5/2018 Cornwall et al.
2018/0189835 A1 7/2018 Deluca et al.
2018/0225687 A1 8/2018 Ahmed et al.
2019/0372991 A1 12/2019 Allen et al.

(56) References Cited

U.S. PATENT DOCUMENTS

| | | | |
|---|---|---|---|
| 2020/0204726 | A1 | 6/2020 | Ebsen et al. |
| 2020/0288270 | A1 | 9/2020 | Allen et al. |
| 2020/0359166 | A1 | 11/2020 | Noeth et al. |
| 2020/0359167 | A1 | 11/2020 | Noeth et al. |
| 2021/0014238 | A1 | 1/2021 | Allen et al. |
| 2021/0073249 | A1 | 3/2021 | Chang et al. |

FOREIGN PATENT DOCUMENTS

| | | | | |
|---|---|---|---|---|
| CN | 103200238 | A | 7/2013 | |
| CN | 105760466 | A | 7/2016 | |
| CN | 107637099 | A | 1/2018 | |
| CN | 110249359 | A | 9/2019 | |
| CN | 1076370998 | | 10/2020 | |
| CN | 112040410 | A | 12/2020 | |
| EP | 3062590 | A1 | 4/2009 | |
| EP | 2151797 | A1 | 2/2010 | |
| GB | 2399928 | A | 9/2004 | |
| KR | 19990073076 | A | 10/1999 | |
| KR | 20010078417 | A | 8/2001 | |
| KR | 101457964 | B1 | 11/2014 | |
| KR | 20160019900 | A | 2/2016 | |
| KR | 102035405 | B1 | 10/2019 | |
| KR | 102163528 | B1 | 9/2020 | |
| WO | WO-1996024213 | A1 | 8/1996 | |
| WO | WO-1999063453 | A1 | 12/1999 | |
| WO | WO-2000058882 | A1 | 10/2000 | |
| WO | WO-2001029642 | A1 | 4/2001 | |
| WO | WO-2001050703 | A3 | 7/2001 | |
| WO | WO-2006118755 | A2 | 11/2006 | |
| WO | WO-2007092668 | A2 | 8/2007 | |
| WO | WO-2009043020 | A2 | 4/2009 | |
| WO | WO-2011040821 | A1 | 4/2011 | |
| WO | WO 2011119407 | A1 * | 9/2011 | ..... G06Q 30/00 |
| WO | WO-2013008238 | | 1/2013 | |
| WO | WO-2013045753 | A1 | 4/2013 | |
| WO | WO-2014068573 | A1 | 5/2014 | |
| WO | WO-2014115136 | A1 | 5/2014 | |
| WO | WO-2014172388 | A1 | 10/2014 | |
| WO | WO-2014194262 | A2 | 12/2014 | |
| WO | WO-2015192026 | A1 | 12/2015 | |
| WO | WO-2016044424 | A1 | 3/2016 | |
| WO | WO-2016054562 | A1 | 4/2016 | |
| WO | WO-2016065131 | A1 | 4/2016 | |
| WO | WO-2016100318 | A2 | 6/2016 | |
| WO | WO-2016100318 | A3 | 6/2016 | |
| WO | WO-2016100342 | A1 | 6/2016 | |
| WO | WO-2016123381 | A1 | 8/2016 | |
| WO | WO-2016149594 | A1 | 9/2016 | |
| WO | WO-2016179166 | A1 | 11/2016 | |
| WO | WO-2018144931 | A1 | 8/2018 | |

OTHER PUBLICATIONS

US 10,542,011 B2, 01/2020, Allen et al. (withdrawn)
"How Snaps Are Stored And Deleted", Snapchat, [Online], Retrieved from the Internet: <URL: https://web.archive.org/web/20130607042322/http://blog.snapchat.com/post/50060403002/how-snaps-are-stored-and-deleted, (May 9, 2013), 2 pgs.
"International Application Serial No. PCT/US2014/040346, International Search Report dated Mar. 23, 2015", 2 pgs.
"International Application Serial No. PCT/US2014/040346, Written Opinion dated Mar. 23, 2015", 6 pgs.
"iVisit Mobile Getting Started", IVISIT, (Dec. 4, 2013), 1-16.
Melanson, Mike, "This text message will self destruct in 60 seconds", readwrite.com, [Online]. Retrieved from the Internet: <http://readwrite.com/2011/02/11/this_text_message_will_self_destruct_in_60_seconds>, (Feb. 18, 2015).
Sawers, Paul, "Snapchatfor iOS Lets You Send Photos to Friends and Set How long They're Visible For", [Online], Retrieved from the Internet: <http:/ /thenextweb.com/apps/2012/05/07/Snapchat-for-ios-lets-you-send-photos-to-friends-and-set-how-long-theyre-visiblefor/#! xCjrp>,, (May 7, 2012), 1-5.
Shein, Esther, "Ephemeral Data", Communications of the ACM vol. 56 | No. 9, (Sep. 2013), 20-22.
"A Whole New Story", [Online]. Retrieved from the Internet: <https://www.snap.com/en-US/news/>, (2017), 13 pgs.
"Adding a watermark to your photos", eBay, [Online]. Retrieved from the Internet:<URL:https://pages.ebay.com/help/sell/pictures.html>, (accessed May 24, 2017), 4 pgs.
"U.S. Appl. No. 14/304,855, Corrected Notice of Allowance dated Jun. 26, 2015", 8 pgs.
"U.S. Appl. No. 14/304,855, Final Office Action dated Feb. 18, 2015", 10 pgs.
"U.S. Appl. No. 14/304,855, Non Final Office Action dated Mar. 18, 2015", 9 pgs.
"U.S. Appl. No. 14/304,855, Non Final Office Action dated Oct. 22, 2014", 11 pgs.
"U.S. Appl. No. 14/304,855, Notice of Allowance dated Jun. 1, 2015", 11 pgs.
"U.S. Appl. No. 14/304,855, Response filed Feb. 25, 2015 to Final Office Action dated Feb. 18, 2015", 5 pgs.
"U.S. Appl. No. 14/304,855, Response filed Apr. 1, 2015 to Non Final Office Action dated Mar. 18, 2015", 4 pgs.
"U.S. Appl. No. 14/304,855, Response filed Nov. 7, 2014 to Non Final Office Action dated Oct. 22, 2014", 5 pgs.
"U.S. Appl. No. 14/505,478, Advisory Action dated Apr. 14, 2015", 3 pgs.
"U.S. Appl. No. 14/505,478, Corrected Notice of Allowance dated May 18, 2016", 2 pgs.
"U.S. Appl. No. 14/505,478, Corrected Notice of Allowance dated Jul. 22, 2016", 2 pgs.
"U.S. Appl. No. 14/505,478, Final Office Action dated Mar. 17, 2015", 16 pgs.
"U.S. Appl. No. 14/505,478, Non Final Office Action dated Jan. 27, 2015", 13 pgs.
"U.S. Appl. No. 14/505,478, Non Final Office Action dated Sep. 4, 2015", 19 pgs.
"U.S. Appl. No. 14/505,478, Notice of Allowance dated Apr. 28, 2016", 11 pgs.
"U.S. Appl. No. 14/505,478, Notice of Allowance dated Aug. 26, 2016", 11 pgs.
"U.S. Appl. No. 14/505,478, Response filed Jan. 30, 2015 to Non Final Office Action dated Jan. 27, 2015", 10 pgs.
"U.S. Appl. No. 14/505,478, Response filed Mar. 4, 2016 to Non Final Office Action dated Sep. 4, 2015", 12 pgs.
"U.S. Appl. No. 14/505,478, Response filed Apr. 1, 2015 to Final Office Action dated Mar. 17, 2015", 6 pgs.
"U.S. Appl. No. 14/506,478, Response filed Aug. 17, 2015 to Advisory Action dated Apr. 14, 2015", 10 pgs.
"U.S. Appl. No. 14/523,728, Non Final Office Action dated Dec. 12, 2014", 10 pgs.
"U.S. Appl. No. 14/523,728, Notice of Allowance dated Mar. 24, 2015", 8 pgs.
"U.S. Appl. No. 14/523,728, Notice of Allowance dated Apr. 15, 2015", 8 pgs.
"U.S. Appl. No. 14/523,728, Notice of Allowance dated Jun. 5, 2015", 8 pgs.
"U.S. Appl. No. 14/523,728, Response filed Aug. 25, 2014 to Non Final Office Action dated Jan. 16, 2015", 5 pgs.
"U.S. Appl. No. 14/529,064, Final Office Action dated Aug. 11, 2015", 23 pgs.
"U.S. Appl. No. 14/529,064, Final Office Action dated Aug. 24, 2016", 23 pgs.
"U.S. Appl. No. 14/529,064, Non Final Office Action dated Mar. 12, 2015", 20 pgs.
"U.S. Appl. No. 14/529,064, Non Final Office Action dated Apr. 6, 2017", 25 pgs.
"U.S. Appl. No. 14/529,064, Non Final Office Action dated Apr. 18, 2016", 21 pgs.
"U.S. Appl. No. 14/529,064, Response filed Feb. 5, 2015 to Restriction Requirement dated Feb. 2, 2015", 6 pgs.
"U.S. Appl. No. 14/529,064, Response filed Mar. 26, 2015 to Non Final Office Action dated Mar. 12, 2015", 8 pgs.
"U.S. Appl. No. 14/529,064, Response filed Jul. 18, 2016 to Non Final Office Action dated Apr. 18, 2016", 20 pgs.

(56) References Cited

OTHER PUBLICATIONS

"U.S. Appl. No. 14/529,064, Restriction Requirement dated Feb. 2, 2015", 5 pgs.
"U.S. Appl. No. 14/529,064, filed Oct. 12, 2015 to Final Office Action dated Aug. 11, 2015", 19 pgs.
"U.S. Appl. No. 14/539,391, Notice of Allowance dated Mar. 5, 2015", 17 pgs.
"U.S. Appl. No. 14/548,590, Advisory Action dated Nov. 18, 2016", 3 pgs.
"U.S. Appl. No. 14/548,590, Final Office Action dated Jul. 5, 2016", 16 pgs.
"U.S. Appl. No. 14/548,590, Final Office Action dated Sep. 16, 2015", 15 pgs.
"U.S. Appl. No. 14/548,590, Non Final Office Action dated Jan. 9, 2017", 14 pgs.
"U.S. Appl. No. 14/548,590, Non Final Office Action dated Feb. 11, 2016", 16 pgs.
"U.S. Appl. No. 14/548,590, Non Final Office Action dated Apr. 20, 2015", 14 pgs.
"U.S. Appl. No. 14/548,590, Response filed May 9, 2017 to Non Final Office Action dated Jan. 9, 2017", 17 pgs.
"U.S. Appl. No. 14/548,590, Response filed May 10, 2016 to Non Final Office Action dated Feb. 11, 2016", 14 pgs.
"U.S. Appl. No. 14/548,590, Response filed Nov. 7, 2016 to Final Office Action dated Jul. 5, 2016", 14 pgs.
"U.S. Appl. No. 14/548,590, Response filed Dec. 16, 2015 to Final Office Action dated Sep. 16, 2015", 13 pgs.
"U.S. Appl. No. 14/548,590, Response filed Jun. 16, 2015 to Non Final Office Action dated Apr. 20, 2015", 19 pgs.
"U.S. Appl. No. 14/578,258, Examiner Interview Summary dated Nov. 25, 2015", 3 pgs.
"U.S. Appl. No. 14/578,258, Non Final Office Action dated Jun. 10, 2015", 12 pgs.
"U.S. Appl. No. 14/578,258, Notice of Allowance dated Feb. 26, 2016", 5 pgs.
"U.S. Appl. No. 14/578,258, Response filed Dec. 10, 2015 to Non Final Office Action dated Jun. 10, 2015", 11 pgs.
"U.S. Appl. No. 14/578,271, Final Office Action dated Dec. 3, 2015", 15 pgs.
"U.S. Appl. No. 14/578,271, Non Final Office Action dated Aug. 7, 2015", 12 pgs.
"U.S. Appl. No. 14/578,271, Notice of Allowance dated Dec. 7, 2016", 7 pgs.
"U.S. Appl. No. 14/578,271, Response filed Feb. 9, 2016 to Final Office Action dated Dec. 3, 2015", 10 pgs.
"U.S. Appl. No. 14/578,271, Response filed Jun. 19, 2015 to Restriction Requirement dated Apr. 23, 2015", 6 pgs.
"U.S. Appl. No. 14/578,271, filed Oct. 28, 2015 to Non Final Office Action dated Aug. 7, 2015", 9 pgs.
"U.S. Appl. No. 14/578,271, Restriotion Requirement dated Apr. 23, 2015", 8 pgs.
"U.S. Appl. No. 14/594,410, Non Final Office Action dated Jan. 4, 2016", 10 pgs.
"U.S. Appl. No. 14/594,410, Notice of Allowance dated Aug. 2, 2016", 5 pgs.
"U.S. Appl. No. 14/594,410, Notice of Allowance dated Dec. 15, 2016".
"U.S. Appl. No. 14/594,410, Response filed Jul. 1, 2016 to Non Final Office Action dated Jan. 4, 2016", 10 pgs.
"U.S. Appl. No. 14/612,692, Examiner Interview Summary dated Jan. 29, 2016", 5 pgs.
"U.S. Appl. No. 14/612,692, Examiner Interview Summary dated Jul. 6, 2016", 4 pgs.
"U.S. Appl. No. 14/612,692, Examiner Interview Summary dated Aug. 14, 2015", 3 pgs.
"U.S. Appl. No. 14/612,692, Examiner Interview Summary dated Sep. 8, 2016", 3 pgs.
"U.S. Appl. No. 14/612,692, Final Office Action dated Aug. 15, 2016", 18 pgs.
"U.S. Appl. No. 14/612,692, Final Office Action dated Nov. 23, 2015", 15 pgs.
"U.S. Appl. No. 14/612,692, Non Final Office Action dated Jan. 3, 2017", 17 pgs.
"U.S. Appl. No. 14/612,692, Non Final Office Action dated Mar. 28, 2016", 15 pgs.
"U.S. Appl. No. 14/612,692, Non Final Office Action dated Jul. 20, 2015", 25 pgs.
"U.S. Appl. No. 14/612,692, Response filed Feb. 23, 2016 to Final Office Action dated Nov. 23, 2015", 10 pgs.
"U.S. Appl. No. 14/612,692, filed May 3, 2017 to Non Final Office Action dated Jan. 3, 2017", 18 pgs.
"U.S. Appl. No. 14/612,692, Response filed Nov. 14, 2016 to Final Office Action dated Aug. 15, 2016", 15 pgs.
"U.S. Appl. No. 14/612,692, Response filed Jun. 28, 2016 to Non Final Office Action dated Mar. 28, 2016", 14 pgs.
"U.S. Appl. No. 14/612,692. Response filed Oct. 19, 2015 to Non Final Office Action dated Jul. 20, 2015", 11 pgs.
"U.S. Appl. No. 14/634,417, Advisory Action dated Mar. 14, 2017", 3 pgs.
"U.S. Appl. No. 14/634,417, Final Office Action dated Jan. 31, 2017", 27 pgs.
"U.S. Appl. No. 14/634,417, Non Final Office Action dated Aug. 30, 2016", 23 pgs.
"U.S. Appl. No. 14/634,417, Response filed Mar. 2, 2017 to Final Office Action dated Jan. 31, 2017", 23 pgs.
"U.S. Appl. No. 14/634,417, Response filed Nov. 30, 2016 to Non Final Office Action dated Aug. 30, 2016", 18 pgs.
"U.S. Appl. No. 14/682,259, Notice of Allowance dated Jul. 27, 2015", 17 pgs.
"U.S. Appl. No. 14/704,212, Final Office Action dated Jun. 17, 2016", 12 pgs.
"U.S. Appl. No. 14/704,212, Non Final Office Action dated Dec. 4, 2015", 17 pgs.
"U.S. Appl. No. 14/704,212, Response filed Mar. 4, 2016 to Non Final Office Action dated Dec. 4, 2015", 11 pgs.
"U.S. Appl. No. 14/738,069, Non Final Office Action dated Mar. 21, 2016", 12 pgs.
"U.S. Appl. No. 14/738,069, Notice of Allowance dated Aug. 17, 2016", 6 pgs.
"U.S. Appl. No. 14/738,069, Response filed Jun. 10, 2016 to Non Final Office Action dated Mar. 21, 2016", 10 pgs.
"U.S. Appl. No. 14/808,283, Notice of Allowance dated Apr. 12, 2016", 9 pgs.
"U.S. Appl. No. 14/808,283, Notice of Allowance dated Jul. 14, 2016", 8 pgs.
"U.S. Appl. No. 14/808,283, Preliminary Amendment filed Jul. 24, 2015", 8 pgs.
"U.S. Appl. No. 14/841,987, Notice of Allowance dated Mar. 29, 2017", 17 pgs.
"U.S. Appl. No. 14/967,472, Final Office Action dated Mar. 10, 2017", 15 pgs.
"U.S. Appl. No. 14/967,472, Non Final Office Action dated Sep. 8, 2016", 11 pgs.
"U.S. Appl. No. 14/967,472, Preliminary Amendment filed Dec. 15, 2015", 6 pgs.
"U.S. Appl. No. 14/967,472, Response filed Dec. 5, 2016 to Non Final Office Action dated Sep. 8, 2016", 11 pgs.
"U.S. Appl. No. 15/137,608, Preliminary Amendment filed Apr. 26, 2016", 6 pgs.
"U.S. Appl. No. 15/152,975, Non Final Office Action dated Jan. 12, 2017", 36 pgs.
"U.S. Appl. No. 15/152,975, Preliminary Amendment filed May 19, 2016", 8 pgs.
"U.S. Appl. No. 15/208,460, Notice of Allowance dated Feb. 27, 2017", 8 pgs.
"U.S. Appl. No. 15/208,460, Notice of Allowance dated Dec. 30, 2016", 9 pgs.
"U.S. Appl. No. 15/208,460, Supplemental Preliminary Amendment filed Jul. 18, 2016", 8 pgs.
"U.S. Appl. No. 15/224,312, Preliminary Amendment filed Feb. 1, 2017", 11 pgs.

(56) References Cited

OTHER PUBLICATIONS

"U.S. Appl. No. 15/224,343, Preliminary Amendment filed Jan. 31, 2017", 10 pgs.
"U.S. Appl. No. 15/224,355, Preliminary Amendment filed Apr. 3, 2017", 12 pgs.
"U.S. Appl. No. 15/224,372, Preliminary Amendment filed May 5, 2017", 10 pgs.
"U.S. Appl. No. 15/224,359, Preliminary Amendment filed Apr. 19, 2017", 8 pgs.
"U.S. Appl. No. 15/298,806, Non Final Office Action dated Jun. 12, 2017", 26 pgs.
"U.S. Appl. No. 15/298,806, Preliminary Amendment filed Oct. 21, 2016", 8 pgs.
"U.S. Appl. No. 15/416,846, Preliminary Amendment filed Feb. 18, 2017", 10 pgs.
"U.S. Appl. No. 15/486,111, Non Final Office Action dated May 9, 2017", 17 pgs.
"BlogStomp", [Online], Retrieved from the Internet: <URL:http://stompsoftware.com/blogstomp>, (accessed May 24, 2017), 12 pgs.
"Canadian Application Serial No. 2,894,332 Response filed Jan. 24, 2017 to Office Action dated Aug. 16, 2016", 15 pgs.
"Canadian Application Serial No. 2,894,332, Office Action dated Aug. 16, 2016", 4 pgs.
"Canadian Application Serial No. 2,910,158, Office Action dated Dec. 15, 2016", 5 pgs.
"Canadian Application Serial No. 2,910,158, Response filed Apr. 11, 2017 to Office Action dated Dec. 15, 2016", 21 pgs.
"Cup Magic Starbucks Holiday Red Cups come to life with AR app", [Online]. Retrieved from the Internet: <http://www.blastradius.com/work/cup-magic>, (2016), 7 pgs.
"Daily App: InstaPlace (iOS/Android): Give Pictures a Sense of Place", TechPP, [Online]. Retrieved from the Internet: <URL;http://techpp.com/2013/02/15/instaplace-app-review>, (2013), 13 pgs.
"InstaPlace Photo App Tell The Whole Story", [Online]. Retrieved from the Internet; <https://youtu.be/uF_gFkg1hBM>, (Nov. 8, 2013), 113 pgs.
"International Application Serial No. PCT/EP2008/063682, International Search Report dated Nov. 24, 2008", 3 pgs.
"International Application Serial No. PCT/US2015/035591, International Preliminary Report on Patentability dated Dec. 22, 2016", 7 pgs.
"International Application Serial No. PCT/US2015/035591, International Search Report dated Aug. 11, 2015", 5 pgs.
"International Application Serial No. PCT/US2015/035591, International Written Opinion dated Aug. 11, 2015", 5 pgs.
"International Application Serial No. PCT/US2015/050424, International Search Report dated Dec. 4, 2015", 2 pgs.
"International Application Serial No. PCT/US2015/050424, Written Opinion dated Dec. 4, 2015", 10 pgs.
"International Application Serial No. PCT/US2015/053811, International Preliminary Report ion Patentability dated Apr. 13, 2017", 9 pgs.
"International Application Serial No. PCT/US2015/053811, International Search Report dated Nov. 23, 2015", 5 pgs.
"International Application Serial No. PCT/US2015/053811, Written Opinion dated Nov. 23, 2015", 8 pgs.
"International Application Serial No. PCT/US2015/056884, International Preliminary Report on Patentability dated May 4, 2017", 8 pgs.
"International Application Serial No. PCT/US2015/056884, International Search Report dated Dec. 22, 2015", 5 pgs.
"International Application Serial No. PCT/US2015/056884, Written Opinion dated Dec. 22, 2015", 6 pgs.
"International Application Serial No. PCT/US2015/065785, International Search Report dated Jul. 21, 2016", 5 pgs.
"International Application Serial No. PCT/US2015/065785, Written Opinion dated Jul. 21, 2016", 5 pgs.
"International Application Serial No. PCT/US2015/065821, International Search Report dated Mar. 3, 2016", 2 pgs.
"International Application Serial No. PCT/US2015/065821, Written Opinion dated Mar. 3, 2016", 3 pgs
"International Application Serial No. PCT/US2016/023085, International Search Report dated Jun. 17, 2016", 5 pgs.
"International Application Serial No. PCT/US2016/023085, Written Opinion dated Jun. 17, 2016", 6 pgs.
"International Application Serical No. PCT/US 2015/037251, International Search Report dated Sep. 29, 2015", 7 pgs.
"Introducing Snapchat Stories", [Online], Retrieved from the Internet:<https://www.youtube.com/watch?v=88Cu3yN-LIM>, (Oct. 3, 2013), 92 pgs.
"Macy's Believe-o-Magic", {Online}. Retrieved from the Internet: <https://www.youtube.com/watch?v=xvzRXy3J0Z0>, (Nov. 7, 2011), 102 pgs.
"Macy's Introduces Augmented Reality Experience in Stores across Country as Part of Its 2011 "Believe" Campaign", [Online]. Retrieved from the Internet: <http://www.businesswire.com/news/home/20111102006759/en/Macy%E2%80%99s-Introduces-Augmented-Reality-Experience-Stores-Country>., (Nov. 2, 2011), 6 pgs.
"Pluraleyes by Red Giant", © 2002-2015 Red Giant LLC, [Online], Retrieved from the Internet: <URL: http://www.redgiant.com/products/pluraleyes/, (Accessed Nov. 11, 2015), 5 pgs.
"Starbucks Cup Magic", {Onliine}. Retrieved from the Internet: <https://www.youtube.com/watch?v=RWwQXi9RG0w>, (Nov. 8, 2011), 87 pgs.
"Starbucks Cup Magic for Valentine's Day", {Online}. Retrieved from the Internet: <https://www.youtube.com/watch?v=8nvqOzjq10w>, (Feb. 6, 2012), 88 pgs.
"Starbucks Holiday Red Cups Come to Life, Signaling the Return of the Merriest Season", [Online]. Retrieved from the Internet: <http://www.businesswire.com/news/home/20111115005744/en/2479513/Starbucks-Holiday-Red-Cups-Life-Signaling-Return>, (Nov. 15, 2011), 5 pgs.
Carthy, Roi, "Dear All Photo Apps: Mobli Just Won Filters", [Online]. Retrieved from the Internet: URL<https://techcrunch.com/2011/09/08/mobil-filters>, (Sep. 8, 2011), 10 pgs.
Castelluccia, Claude, et al., "EphPub: Toward robust Epherneral Publishing", Network Protocols (ICNP), 2011 19th IEEE International Conference on, IEEE, (Oct. 17, 2011), 18 pgs.
Clarke, Tangier, "Automatically syncing multiple clips and lots of audio like PluralEyes possible?", [Online]. Retrieved from the Internet: <URL: https://forums.creativecow.net/thread/344/20553, (May 21, 2013), 8 pgs.
Janthong, Isaranu, "Android App Review Thailand", [Online]. Retrieved from the Internet:<http://www.android-free-app-review.com/2013/01/instaplace-android-google-play-store.html>, (Jan. 23, 2013), 9 pgs.
Leyden, John, "This SMS will self-destruct in 40 seconds", [Online], Retrieved from the Internet: <URL: http://www.theregister.co.uk/2005/12/12/stealthtext/, (Dec. 12, 2005), 1 pg.
Macleod, Duncan, "Macys Believe-o-Magic App", [Online]. Retrieved from the Internet: <URL:http://theinspirationroom.com/daily/2011/macys-believe-o-magic-app>, (Nov. 14, 2011), 10 pgs.
Macleod, Duncan, "Starbucks Cup Magic—Let's Merry", {Online}. Retrieved from the Internet: <URL; http://theinspirationroom.com/daily/2011/starbucks-cup-magic>, (Nov. 12, 2011), 8 pgs.
Notopoulos, Katie, "A Guide To The New Snapchat Filters And Big Fonts", [Online]. Retrieved from the Internet:<https://www.buzzfeed.com/katienotopoulos/a-guide-to-the-new-snapchat-filters-and-big-fonts?utm_term=.bkQ9qVZWe#.nv58YXpkV>, (Dec. 22, 2013), 13 pgs.
Panzarino, Matthew, "Snapchat Adds Filters, A Replay Function And For Whatever Reason, Time, Temperature And Speed Overlays", [Online], Retrieved from the Internet: <https://techcrunch.com/2013/12/20/snapchat-adds-filters-new-font-and-for-some-reason-time-temperature-and-speed-overlays/>, (Dec. 20, 2013), 12 pgs.
Sawers, Paul, "Snapchat for ios lets you send photos to friends and set how long they're visible for", http ://thenextweb.com/apps/2012/05/07/ snapchat-for-ios-lets-you-send-photos-to-f riends-and-set-how-long-theyre-visible-for, (May 2012), 1-3 pgs.
Trice, Andrew, "My Favorite New Feature: Multi-Clip Sync in Premiere Pro CC", [Online]. Retrieved from the Internet: <URL:

(56) References Cited

OTHER PUBLICATIONS http://www.tricedesigns.com/2013/06/18/my-favorite-new-feature-multi-cam-synch-in-premiere-pro-cc/, (Jun. 18, 2013), 5 pgs.
Tripathi, Rohit, "Watermark Images in PHP And Save File on Server", [Online]. Retrieved from the Internet: <URL:http://code.rohitink.com/2012/12/28/watermark-images-in-php-and-save-file-on-server/, (Dec. 28, 2012), 4 pgs.
"U.S. Appl. No. 14/529,064, Examiner Interview Summary dated May 23, 2016", 3 pgs.
"U.S. Appl. No. 14/529,064, Examiner Interview Summary dated Nov. 17, 2016", 3 pgs.
"U.S. Appl. No. 14/529,064, Response filed Sep. 6, 2017 to Non Final Office Action dated Apr. 6, 2017", 19 pgs.
"U.S. Appl. No. 14/529,064, Response filed Dec. 21, 2016 to Final Office Action dated Aug. 24, 2016", 17 pgs.
"U.S. Appl. No. 14/548,590, Final Office Action dated Jul. 18, 2017", 20 pgs.
"U.S. Appl. No. 14/841,987, Notice of Allowance dated Aug. 7, 2017", 8 pgs.
"U.S. Appl. No. 15/298,806, Final Office Action dated Oct. 24, 2017", 15 pgs.
"U.S. Appl. No. 15/298,806, Response filed Sep. 12, 2017 to Non Final Office Action dated Jun. 12, 2017", 12 pgs.
"U.S. Appl. No. 15/486,111, Corrected Notice of Allowance dated Sep. 7, 2017".
"U.S. Appl. No. 15/486,111, Notice of Allowance dated Aug. 30, 2017", 5 pgs.
"U.S. Appl. No. 15/486,111, Response filed Aug. 9, 2017 to Non Final Office Action dated May 9, 2017", 11 pgs.
"International Application Serial No. PCT/US2016/023085, International Preliminary Report on Patentability dated Sep. 28, 2017", 8 pgs.
"U.S. Appl. No. 14/529,064, Final Office Action dated Jan. 25, 2018", 39 pgs.
"U.S. Appl. No. 15/074,029, Response filed Feb. 28, 2018 to Non Final Office Action dated Nov. 30, 2017", 12 pgs.
"U.S. Appl. No. 15/298,806, Advisory Action dated Jan. 29, 2018", 4 pgs.
"U.S. Appl. No. 15/298,806, Examiner Interview Summary dated Jan. 12, 2018", 3 pgs.
"U.S. Appl. No. 15/298,806, Response filed Jan. 9, 2018 to Final Office Action dated Oct. 24, 2017", 17 pgs.
"U.S. Appl. No. 15/835,100, Non Final Office Action dated Jan. 23, 2018", 18 pgs.
"International Application Serial No. PCT/US2018/016723, International Search Report dated Apr. 5, 2018", 2 pgs.
"International Application Serial No. PCT/US2018/016723, Written Opinion dated Apr. 5, 2018", 17 pgs.
"U.S. Appl. No. 14/548,590, Advisory Action dated Apr. 19, 2018", 2 pgs.
"U.S. Appl. No. 14/548,590, Appeal Brief filed Apr. 20, 2018", 28 pgs.
"U.S. Appl. No. 15/298,806, Non Final Office Action dated May 17, 2018", 16 pgs.
"U.S. Appl. No. 15/835,100, Response filed Apr. 23, 2018 to Non Final Office Action dated Jan. 23, 2018", 11 pgs.
"European Application Serial No. 16716090.2, Response filed May 21, 2018 to Communication pursuant to Rules 161(1) and 162 EPC dated Nov. 10, 2017", w/ English Claims, 89 pgs.
"U.S. Appl. No. 15/074,029, Non Final Office Action dated Nov. 30, 2017", 16 pgs.
"U.S. Appl. No. 14/529,064, Non Final Office Action dated Jul. 13, 2018", 38 pgs.
"U.S. Appl. No. 14/529,064, Response filed May 25, 2018 to Final Office Action dated Jan. 25, 2018", 20 pgs.
"U.S. Appl. No. 14/548,590, Appeal Decision dated Mar. 26, 2020", 13 pgs.
"U.S. Appl. No. 14/548,590, Notice of Allowance dated Jun. 17, 2020", 9 pgs.
"U.S. Appl. No. 15/074,029, Advisory Action dated Oct. 11, 2018", 3 pgs.
"U.S. Appl. No. 15/074,029, Corrected Notice of Allowability dated Feb. 5, 2020", 4 pgs.
"U.S. Appl. No. 15/074,029, Corrected Notice of Allowability dated Aug. 20, 2019", 10 pgs.
"U.S. Appl. No. 15/074,029, Final Office Action dated Jun. 28, 2018", 22 pgs.
"U.S. Appl. No. 15/074,029, Non Final Office Action dated Jan. 23, 2019", 19 pgs.
"U.S. Appl. No. 15/074,029, Notice of Allowance dated Jun. 19, 2019", 14 pgs.
"U.S. Appl. No. 15/074,029, Response filed Aug. 28, 2018 to Final Office Action dated Jun. 28, 2018", 21pgs.
"U.S. Appl. No. 15/074,029, Response filed Apr. 23, 2019 to Non Final Office Action dated Jan. 23, 2019", 15 pgs.
"U.S. Appl. No. 15/298,806, Examiner Interview Summary dated Aug. 13, 2018", 3 pgs.
"U.S. Appl. No. 15/298,806, Notice of Allowance dated Sep. 19, 2018", 5 pgs.
"U.S. Appl. No. 15/298,806, Response filed Aug. 10, 2018 to Non Final Office Action dated May 17, 2018", 15 pgs.
"U.S. Appl. No. 15/424,184, Advisory Action dated May 26, 2020", 6 pgs.
"U.S. Appl. No. 15/424,184, Advisory Action dated Aug. 25, 2020", 5 pgs.
"U.S. Appl. No. 15/424,184, Examiner Interview Summary dated Jan. 10, 2019", 3 pgs.
"U.S. Appl. No. 15/424,184, Examiner Interview Summary dated Jul. 30, 2019", 2 pgs.
"U.S. Appl. No. 15/424,184, Final Office Action dated Jan. 29, 2019", 14 pgs.
"U.S. Appl. No. 15/424,184, Final Office Action dated Mar. 9, 2020", 19 pgs.
"U.S. Appl. No. 15/424,184, Final Office Action dated Jul. 27, 2020", 18 pgs.
"U.S. Appl. No. 15/424,184, Final Office Action dated Sep. 9, 2019", 13 pgs.
"U.S. Appl. No. 15/424,184, Non Final Office Action dated May 21, 2019", 16 pgs.
"U.S. Appl. No. 15/424,184, Non Final Office Action dated Jun. 29, 2020", 19 pgs.
"U.S. Appl. No. 15/424,184, Non Final Office Action dated Nov. 30, 2018", 22 pgs.
"U.S. Appl. No. 15/424,184, Non Final Office Action dated Dec. 2, 2019", 16 pgs.
"U.S. Appl. No. 15/424,184, Notice of Allowance dated Sep. 25, 2020", 10 pgs.
"U.S. Appl. No. 15/424,184, Response filed Mar. 2, 2020 to Non Final Office Action dated Dec. 2, 2019", 11 pgs.
"U.S. Appl. No. 15/424,184, Response filed May 11, 2020 to Final Office Action dated Mar. 9, 2020", 14 pgs.
"U.S. Appl. No. 15/424,184, Response filed Jul. 13, 2020 to Non Final Office Action dated May 5, 2020", 11 pgs.
"U.S. Appl. No. 15/424,184, Response filed Aug. 5, 2020 to Final Office Action dated Jul. 27, 2020", 12 pgs.
"U.S. Appl. No. 15/424,184, Response filed Aug. 21, 2019 to Non Final Office Action dated May 21, 2019", 12 pgs.
"U.S. Appl. No. 15/424,184, Response filed Sep. 1, 2020 to Advisory Action dated Aug. 25, 2020", 9 pgs.
"U.S. Appl. No. 15/424,184, Response filed Nov. 11, 2019 to Final Office Action dated Sep. 9, 2019", 12 pgs.
"U.S. Appl. No. 15/424,184, Response filed Apr. 29, 2019 to Final Office Action dated Jan. 29, 2019", 11 pgs.
"U.S. Appl. No. 15/424,184k, Response filed Jan. 4, 2019 to Non Final Office Action dated Nov. 30, 2018", 17 past.
"U.S. Appl. No. 15/474,821, Advisory Action dated Dec. 19, 2019", 3 pgs.
"U.S. Appl. No. 15/474,821, Final Office Action dated Sep. 3, 2019", 19 pgs.
"U.S. Appl. No. 15/474,821, Non Final Office Action dated Jan. 25, 2019", 17 pgs.

(56) References Cited

OTHER PUBLICATIONS

"U.S. Appl. No. 15/474,821, Non Final Office Action dated Mar. 18, 2021", 17 pgs.
"U.S. Appl. No. 15/474,821, Notice of Non-Compliant Amendment dated Sep. 8, 2020", 6 pgs.
"U.S. Appl. No. 15/474,821, Response filed Jan. 7, 2021 to Notice of Non-Compliant Amendment dated Sep. 8, 2020", 9 pgs.
"U.S. Appl. No. 15/474,821, Response filed May 11, 2021 to Non Final Office Action dated Mar. 18, 2021", 10 pgs.
"U.S. Appl. No. 15/474,821, Response filed Apr. 25, 2019 to Non Final Office Action dated Jan. 25, 2019", 16 pgs.
"U.S. Appl. No. 15/474,821, Response filed on Dec. 2, 2019 to Final Office Action dated Sep. 3, 2019", 10 pgs.
"U.S. Appl. No. 15/835,100, Notice of Allowance dated May 22, 2018", 5 pgs.
"U.S. Appl. No. 15/837,935, Notice of Allowance dated Nov. 25, 2019", 18 pgs.
"U.S. Appl. No. 15/946,990, Final Office Action dated May 9, 2019", 11 pgs.
"U.S. Appl. No. 15/946,990, Non Final Office Action dated Dec. 3, 2018", 10 pgs.
"U.S. Appl. No. 15/946,990, Notice of Allowance dated Sep. 24, 2019", 5 pgs.
"U.S. Appl. No. 15/946,990, Response filed Feb. 20, 2019 to Non Final Office Action dated Dec. 3, 2018", 11 pgs.
"U.S. Appl. No. 15/946,990, Response filed Jul. 9, 2019 to Final Office Action dated May 9, 2019", 12 pgs.
"U.S. Appl. No. 16/105,687, Non Final Office Action dated Sep. 14, 2018", 11 pgs.
"U.S. Appl. No. 16/105,687, Notice of Allowance dated Feb. 25, 2019", 8 pgs.
"U.S. Appl. No. 16/105,687, Response filed Dec. 14, 2018 to Non Final Office Action dated Sep. 14, 2018", 12 pgs.
"U.S. Appl. No. 16/219,577, Non Final Office Action dated Oct. 29, 2019", 7 pgs.
"U.S. Appl. No. 16/219,577, Notice of Allowance dated Jan. 15, 2020", 7 pgs.
"U.S. Appl. No. 16/219,577, Response filed Oct. 3, 2019 to Restriction Requirement dated Aug. 7, 2019", 6 pgs.
"U.S. Appl. No. 16/219,577, Response filed Dec. 5, 2019 to Non Final Office Action dated Oct. 29, 2019", 6 pgs.
"U.S. Appl. No. 16/219,577, Restriction Requirement dated Aug. 7, 2019", 6 pgs.
"U.S. Appl. No. 16/428,210, Advisory Action dated Sep. 9, 2020", 3 pgs.
"U.S. Appl. No. 16/428,210, Examiner Interview Summary dated Aug. 28, 2020", 3 pgs.
"U.S. Appl. No. 16/428,210, Final Office Action dated Jun. 29, 2020", 16 pgs.
"U.S. Appl. No. 16/428,210, Non Final Office Action dated Apr. 6, 2020", 16 pgs.
"U.S. Appl. No. 16/428,210, Non Final Office Action dated Nov. 27, 2020", 17 pgs.
"U.S. Appl. No. 16/428,210, Preliminary Amendment filed Aug. 8, 2019", 8 pgs.
"U.S. Appl. No. 16/428,210, Response filed Apr. 27, 2021 to Non Final Office Action dated Nov. 27, 2020", 11 pgs.
"U.S. Appl. No. 16/428,210, Response filed Jun. 3, 2020 to Non Final Office Action dated Apr. 6, 2020", 10 pgs.
"U.S. Appl. No. 16/428,210, Response filed Aug. 27, 2020 to Final Office Action dated Jun. 29, 2020", 12 pgs.
"U.S. Appl. No. 16/541,919, Non Final Office Action dated Apr. 14, 2020", 18 pgs.
"U.S. Appl. No. 16/541,919, Notice of Allowance dated Jun. 30, 2020", 8 pgs.
"U.S. Appl. No. 16/541,919, Notice of Allowance dated Oct. 15, 2020", 8 pgs.
"U.S. Appl. No. 16/541,919, Response filed Jun. 12, 2020 to Non Final Office Action dated Apr. 14, 2020", 8 pgs.
"U.S. Appl. No. 16/808,101, Preliminary Amendment filed Mar. 10, 2020", 8 pgs.
"U.S. Appl. No. 16/841,817, Non Final Office Action dated May 26, 2021", 7 pgs.
"U.S. Appl. No. 16/943,706, Examiner Interview Summary dated Mar. 31, 2021", 2 pgs.
"U.S. Appl. No. 16/943,706, Final Office Action dated Feb. 24, 2021", 17 pgs.
"U.S. Appl. No. 16/943,706, Non Final Office Action dated Sep. 8, 2020", 16 pgs.
"U.S. Appl. No. 16/943,706, Response filed Feb. 8, 2021 to Non Final Office Action dated Sep. 8, 2020", 9 pgs.
"U.S. Appl. No. 16/943,804, Examiner Interview Summary dated Mar. 31, 2021", 2 pgs.
"U.S. Appl. No. 16/943,804, Final Office Action dated Feb. 24, 2021", 15 pgs.
"U.S. Appl. No. 16/943,804, Non Final Office Action dated Sep. 8, 2020", 14 pgs.
"U.S. Appl. No. 16/943,804, Response filed Feb. 8, 2021 to Non Final Office Action dated Sep. 8, 2020", 7 pgs.
"U.S. Appl. No. 17/031,310, Preliminary Amendment filed Jan. 22, 2021", 8 pgs.
"Chinese Application Serial No. 201680027177.8, Office Action dated Oct. 28, 2019", w/English Translation, 15 pgs.
"Chinese Application Serial No. 201680027177.8, Response filed Mar. 5, 2020 to Office Action dated Oct. 28, 2019", w/ English Claims, 11 pgs.
"Connecting To Your Customers In the Triangle and Beyond", Newsobserver.com, (2013), 16 pgs.
"Demystifying Location Data Accuracy", Mobile Marketing Association, (Nov. 2015), 18 pgs.
"European Application Serial No. 16716090.2, Communication Pursuant to Article 94(3) EPC dated Jan. 15, 2020", 6 pgs.
"European Application Serial No. 16716090.2, Response filed Apr. 15, 2020 to Communication Pursuant to Article 94(3) EPC dated Jan. 15, 2020", 10 pgs.
"European Application Serial No. 18747246.9, Communication Pursuant to Article 94(3) EPC dated Jun. 25, 2020", 10 pgs.
"European Application Serial No. 18747246.9, Extended European Search Report dated Nov. 7, 2019", 7 pgs.
"European Application Serial No. 18747246.9, Response filed Jun. 3, 2020 to Extended European Search Report dated Nov. 7, 2019", 15 pgs.
"European Application Serial No. 18747246.9, Response filed Oct. 15, 2020 to Communication Pursuant to Article 94(3) EPC dated Jun. 25, 2020", 16 pgs.
"Geofencing and the event industry", Goodbarber Blog, [Online] Retrieved from the internet by the examiner on May 16, 2019: <URL: https://www.goodbarber.com/blog/geofencing-and-the-event-industry-a699/>, (Nov. 9, 2015), 7 pgs.
"IAB Platform Status Report: A Mobile Advertising Review", Interactive Advertising Bureau, (Jul. 2008), 24 pgs.
"International Application Serial No. PCT/US2018/016723, International Preliminary Report on Patentability dated Aug. 15, 2019", 19 pgs.
"Korean Application Serial No. 10-2017-7029861, Notice of Preliminary Rejection dated Jan. 17, 2019", w/ English Translation, 9 pgs.
"Korean Application Serial No. 10-2017-7029861, Response filed Mar. 15, 2019 to Notice of Preliminary Rejection dated Jan. 17, 2019", w/ English Claims, 20 pgs.
"Korean Application Serial No. 10-2019-7025443, Notice of Preliminary Rejection dated Feb. 2, 2021", w/ English Translation, 11 pgs.
"Korean Application Serial No. 10-2019-7030235, Final Office Action dated May 20, 2020", w/English Translation, 5 pgs.
"Korean Application Serial No. 16-2019-7030235, Notice of Preliminary Rejection dated Nov. 28, 2019", w/ English Translation, 10 pgs.
"Korean Application Serial No. 10-2019-7030235, Response filed Jan. 28, 20 to Notice of Preliminary Rejection dated Nov. 28, 2019", w/ English Claims, 12 pgs.

(56) References Cited

OTHER PUBLICATIONS

"Korean Application Serial No. 10-2019-7030235, Response filed Jun. 22, 2020 to Final Office Action dated May 20, 2020", w/ English Claims, 16 pgs.
"Korean Application Serial No. 16-2021-7604376, Notice of Preliminary Rejection dated May 31, 2021", w/ English translation, 9 pgs.
"Mobile Location User Cases and Case Studies", Interactive Advertising Bureau, (Mar. 2014), 25 pgs.
"WIPO; International Preliminary Report; WO201776739", (dated Sep. 10, 2018), 5 pgs.
"WIPO; Search Strategy; WO201776739", (dated Dec. 10, 2017), 6 pgs.
Carr, Dale, "Mobile Ad Targeting: A Labor of Love", Ad Week, [Online] Retrieved from the Internet on Feb. 11, 2019: <URL: https://www.adweek.com/digital/mobile-ad-targeting-a-labor-of-love/>, (Feb. 12, 2016), 7 pgs.
Kumar, S, "Optimization Issues in Web and Mobile Advertising", Chapter 2—Pricing Models in Web Advertising, SpringerBriefs in Operations Management, (2016), 6 pgs.
Naylor, Joseph, "Geo-Precise Targeting: It's time to Get off the Fence", Be In The Know Blog, [Online] Retrieved from the internet by the examiner on May 16, 2019: <URL: http://blog.cmglocalsolutions.com/geo-precise-targeting-its-time-to-get-off-the-fence>, (May 15, 2015), 6 pgs.
Palmer, Alex, "Geofencing at events: how to reach potential customers live and on-site", Streetfight Mag, [Online] Retrieved form the internet by the examiner on May 16, 2019: <URL: http://streetfightmag.com/2015/08/20/geofencing-at-events-how-to-reach-potential-customers-live-and-on-site>, (Aug. 20, 2015), 6 pgs.
Peterson, Lisa, et al., "Location-Based Advertising", Peterson Mobility Solutions, (Dec. 2009), 39 pgs.
Quercia, Daniele, et al., "Mobile Phones and Outdoor Advertising: Measurable Advertising", IEEE Persuasive Computing, (2011), 9 pgs.
Simonite, Tom, "Mobile Data: A Gold Mine for Telcos", MIT Technology Review, (May 27, 2010), 6 pgs.
Virgillito, Dan, "Facebook Introduces Mobile Geo-Fencing With Local Awareness Ads", Adespresso, [Online] Retrieved from the internet by the examiner on May 16, 2019: <URL: https://adespresso.com/blog/facebook-local-business-ads-geo-fencing/>, (Oct. 8, 2014), 14 pgs.
"U.S. Appl. No. 16/943,706, Response filed Jun. 24, 2021 to Final Office Action dated Feb. 24, 2021", 11 pgs.
"U.S. Appl. No. 16/943,804, Response filed Jun. 24, 21 to Final Office Action dated Feb. 24, 21", 8 pgs.
"U.S. Appl. No. 16/428,210, Final Office Action dated Jul. 9, 21", 18 pgs.
"U.S. Appl. No. 16/943,706, Non Final Office Action dated Jul. 9, 21", 17 pgs.
"U.S. Appl. No. 16/943,804, Non Final Office Action dated Jul. 21, 21", 16 pgs.
"U.S. Appl. No. 16/808,101, Notice of Allowance dated Jul. 27, 21", 16 pgs.
"U.S. Appl. No. 16/808,101, Supplemental Notice of Allowability dated Aug. 9, 21", 3 pgs.
"U.S. Appl. No. 15/474,821, Final Office Action dated Aug. 19, 21", 18 pgs.
"U.S. Appl. No. 16/841,817, Response filed Aug. 26, 21 to Non Final Office Action dated May 26, 21", 6 pgs.
"U.S. Appl. No. 16/841,817, Notice of Allowance dated Sep. 3, 21", 7 pgs.
"Korean Application Serial No. 10-2021-7004376, Response filed Aug. 12, 21 to Notice of Preliminary Rejection dated May 31, 21", w/ English Translation, 47 pgs.
"European Application Serial No. 18747246.9, Summons to Attend Oral Proceedings dated Jun. 29, 21", 12 pgs.
"Application Serial No. 16 841,817, Corrected Notice of Allowability dated Sep. 16, 21", 2 pgs.
"Application Serial No. 17 112,676, Non Final Office Action dated Sep. 23, 21", 26 pgs.
"Application Serial No. 16 943,804, Examiner Interview Summary dated Oct. 21, 21", 2 pgs.
"Application Serial No. 15 474,821, Response filed Oct. 20, 21 to Final Office Action dated Aug. 19, 21", 10 pgs.
"Application Serial No. 16 428,210, Examiner Interview Summary dated Nov. 5, 21", 2 pgs.
"Application Serial No. 16 943,706, Examiner Interview Summary dated Nov. 5, 21", 2 pgs.
"Application Serial No. 16 943,804, Response filed Nov. 4, 21 to Non Final Office Action dated Jul. 21, 21", 9 pgs.
"Application Serial No. 16 943,706, Response filed Nov. 8, 21 to Non Final Office Action dated Jul. 9, 21", 11 pgs.
"Application Serial No. 16 428,210, Response filed Nov. 9, 21 to Final Office Action dated Jul. 9, 21", 12 pgs.
"Application Serial No. 17 031,310, Notice of Allowance dated Nov. 15, 21", 9 pgs.

* cited by examiner

USER INTERFACE TO AUGMENT AN IMAGE USING GEOLOCATION

TECHNICAL FIELD

The subject matter disclosed herein generally relates to user interface technology. Specifically, the present disclosure addresses systems and methods for a platform for publishing context relevant media filters, for presentation on the user interfaces of mobile devices.

BACKGROUND

The number of digital photographs taken with mobile wireless devices is increasingly outnumbering photographs taken with dedicated digital and film based cameras. Thus, there are growing needs to improve the experience associated with mobile wireless digital photography.

BRIEF DESCRIPTION OF THE DRAWINGS

The present disclosure is illustrated by way of example, and not by way of limitation, in the figures of the accompanying drawings, in which.

DETAILED DESCRIPTION

Figure 1:
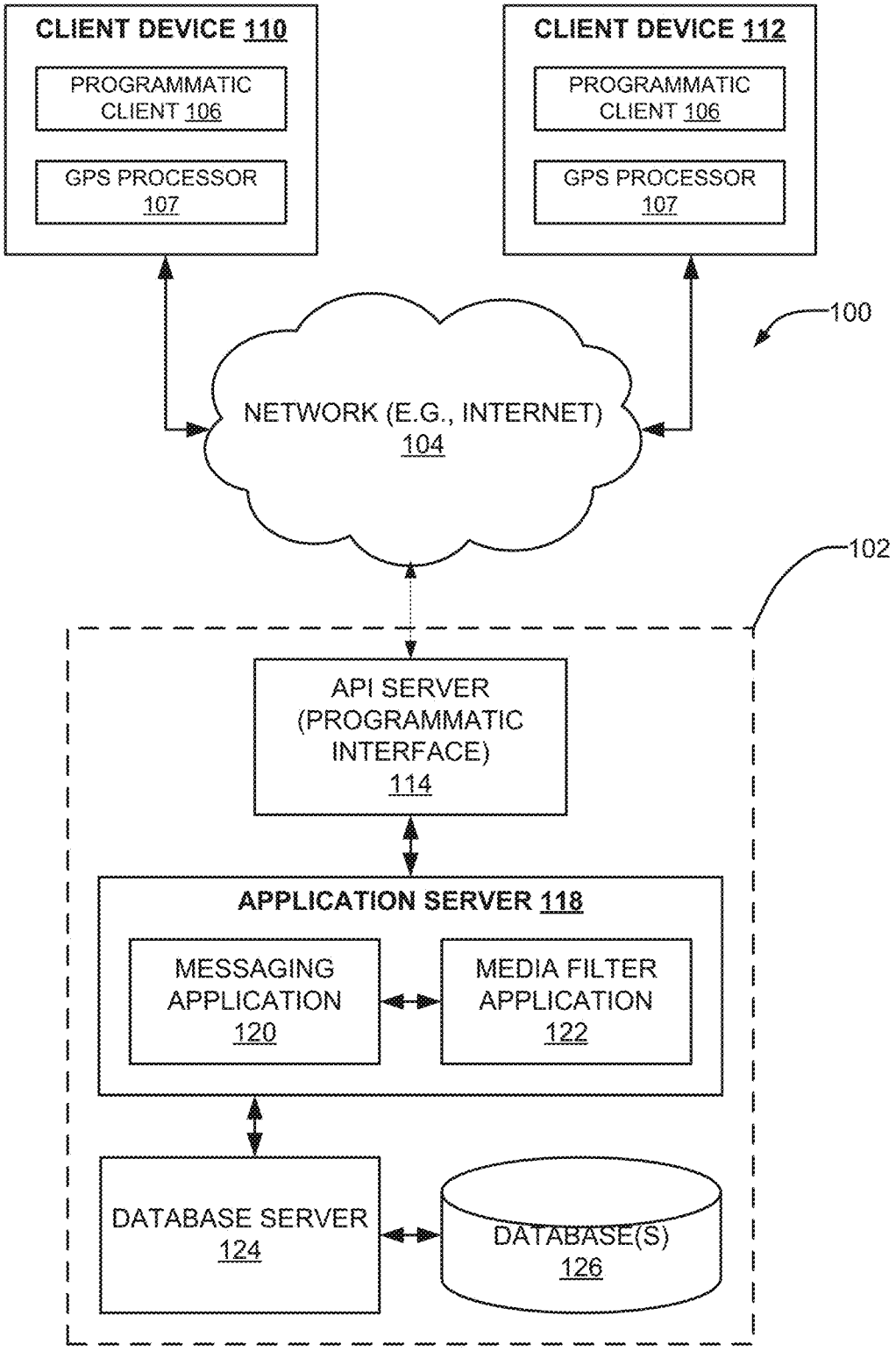
FIG. 1 is a network diagram depicting a network system having a client-server architecture configured for exchanging data over a network, according to one embodiment.

Although the present disclosure is described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense.

The addition of labels, drawings and other artwork to images (e.g., pictures or video) provides a compelling way for users to personalize, supplement and enhance these images before storage or publication to a broader audience. An example embodiment seeks to provide users with a set of the geo-filters (e.g., enhancement and augmentations) that can be applied to an image. The set of enhancements and augmentations, in the example form of image overlays, may be determined based on a location associated with the image. The image overlays are presented to a user for selection and combining with an image based on a determined location of the image, or content of the image. For example, where a user takes a picture on a mobile device in Disneyland, an image overlay indicating the name "Disneyland", in a particular style, is presented to the user. Further Disneyland-themed image overlays may also be presented to the user. The presentation of the image overlay may be in response to the user performing a gesture (e.g. a swipe operation) on a screen of the mobile device. The user is then able to select the image overlay and have it applied to the image, in this way to personalize and enhance the image.

Third party entities (e.g., merchants, restaurants, individuals, etc.) may, in one example embodiment, seek to have geo-filters included in the set presented for user selection at a particular geographic location. For example, a restaurant at a particular location in San Francisco may wish to have their restaurant name and logo included in a set of geo-filters presented to a user, for the purposes of augmenting a photograph taken by the user proximate to the restaurant. According to one example embodiment, such third party entities may bid (or otherwise purchase opportunities) to have a particular geo-filter included in a set presented to a user for augmentation of a particular image. Below described are various systems and methodologies that may be used to technically implement the above described image enhancement technologies and capabilities.

More specifically, various examples of a media filter publication application are described. The media filter publication application operates at a server and generates media filters that include content based on geographic locations (also referred to as geolocation). A media filter may include audio and visual content or visual effects that can be applied to augment a media item at a mobile device. The media item may be a picture or a video. The media filter publication application includes a user-based media filter publication platform and a merchant-based publication platform.

In the user-based media filter publication platform, the media filter publication application provides a Graphical User Interface (GUI) for a user to upload content and select a geolocation on a map. For example, the user may upload a logo and define boundaries on the map to identify a particular geolocation associated with the logo. Once the user submits the logo and identifies the particular geolocation, the media filter publication application generates a media filter that includes the logo associated with the particular geolocation. As such, mobile devices that are located within the particular geolocation have access to the media filter.

In the merchant-based media filter publication platform, the media filter publication application provides a GUI for merchants to upload content, select geolocations on a map, and submit bids for the corresponding geolocations. A bidding process determines the merchant with the highest bid amount. That merchant can then exclude publication of media filters from other merchants at a selected geolocation of the merchant. Therefore, the media filter of the highest bidding merchant may be the only media filter that can be accessed by mobile devices that are located at the selected geolocation.

In other examples, the media filter includes context relevant data, such as, a current temperature, an identification of a geolocation of the mobile device (e.g., Venice beach), a name of a live event associated with the geolocation of the mobile device, or a name of a business.

In one example embodiment, a media filter application at a server provides a live event media filter to a mobile device. The live event media filter includes live event data associated with a live event, such as a sporting event or an award ceremony, at a geolocation of the mobile device. For example, a user attending a football game can access a sports media filter that includes the current score of the football game. In another example, a user attending the Oscar® award ceremony can access an entertainment media filter that includes a name of an Oscar® winner.

In one example embodiment, the media filter application at the server provides a social network media filter to the mobile device. The social network media filter may be based on social network activities of the user of the mobile device. For example, if the user follows a brand such as McDonald's® on a social network service, and the mobile device of the user is located at a McDonald's® restaurant, the mobile device of the user can access a McDonald's® media filter. Other users located at the same restaurant would not have access to the McDonald's® media filter unless they also follow McDonald's® on the social network service. In another example, the order in which the media filters are presented to users located at a McDonald's® restaurant may be modified so that the McDonald's® media filter is served higher for users following McDonald's® on the social network service.

In one example embodiment, the media filter application at the server provides a promotion media filter to a mobile device. The promotion media filter may be based on promotions from a merchant. For example, the media filter may be used to implement a Monopoly™ game at McDonald's® by randomly selecting a media filter every time the user of the mobile device walks into a McDonald's® restaurant and purchases an item. The media filter can be used to obtain Monopoly™ puzzle pieces that can be redeemed towards prizes.

In one example embodiment, the media filter application at the server enables the mobile device to collect media filters. For example, the mobile filter application provides the mobile device with permanent access to collected media filters. The collected media filters may be stored in a collection portfolio for the mobile device. The mobile device may access any of the media filters in the collection portfolio at any time.

In one example embodiment, the media filter application at the server provides a history media filter to the mobile device. The history media filter may be based on geographic locations of historical sites visited by the user of the mobile device. For example, the mobile device is awarded with a unique media filter associated with one of the Seven Wonders of the World when the mobile device is located at one of the corresponding Seven Wonders geographic locations.

In one example embodiment, the media filter application at the server provides a progressive use media filter to the mobile device. The content in the progressive use media filter changes depending on the number of people that have previously used the progressive use media filter.

In one example embodiment, users can "purchase" a geolocation for a predetermined amount of time and select a media filter associated with the geolocation. For example, a college can purchase and select a particular media filter associated with the geolocation of its campus.

In one example embodiment, the media filter application provides a viral media filter to the mobile device. For example, when the user of the mobile device obtains the viral media filter at a geolocation, that user can send the viral media filter to mobile devices located outside the geolocation of the original user. Users of the mobile devices located outside the geolocation of the original user can make use of the viral media filter for the next hour. Those users can also forward the viral media filter to other users.

In one example embodiment, the media filter application 122 provides an actionable media filter to the mobile device. For example, the actionable media filter can be a link to open a browser page in the mobile device to obtain a coupon. The actionable media filter can trigger other functions of the mobile device.

System Architecture

FIG. 1 is a network diagram depicting a network system 100 having a client-server architecture configured for exchanging data over a network, according to one embodiment. For example, the network system 100 may be a messaging system where clients may communicate and exchange data within the network system 100. The data may pertain to various functions (e.g., sending and receiving text and media communication, determining geolocation) and aspects (e.g., publication of media filters, management of media filters) associated with the network system 100 and its users. Although illustrated herein as client-server architecture, other embodiments may include other network architectures, such as peer-to-peer or distributed network environments.

A data exchange platform, in an example, includes a messaging application 120 and a media filter application 122, and may provide server-side functionality via a network 104 (e.g., the Internet) to one or more clients. The one or more clients may include users that utilize the network system 100 and, more specifically, the messaging application 120 and the media filter application 122, to exchange data over the network 104. These operations may include transmitting, receiving (communicating), and processing data to, from, and regarding content and users of the network system 100. The data may include, but is not limited to, content and user data such as user profiles, messaging content, messaging attributes, media attributes, client device information, geolocation information, photo filters content, messaging content persistence conditions, social network information, and live event data information, among others.

In various embodiments, the data exchanges within the network system 100 may be dependent upon user-selected functions available through one or more client or user interfaces (UIs). The UIs may be associated with a client machine, such as client devices 110, 112 using a programmatic client 106, such as a client application. The programmatic client 106 may be in communication with the messaging application 120 and media filter application 122 via an application server 118. The client devices 110, 112 include mobile devices with wireless communication components, and audio and optical components for capturing various forms of media including photos and videos.

Turning specifically to the messaging application 120 and the media filter application 122, an application program interface (API) server 114 is coupled to, and provides programmatic interface to one or more application server(s) 118. The application server 118 hosts the messaging application 120 and the media filter application 122. The application server 118 is, in turn, shown to be coupled to one or more database servers 124 that facilitate access to one or more databases 126.

The API server 114 communicates and receives data pertaining to messages and media filters, among other things, via various user input tools. For example, the API server 114 may send and receive data to and from an application (e.g., the programmatic client 106) running on another client machine (e.g., client devices 110, 112 or a third party server).

In one example embodiment, the messaging application 120 provides messaging mechanisms for users of the client devices 110, 112 to send messages that include text and media content such as pictures and video. The client devices 110, 112 can access and view the messages from the messaging application 120 for a limited period of time. For example, the client device 110 can send a message to the client device 112 via the message application 120. Once the client device 112 accesses the message from the message application 120, the message is deleted after a predefined duration has elapsed from the time the client device 112 started viewing the message. Components of the messaging application 120 are described in more detail below with respect to FIG. 2.

In one example embodiment, the media filter application 122 provides a system and a method for operating and publishing media filters for messages processed by the messaging application 120. The media filter application 122 supplies a media filter to the client device 110 based on a geolocation of the client device 110. In another example, the media filter application 122 supplies a media filter to the client device 110 based on other information, such as, social network information of the user of the client device 110.

The media filter may include audio and visual content and visual effects. Examples of audio and visual content include pictures, texts, logos, animations, and sound effects. An example of a visual effect includes color filtering. The audio and visual content or the visual effects can be applied to a media content item (e.g., a photo) at the client device 110. For example, the media filter includes text that can be overlaid on top of a photo generated at the client device 110. In another example, the media filter includes an identification of a location overlay (e.g., Venice beach), a name of a live event, or a name of a merchant overlay (e.g., Beach Coffee House). In another example, the media filter application 122 uses the geolocation of the client device 110 to identify a media filter that includes the name of a merchant at the geolocation of the client device 110. The media filter may include other indicia associated with the merchant. Examples of indicia include logos and other pictures related to the merchant. The media filters may be stored in the database(s) 126 and accessed through the database server 124.

In one example embodiment, the media filter application 122 includes a user-based publication platform that enables users to select a geolocation on a map, and upload content associated with the selected geolocation. The user may also indicate other circumstances under which a particular media filter should be provided. The media filter application 122 generates a media filter that includes the uploaded content and associates the uploaded content with the selected geolocation.

In another example embodiment, the media filter application 122 includes a merchant-based publication platform that enables merchants to select a particular media filter associated with a geolocation via a bidding process. For example, the media filter application 122 associates the media filter of a highest bidding merchant with a corresponding geolocation for a predefined amount of time. Components of the media filter application 122 are described in more detail below with respect to FIG. 3.

Messaging Application

Figure 2:
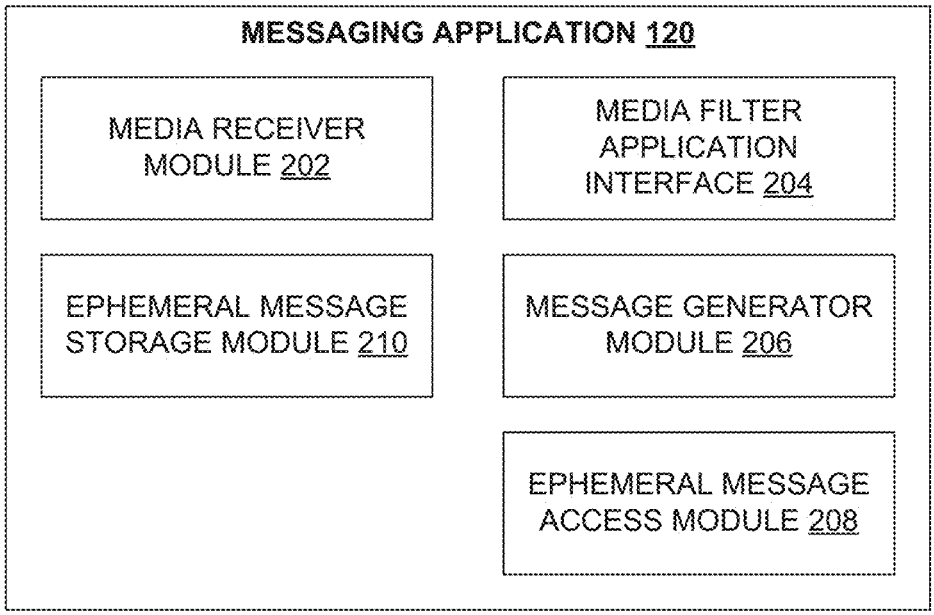
FIG. 2 shows a block diagram illustrating one example embodiment of a messaging application.

FIG. 2 shows a block diagram illustrating one example embodiment of the messaging application 120. The messaging application 120 may be hosted on dedicated or shared server machines (not shown) that are communicatively coupled to enable communications between server machines. The messaging application 120 and the media filter application 122 themselves are communicatively coupled (e.g., via appropriate interfaces) to each other and to various data sources, so as to allow information to be passed between the messaging application 120 and the media filter application 122, or so as to allow the messaging application 120 and the media filter application 122 to share and access common data. The messaging application 120 and the media filter application 122 may, furthermore, access the one or more databases 126 via the database server(s) 124.

The messaging application 120 is responsible for the generation and delivery of messages between users of the programmatic client 106. The messaging application 120 may utilize any one of a number of message delivery networks and platforms to deliver messages to users. For example, the messaging application 120 may deliver messages using electronic mail (e-mail), instant message (IM), Short Message Service (SMS), text, facsimile, or voice (e.g., Voice over IP (VoIP)) messages via wired (e.g., the Internet), plain old telephone service (POTS), or wireless networks (e.g., mobile, cellular, WiFi, Long Term Evolution (LTE), Bluetooth).

In one example embodiment, the messaging application 120 includes a media receiver module 202, a media filter application interface 204, a message generator module 206, an ephemeral message access module 208, and an ephemeral message storage module 210. The media receiver module 202 receives a message from the programmatic client 106 of the client device 110. The message may include a combination of text, photo, or video. The media receiver module 202 also receives persistence metadata associated with the message. The persistence metadata defines how long a message can be viewed. For example, the user of client device 110 may specify that the message be persistent or can only be viewed or accessed for a user-determined amount of time (e.g., ten seconds). The media filter application interface 204 communicates with the media filter application 122 to access and retrieve a media filter associated with the metadata in the message. The message generator module 206 applies the media filter to the message from the programmatic client 106 to create an ephemeral message and temporarily store the ephemeral message with the ephemeral message storage module 210.

The ephemeral message access module 208 notifies a recipient of the message of the availability of the ephemeral message. The ephemeral message access module 208 receives a request to access the ephemeral message from the recipient and causes the ephemeral message to be displayed on a client device of the recipient for the maximum duration specified in the persistence metadata. Once the recipient views the message for the maximum duration, the ephemeral message access module 208 causes the client device of the recipient to stop displaying the ephemeral message, and deletes the ephemeral message from the ephemeral message storage module 210.

Media Filter Application

Figure 3:
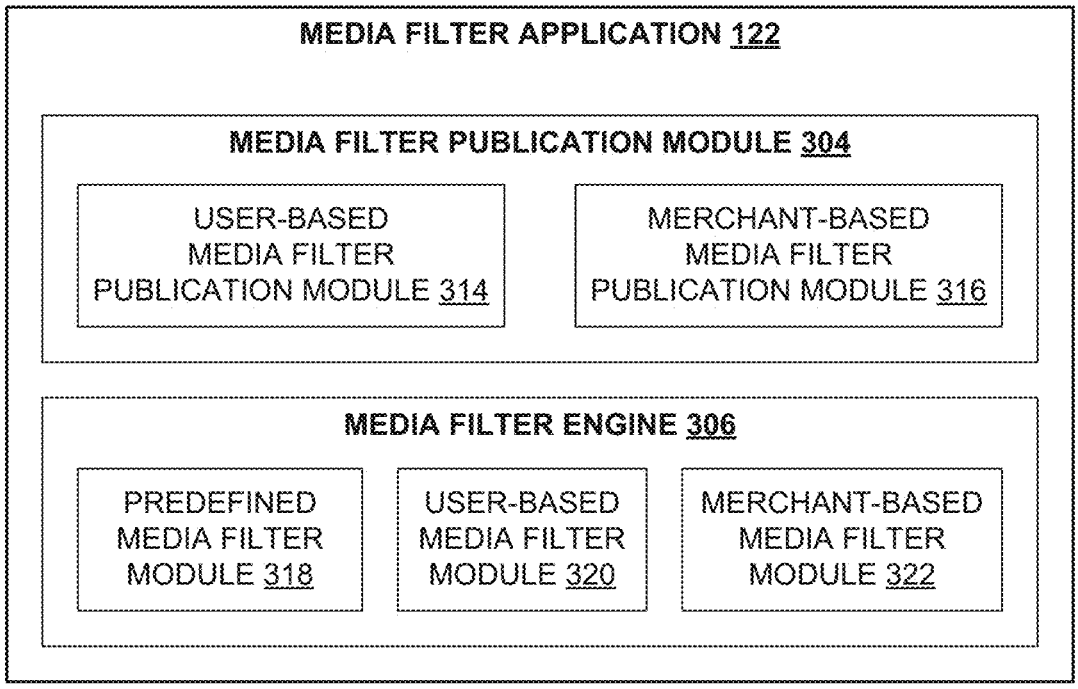
FIG. 3 shows a block diagram illustrating one example embodiment of a media filter application.

FIG. 3 shows a block diagram illustrating one example embodiment of the media filter application 122. The media filter application 122 includes a media filter publication module 304 and a media filter engine 306.

The media filter publication module 304 provides a platform for publication of media filters. In an example embodiment, the media filter publication module 304 includes a user-based media filter publication module 314 and a merchant-based media filter publication module 316. The user-based media filter publication module 314 enables users of client devices (either mobile or web clients) to upload content and select a geolocation for a user-based media filter. The merchant-based media filter publication module 316 enables merchants to upload content, select a geolocation, and submit a bid amount for a merchant-based media filter. The user-based media filter publication module 314 is described in more detail below with respect to FIG. 4A. The merchant-based media filter publication module 316 is described in more detail below with respect to FIG. 5A.

The media filter engine 306 generates and supplies a media filter based on the geolocation of a client device. In one example embodiment, the media filter engine 306 includes a predefined media filter module 318, a user-based media filter module 320, and a merchant-based media filter module 322. The media filter may be based on predefined media filters from the predefined media filter module 318, user-based media filters from the user-based media filter module 320, and merchant-based media filters from the merchant-based media filter module 322.

The predefined media filter module 318 supplies the client device with one of predefined media filters. Examples of predefined media filters are described in more detail below with respect to FIG. 6.

The user-based media filter module 320 supplies the client device with a user-based media filter generated by the user-based media filter publication module 314. The merchant-based media filter module 322 supplies the client device with a merchant-based media filter generated by the merchant-based media filter publication module 316.

Figure 4A:
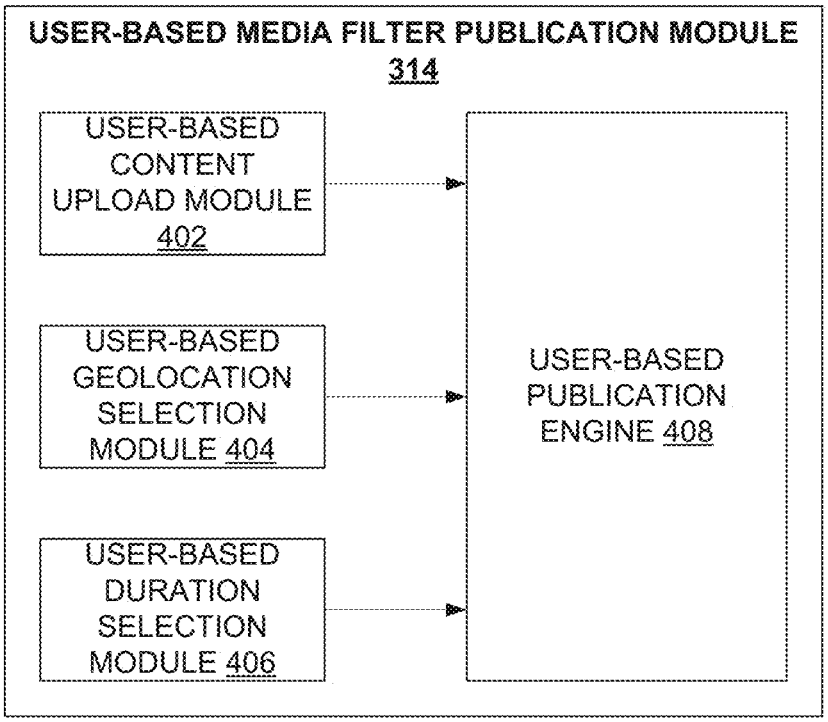
FIG. 4A shows a block diagram illustrating one example embodiment of a user-based media filter publication module.

FIG. 4A shows a block diagram illustrating one example embodiment of the user-based media filter publication module 314. The user-based media filter publication module 314 includes a user-based content upload module 402, a user-based geolocation selection module 404, a user-based duration selection module 406, and a user-based publication engine 408.

Figure 4B:
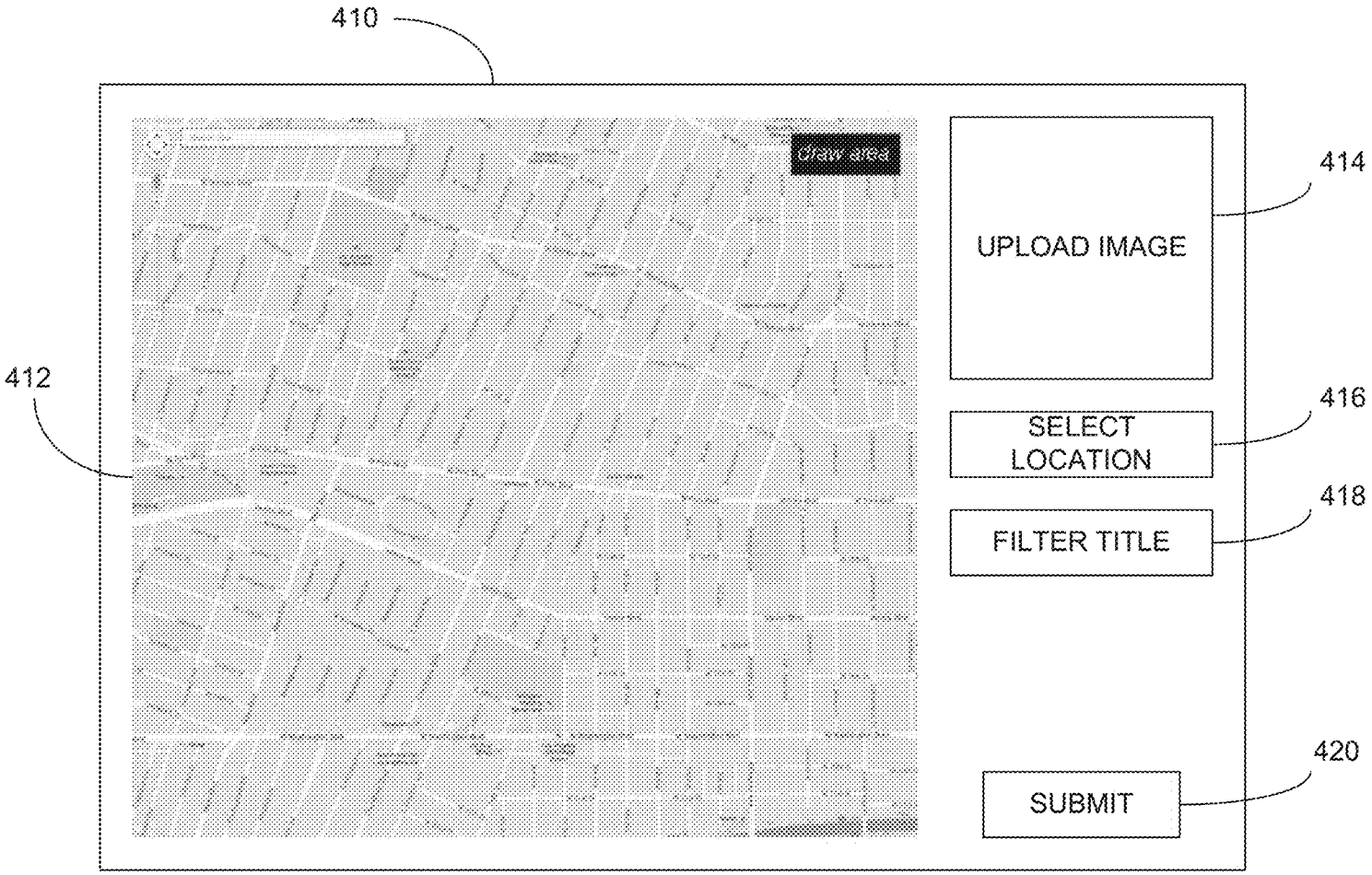
FIG. 4B shows an example of a graphical user interface for a user-based media filter publication module.

The user-based content upload module 402 receives uploaded content from a user. The content may include a media item such as a photo or a video. The user-based content upload module 402 may be implemented on a web server to allow a user to upload the content using a GUI as illustrated in FIG. 4B.

The user-based geolocation selection module 404 receives geolocation identification information from the user to identify a selected geolocation. The geolocation identification information may include an address, an identification of an establishment already associated with the address, Global Positioning System (GPS) coordinates, or a geographic boundary. For example, the address may include a street number, street address, city, state, and country. The user may also identify a location based on an existing establishment. For example, the geolocation information may include "restaurant x" in Venice Beach. The geographic boundary identifies a region or a zone. For example, the geographic boundary may define a region located within a predetermined radius of an address, a point of interest, or a name of an existing establishment.

Figure 4C:
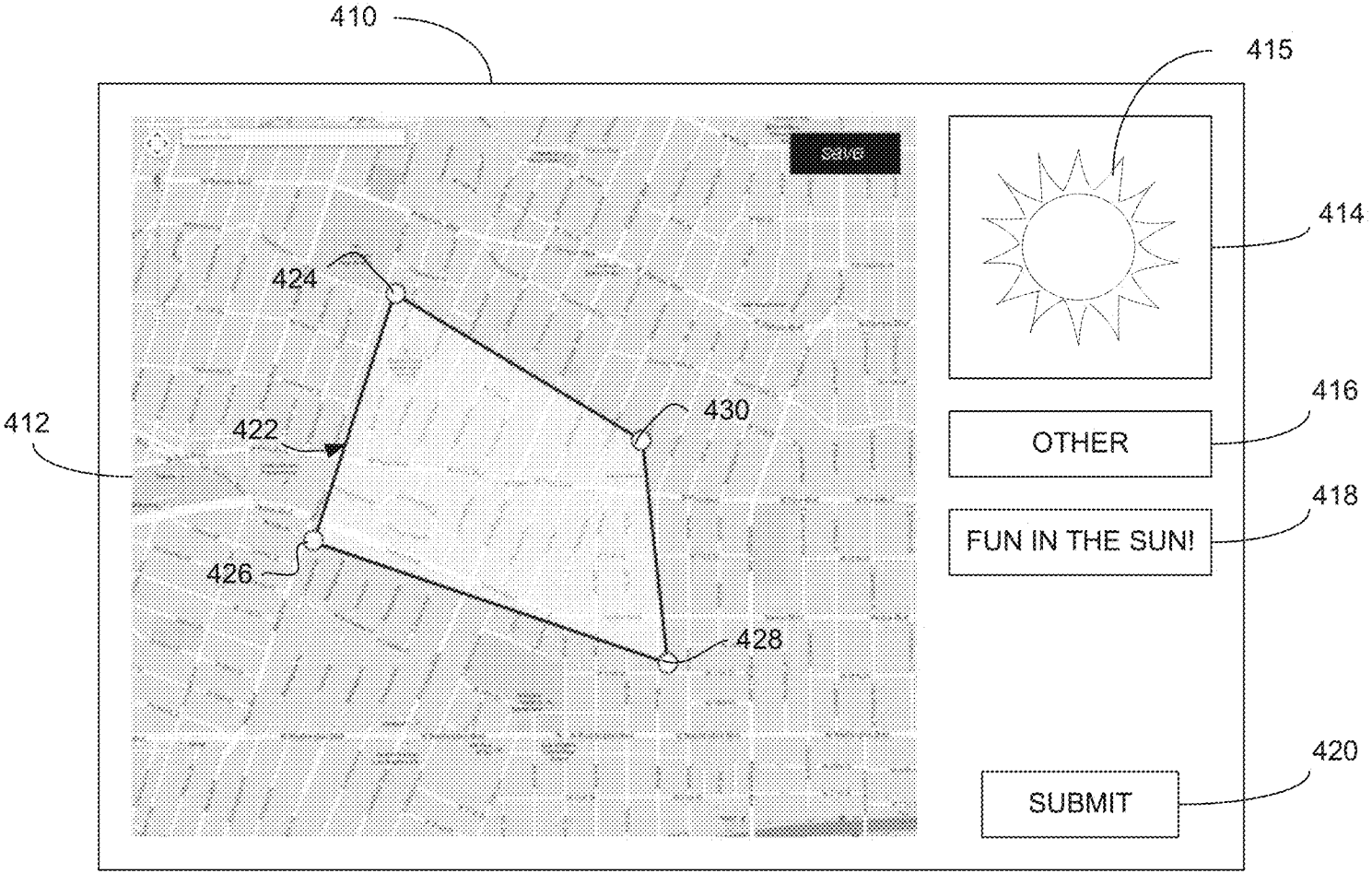
FIG. 4C shows an example of an operation of the graphical user interface of FIG. 4B.

In one example embodiment, the geolocation identification information may be embedded in a message or communication from a client device to the user-based geolocation selection module 404. For example, the user of the client device may take a picture of a sunset at Venice Beach and send the picture to the user-based geolocation selection module 404 that may then extract the geolocation attribute from the metadata associated with the picture of the sunset. The user-based geolocation selection module 404 may be implemented on a web server to present a user with a GUI in a web page that allows the user to select the geolocation for the content as illustrated in FIG. 4C.

The user-based duration selection module 406 receives, from the user, time duration information related to the uploaded content and selected geolocation. The time duration may identify a period of time during which the uploaded content is associated with the selected geolocation. Once the period of time has elapsed, the uploaded content is no longer associated with the selected geolocation. For example, if the time duration indicates twenty four hours, the media filter engine 306 makes the user-based media filter available to client devices that are located at the selected geolocation. Once twenty four hours has elapsed, the user-based media filter is no longer accessible by the client devices at the selected geolocation.

Other embodiments include a periodic time duration information or specific time duration information. For example, for the periodic time duration information, the user-based media filter is published and made available at the selected geolocation every Sunday (e.g., a religion related media filter available on days of religious services). For the specific time duration information, the user-based media filter is published and made available at the selected geolocation around a specific holiday or date (e.g., Thanksgiving weekend, New Year's day).

The user-based publication engine 408 generates a user-based media filter that associates the uploaded content from the user-based content upload module 402 with the selected geolocation from the user-based geolocation selection module 404. The user-based publication engine 408 publishes the user-based media filter to client devices that are located within the selected geolocation for the time duration identified with the user-based duration selection module 406.

In another example embodiment, the user-based publication engine 408 determines that no other user-based media filters exist during the same period of time for the same selected geolocation. The user-based media filter publication engine 408 may publish just one user-based media filter at any time for the same selected geolocation. In another example embodiment, a limit may be placed on the number of user-based media filters available at any time for the same selected geolocation. Thus, the user-based media filter publication engine 408 may publish and make available a limited number of user-based media filters at any time for the same selected geolocation. In another example embodiment, user-based media filters may be published to only contacts or 'friends' of the uploading user.

FIG. 4B illustrates an example of a GUI 410 for uploading content and for selecting a geographic region on a map. The GUI 410 includes a map 412, an upload image box 414, a select location button 416, a filter title box 418, and a submit button 420. The upload image box 414 enables a user to upload content, (e.g., a picture) to the user-based content upload module 402. The select location button 416 enables the user to identify a geolocation by drawing boundaries on the map 312 or by inputting an address or a zip code. The identified geolocation is submitted to the user-based geolocation selection module 404. The filter title box 418 enables the user to submit a name for the media filter. The user may submit the content and the requested geolocation by clicking on the submit button 420. Once the content and requested geolocation are submitted, the user-based publication engine 408 generates a user-based media filter that includes the uploaded content for the identified geolocation.

FIG. 4C illustrates an example where user identified boundaries points 424, 426, 428, and 430 on the map 412 define a geolocation 422. The user has uploaded a picture of the sun 415 displayed in the upload image box 414. The user has entered the title of the content "Fun in the sun!" in the filter title box 418. The user may submit the picture of the sun 415 and the geolocation 422 by clicking on the submit button 420. Once the picture of the sun 415 and the geolocation 422 are submitted, the user-based publication engine 408 generates a user-based media filter.

Figure 4D:
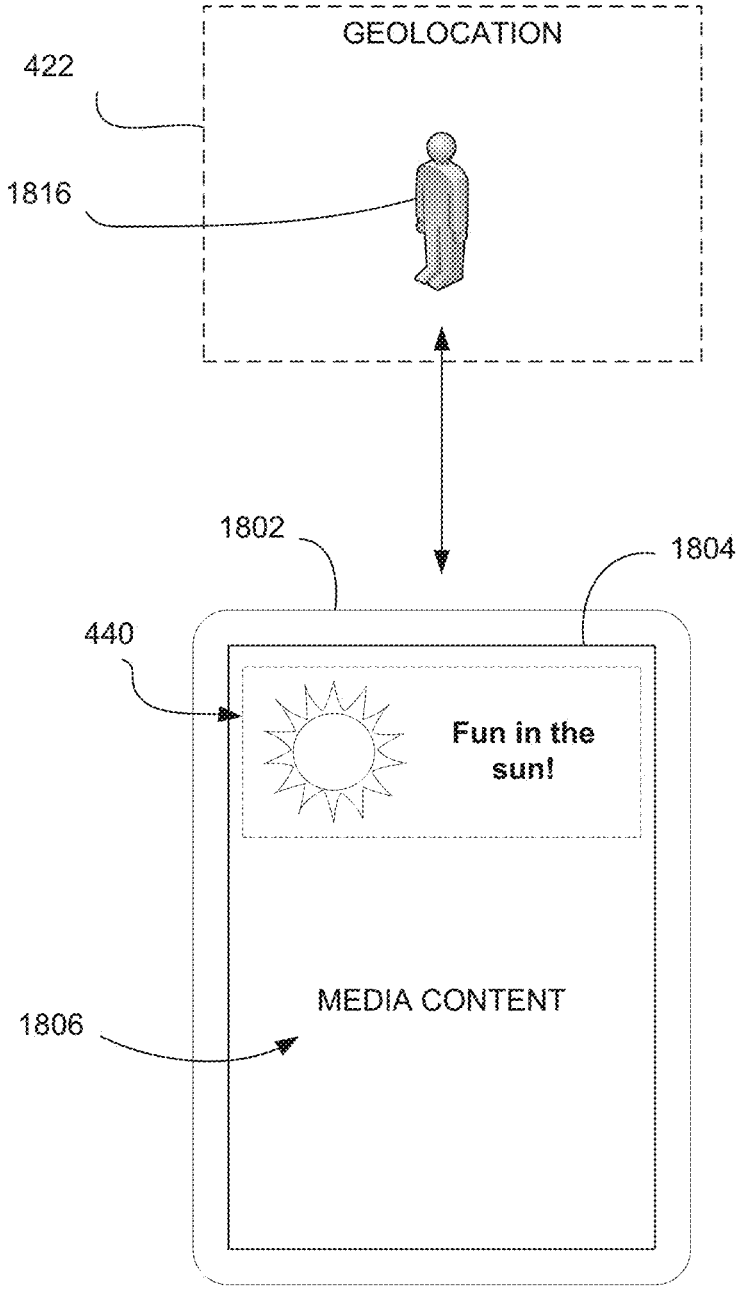
FIG. 4D illustrates an example of a publication of a user-based media filter.

FIG. 4D illustrates an example of a publication of a user-based media filter. The media filter application 122 detects that a mobile device 1802 of a user 1816 is located at the geolocation 422. The media filter application 122 retrieves the user-based media filter 440 corresponding to the geolocation 422 and publishes the user-based media filter 440 to the mobile device 1802. The user-based media filter 440 is applied to media content 1806 in a display 1804 of the mobile device 1802.

Figure 5A:
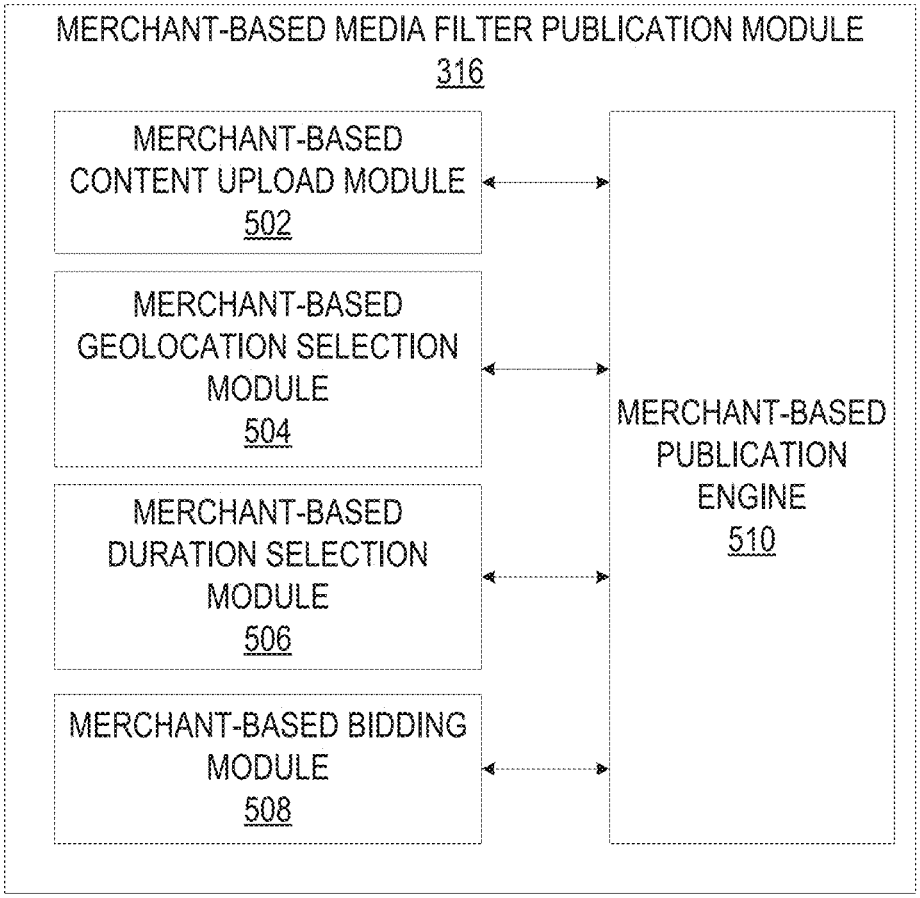
FIG. 5A shows a block diagram illustrating one example embodiment of a merchant-based media filter publication module.

FIG. 5A shows a block diagram illustrating one example embodiment of the merchant-based media filter publication module 316. The merchant-based media filter publication module 316 includes a merchant-based content upload module 502, a merchant-based geolocation selection module 504, a merchant-based duration selection module 506, a merchant-based bidding module 508, and a merchant-based publication engine 510.

The merchant-based content upload module 502 receives content from a merchant. The content may include a media item such as a picture, a video, a graphic, or a text. The merchant-based content upload module 502 may be implemented on a web server to allow a merchant to upload the content using a webpage.

The merchant-based geolocation selection module 504 receives geolocation identification information from the merchant to identify a selected geolocation. The geolocation identification information may include an address of an establishment, an identification of an establishment already associated with the address, GPS coordinates, or a geographic boundary. For example, the address of the establishment may include a street number, street address, city, state, and country. The merchant may also identify a location based on an existing establishment. For example, the geolocation information may include "restaurant x" in Venice beach. The geographic boundary identifies a region or a zone. For example, the geographic boundary may define a region located within a predetermined radius of an address, a point of interest, or a name of an existing establishment. The merchant may further define the geographic boundary by drawing a virtual fence on a map. The merchant-based geolocation selection module 504 may be implemented on a web server to allow a merchant to draw boundaries on a map in a web page.

The merchant-based duration selection module 506 receives, from the merchant, time duration information related to the uploaded content and selected geolocation. The time duration may identify a period of time in which the uploaded content is associated with the selected geolocation. Once the period of time has elapsed, the uploaded content is no longer associated with the selected geolocation. Other embodiments include periodic time duration information or specific time duration information. For example, for the periodic time duration information, the merchant-based media filter is published or made available at the selected geolocation (e.g., corner of two identified streets) every Saturday night (e.g., a night club related media filter available every Saturday night). For the specific time duration information, the selected media filter is published or made available at the selected geolocation around a specific date (e.g., party event date).

Figure 5B:
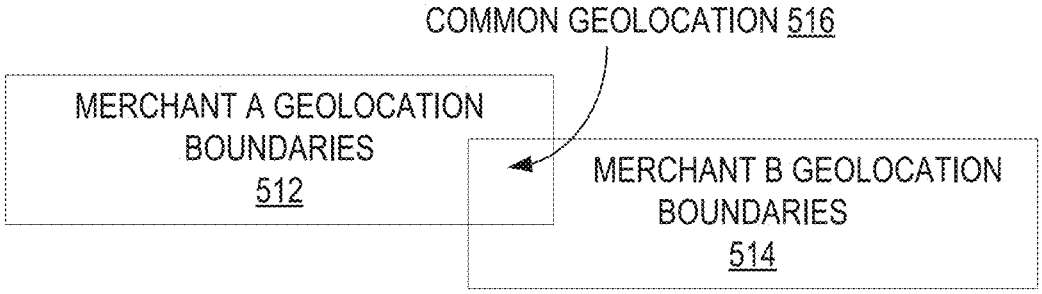
FIG. 5B illustrates an example of a common geolocation.

The merchant-based bidding module 508 provides an interface to enable merchants to submit a bid amount for a common geolocation. The common geolocation may include, for example, a same street address. For example, several businesses may have the same street address but different suite numbers in a shopping center. FIG. 5B illustrates an example of a common geolocation. Merchant A geolocation boundaries 512 overlaps with merchant B geolocation boundaries 514 to define a common geolocation 516. Thus, merchants A and B may submit respective bids corresponding to the common geolocation 516. In one example embodiment, the merchant-based geolocation selection module 504 determines common geolocations from the geolocations selected by the merchants. The merchant-based bidding module 508 identifies a highest bidder for the common geolocation and awards the highest bidder with the ability to exclude other merchant-based media filters from the common geolocation 516 for a predefined amount of time.

In another example embodiment, the merchant-based bidding module 508 prorates bid amounts based on their corresponding time duration information. For example, merchant A submits a bid amount of $100 for one day for a specific geolocation. Merchant B submits a bid amount of $160 for two days for the same specific geolocation. The merchant-based bidding module 508 may prorate the bid from merchant B for one day (e.g., $80) and compare both bids for the same period of time (e.g., one day) to determine a highest bidder.

The merchant-based publication engine 510 generates a merchant-based media filter that associates the uploaded content of the highest bidder with the geolocation identified by the highest bidder. The merchant-based publication engine 510 publishes the merchant-based media filter to client devices that are located at the geolocation selected by the highest bidder for the time duration identified with the merchant-based duration selection module 506. Merchant-based media filters from other merchants in the common geolocation 516 are excluded from publication. In another embodiment, a quota may be placed on the number of merchant-based media filters available for the common geolocation 516. For example, the merchant-based publication engine 510 may publish and make available a limited number of merchant-based media filters (e.g., a maximum of two merchant-based media filters) for the common geolocation 516.

In another example embodiment, the merchant-based publication engine 510 forms a priority relationship that associates the uploaded content of the highest bidder with the geolocation selected by the highest bidder. For example, an order in which media filters are displayed at the client device 110 may be manipulated based on the results from the merchant-based bidding module 508. A media filter of a merchant with the highest bid may be prioritized and displayed first at the client device 110. Media filters from other merchants may be displayed at the client device 110 after the media filter of the highest bidder. In another example embodiment, a merchant may be able to bid on all locations at which it maintains a presence. Thus, a restaurant chain may be able to have its media filter(s) published at each of its restaurant chain locations.

Figure 5C:
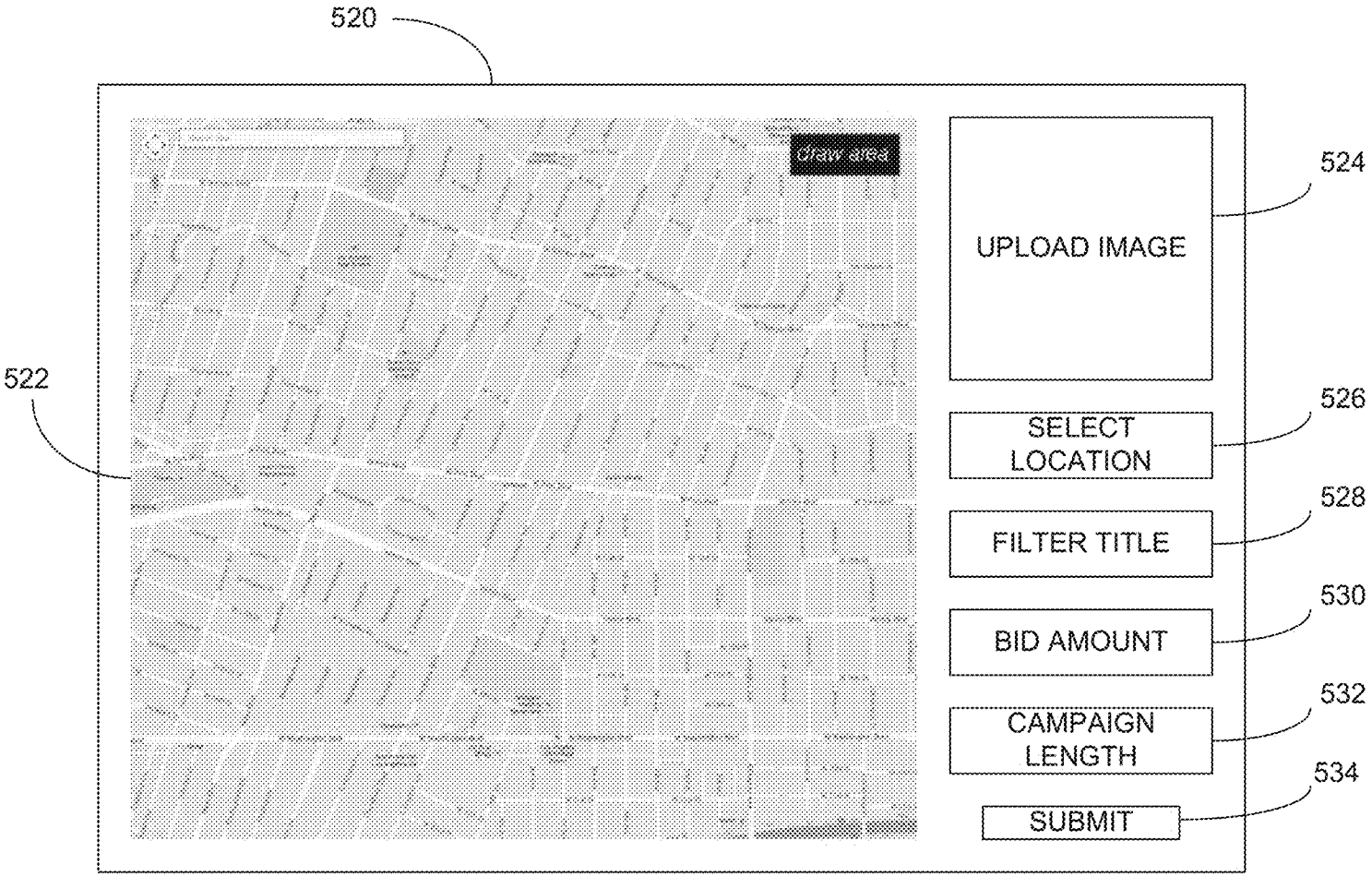
FIG. 5C illustrates an example of a graphical user interface for a merchant-based media filter publication module.

FIG. 5C illustrates an example of a GUI 520 for uploading content and for selecting a geolocation on a map. The GUI 520 includes a map 522, an upload image box 524, a select location button 526, a filter title box 528, a bid amount entry box 530, a campaign length entry box 532, and a submission button 534. The upload image box 524 enables a merchant to upload content (e.g., a picture, a video, or an animation) to the merchant-based content upload module 502. The selection location button 526 enables the merchant to identify a geolocation by drawing boundaries on the map 522 or by inputting an address or a zip code. The filter title box 528 enables the merchant to submit a name for the media filter. The bid amount entry box 530 enables the merchant to enter a bid amount for the identified geolocation. The campaign length entry box 532 enables the merchant to specify a length of a campaign in which the uploaded content is associated with the identified geolocation. The merchant may submit the uploaded content and entered information by clicking on the submit button 534.

Figure 5D:
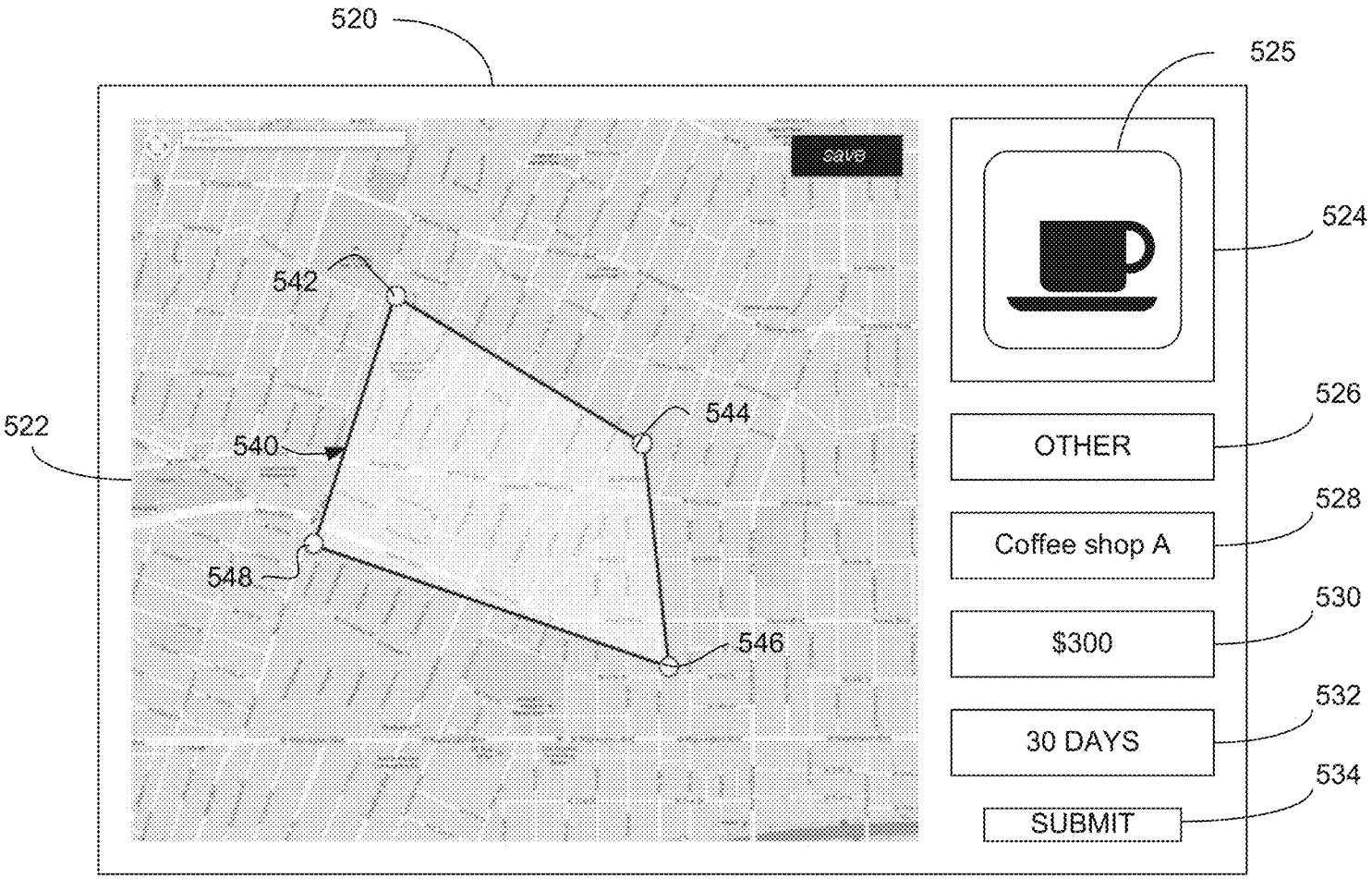
FIG. 5D illustrates an example of a bid from a first merchant using the graphical user interface of FIG. 5C.

FIG. 5D illustrates an example where a merchant A has identified boundaries points 542, 544, 546, and 548 on the map 522 to define a geolocation 540. Merchant A has uploaded a picture 525 displayed in the upload image box 524. Merchant A has entered a title "Coffee shop A" in the filter title box 528, a bid amount of $300 in the bid amount entry box 530, and a campaign length of 30 days in the campaign length entry box 532. Merchant A submits the picture 525, the requested geolocation 540, and other entered information by clicking on the submit button 534. The merchant-based publication engine 510 generates a media filter for merchant A.

Figure 5E:
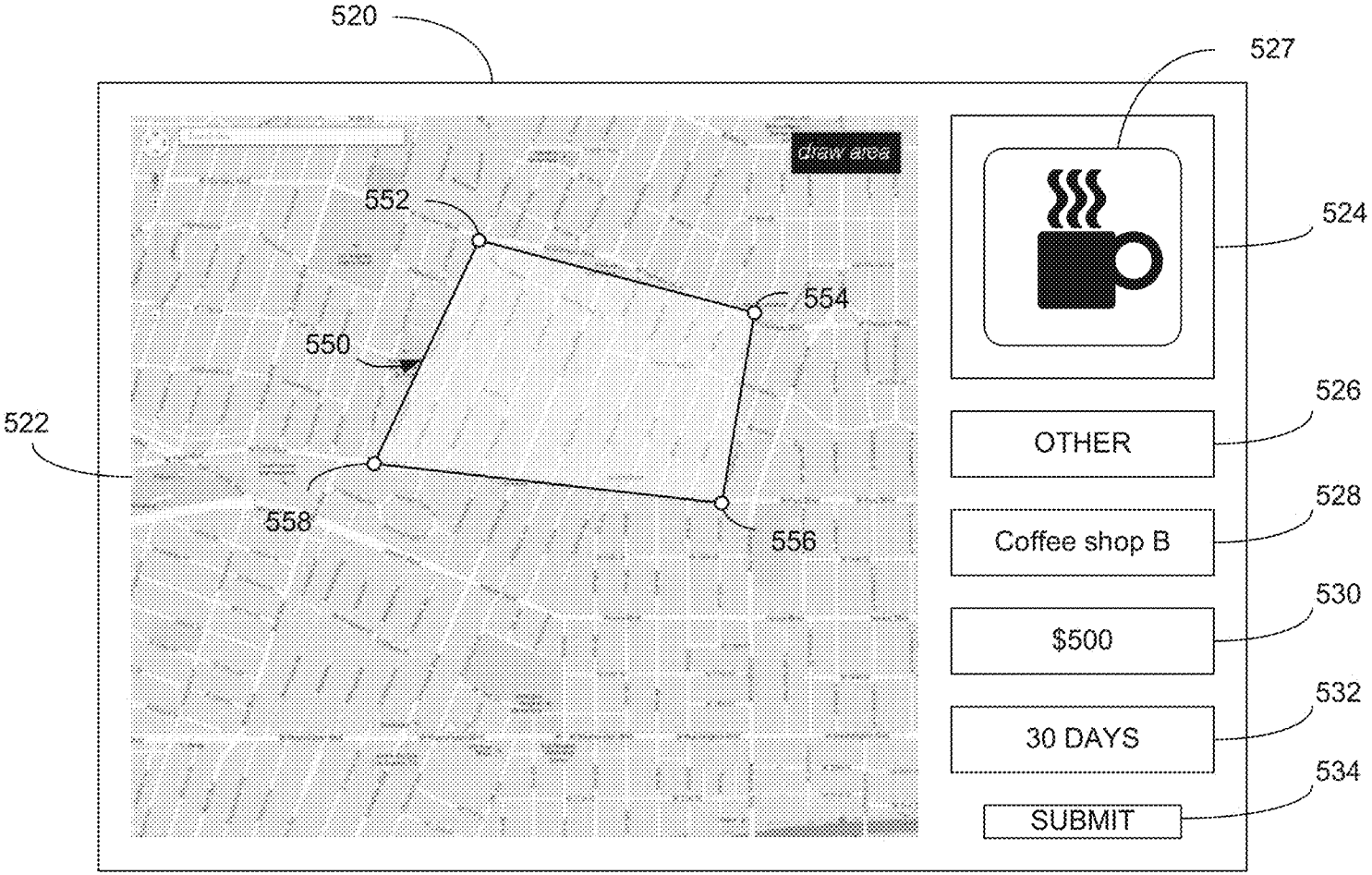
FIG. 5E illustrates an example of a bid from a second merchant using the graphical user interface of FIG. 5C.

FIG. 5E illustrates an example where another merchant, merchant B, has identified boundaries points 552, 554, 556, and 558 on the map 522 to define a geolocation 550. Merchant B has uploaded a picture 527 displayed in the content upload box 524. Merchant B has entered a title "Coffee shop B" in the filter title box 528, a bid amount of $500 in the bid amount entry box 530, and a campaign length of 30 days in the campaign length entry box 532. Merchant B may submit the picture 527, the requested geolocation 550, bid amount, and campaign length by clicking on the submission button 534. The merchant-based publication engine 510 generates a media filter for merchant B.

Figure 5F:
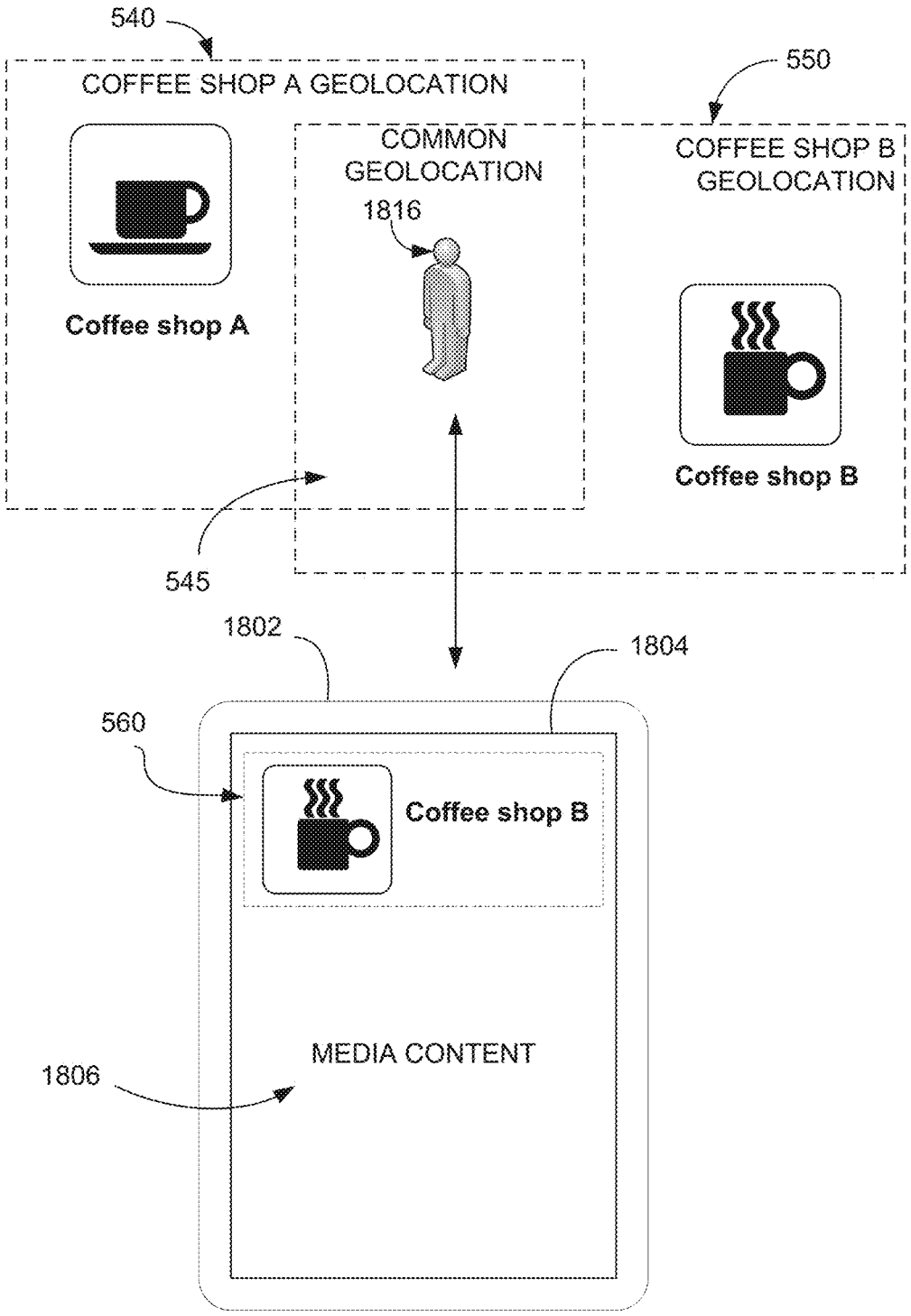
FIG. 5F illustrates an example of an operation of a merchant-based media filter.

FIG. 5F shows a diagram illustrating an example of a merchant-based media filter selected based on a bidding process. The geolocation 540 of merchant A and the geolocation 550 of merchant B overlap at a common geolocation 545. The user 1816 is located at the common geolocation 545 and uses his mobile device 1802 to generate the media content 1806 (e.g., user 1816 takes a picture) in the display 1804 of the mobile device 1802. The media filter of the merchant with the highest bid for the common location 545 is published to the mobile device 1802. In the present example, merchant B has outbid merchant A. As such, media filter 560 of merchant B is provided and displayed in the display 1804 on top of the media content 1806. The media filter 560 contains the uploaded content from merchant B. In addition, it should be noted that 'merchant' in the context of the current example embodiments may include not only entities involved in the trade or sale of merchandise but any other entity as well, including individuals, universities, non-profit organizations, student organizations, clubs, etc.

Figure 6A:
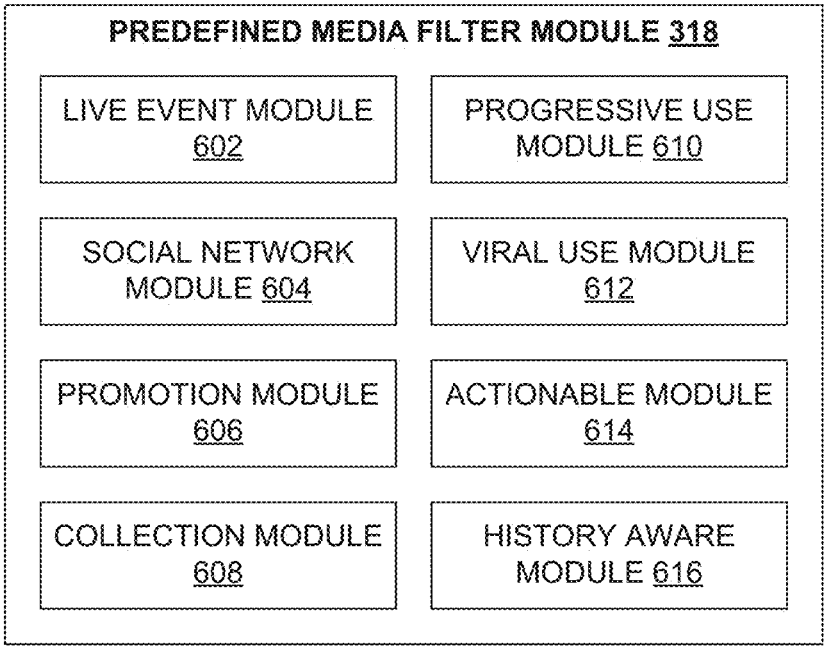
FIG. 6A shows a block diagram illustrating one example embodiment of a predefined media filter module.

FIG. 6A shows a block diagram illustrating one example embodiment of the predefined media filter module 318. The predefined media filter module 318 includes, for example, a live event module 602, a social network module 604, a promotion module 606, a collection module 608, a progressive use module 610, a viral use module 612, an actionable module 614, and a history aware module 616.

The live event module 602 generates a media filter based on live event information. The live event information may be related to a live game score of a sporting event associated with a corresponding geolocation, or a live news event related to an entertainment or social event associated with a corresponding geolocation. For example, a user of the client device 110 attends a game at a stadium. As such, media metadata from the client device 110 may identify the location of the stadium with a date and time. The live event module 402 uses that information to search for a live event associated with the location of the stadium, date, and time. The live event module 602 retrieves a current or nearly current game score associated with the live sporting event at the stadium (via e.g., the ESPN API). The live event module 602 may also retrieve insignias or team logos associated with the live sporting event. As such, the live event module 602 generates a media filter containing the latest score based on news sources covering the live sporting event.

In another example, the user of the client device 110 attends a social event at a venue. Similarly, media metadata identifies the location of the venue with a date and time. The live event module 602 uses that information to search for a live event associated with the location of the venue, date, and time from sources such as a social network server or news media service. The live event module 602 retrieves a news feed associated with the live social event at the venue. As such, the live event module 602 generates a media filter containing information or content based on news retrieved from a news feed associated with the live social event at the venue.

The social network module 604 generates a media filter based on social network information of a user of the client device 110. The social network information may include social network data retrieved from a social network service provider. The social network data may include profile data of the user, "likes" of the user, establishments that the user follows, friends of the user, and postings of the user among others. For example, the media filter associated with a restaurant may be available to the user at the location of the restaurant if the user has identified himself as a fan of the restaurant or indicates a "like" of the restaurant with the social network service provider. In another example, the ranking or priority of displaying the media filter in the client device 110 of the user may be based on the profile of the user or the number of "check-ins" of the user at the restaurant.

In another example embodiment, the media filter may be restricted and available only to the user and the social network (e.g., friends or other users in different categories) of the user of the client device 110. As such, the user may forward the media filter to his friends.

The promotion module 606 generates media filters for a promotion (e.g., a game, contest, lottery). For example, a set of unique media filters may be generated. One media filter from the set of unique media filters may be provided to the client device 110 when the client device 110 is at a predefined location associated with the media filters. For example, the user may visit a fast food restaurant. The media metadata from the client device 110 identifies the location of the fast food restaurant. The promotion module 606 retrieves a unique media filter from the set of unique media filters and provides it to the client device 110. The promotion module 606 may remove the unique media filter from the set of unique media filters after it has been provided to the client device 110. In another embodiment, the promotion module 406 removes the unique media filter from the set of unique media filters after it has been provided to other client devices for a predefined number of times.

The media filter includes content related to a game or promotion. In another example, the media filter may include dynamic content adjusted based on the game or promotion. For example, the dynamic content may include a current number of remaining media filters of the game or promotion. The media filters from the promotion module 606 may be "collected" by the client device 110. For example, the client device 110 may store the media filter in a collection at the client device 110. A prize may be redeemed upon collection of each filter of a predefined set of media filters.

The collection module 608 generates collectible media filters. For example, the client device 110 is provided with a media filter associated with the geolocation of the client device 110. The media filter may be collected by the client device 110 and be made permanently available to the client device 110. The client device 110 may store the collected media filter in a collection folder at the client device 110.

The progressive use module 610 generates media filters with dynamic content that changes based on a number of uses of the media filters. For example, a media filter can be set to be used for a limited number of times. Every time the media filter is provided to a client device, a content of the media filter is adjusted. For example, the media filter may include a fundraising progress bar in which a level of the bar rises every time the media filter is used. The dynamic content in the media filter may include a countdown displaying the number of remaining usage of the media filter.

The viral use module 612 generates media filters that can be forwarded to other users outside a geolocation associated with the media filters. For example, the client device 110 receives a media filter based on a geolocation of the mobile device 110. The client device 110 can send the media filter to mobile device 112 that is outside the geolocation of the mobile device 110. The forwarded media filter may be available for use by the mobile device 112 for a predefined time limit (e.g., one hour). Similarly, the mobile device 112 may forward the media filter to other mobile devices outside the geolocation of the mobile device 110 for use within the predefined time limit.

The actionable module 614 generates media filters with an action associated with a content of the media filter. For example, the media filter can start a browser of the client device 110 and open a predetermined website in the browser. In another embodiment, the media filter is capable of opening other functionalities (e.g., payment application) or executing other programs at the client device 110. For example, a user can tap on the media filter to download or display a coupon associated with the media filter at the client device 110.

The history aware module 616 generates media filters based on geolocation of the mobile device 110 and historical events associated with the geolocation. For example, a media filter may include pictures of a pyramid associated with the geolocation of the mobile device 110. The media filters may be collected based on the historical events or, for example, for each of the Seven Natural Wonders of the World. For example, a media filter associated with a national park may be collected when the user visits the national park. The device can collect all media filters associated with all national parks.

Figure 6B:
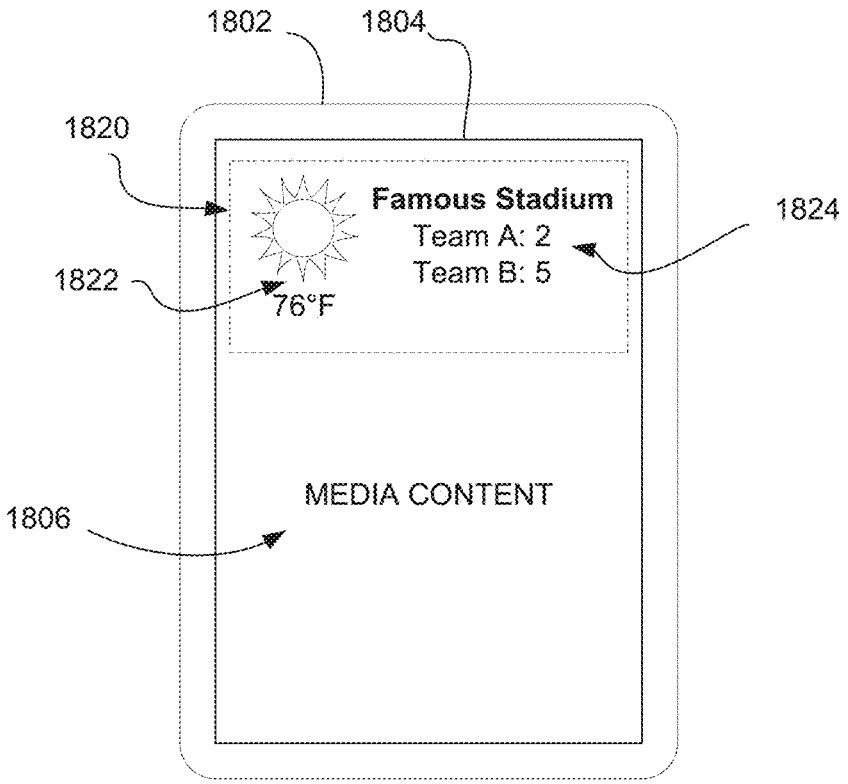
FIG. 6B shows a diagram illustrating an example of a media filter with live data content.

FIG. 6B shows a diagram illustrating an example of a media filter 1820 with live data content. The media filter 1820 contains live data associated with a geolocation of the mobile device 1802. For example, the live data contains a live weather status 1822 and latest score update 1824 of a sporting event associated with the geolocation of the mobile device 1802. The mobile device 1802 displays the media filter 1820 on top of (i.e., as a transparent overlay) the media content 1806. In one example embodiment, the media filter 1820 may be implemented with the live event module 602 of FIG. 6A.

Figure 6C:
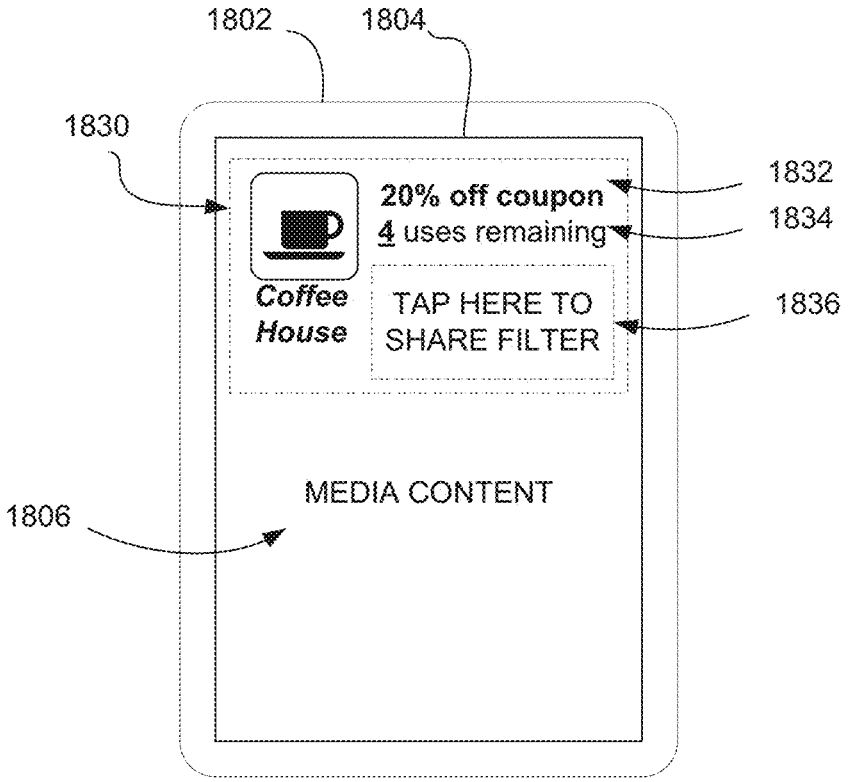
FIG. 6C shows a diagram illustrating an example of a media filter with dynamic progressive use content.

FIG. 6C shows a diagram illustrating an example of a media filter 1830 with promotional content. For example, the media filter 1830 includes a digital coupon 1832 that can be redeemed at a coffee shop. The media filter 1830 may include dynamic content 1834. For example, the dynamic content 1834 may include a remaining number of times the coupon can be used. Furthermore, the media filter 1830 may include an actionable area 1836 that is associated with an executable function. For example, when the user taps the actionable area 1836, the media filter 1830 is forwarded to a mobile device of a friend of the user. The mobile device 1802 displays the media filter 1830 on top of the media content 1806. In one example embodiment, the media filter 1830 may be implemented with the social network module 604, the promotion module 606, the progressive use module 610, and the actionable module 614 of FIG. 6A.

Figure 6D:
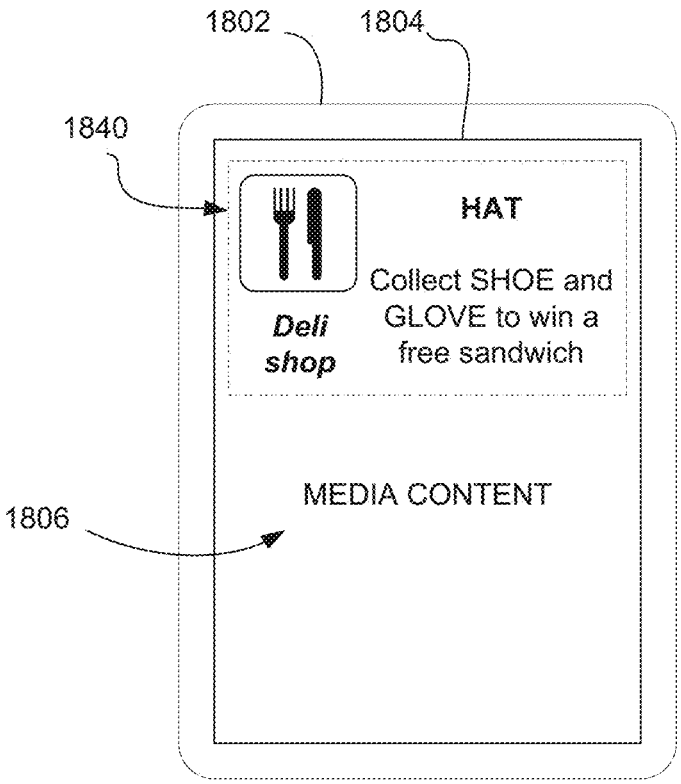
FIG. 6D shows a diagram illustrating an example of a media filter with promotional content.

FIG. 6D shows a diagram illustrating an example of a collectible media filter 1840. The collectible media filter 1840 may be randomly supplied to the mobile device 1802 in response to detecting the mobile device 1802 at a geolocation associated with the collectible media filter 1840. The collectible media filter 1840 can be stored at the mobile device 1802. Once the mobile device 1802 detects that related collectible media filters have been stored, the mobile device 1802 may cause the related collectible media filters or a corresponding unique media filter to be displayed in the display 1804. The mobile device 1802 displays the media filter 1840 on top of the media content 1806. In one example embodiment, the media filter 1840 may be implemented with the collection module 608 of FIG. 6A.

Figure 6E:
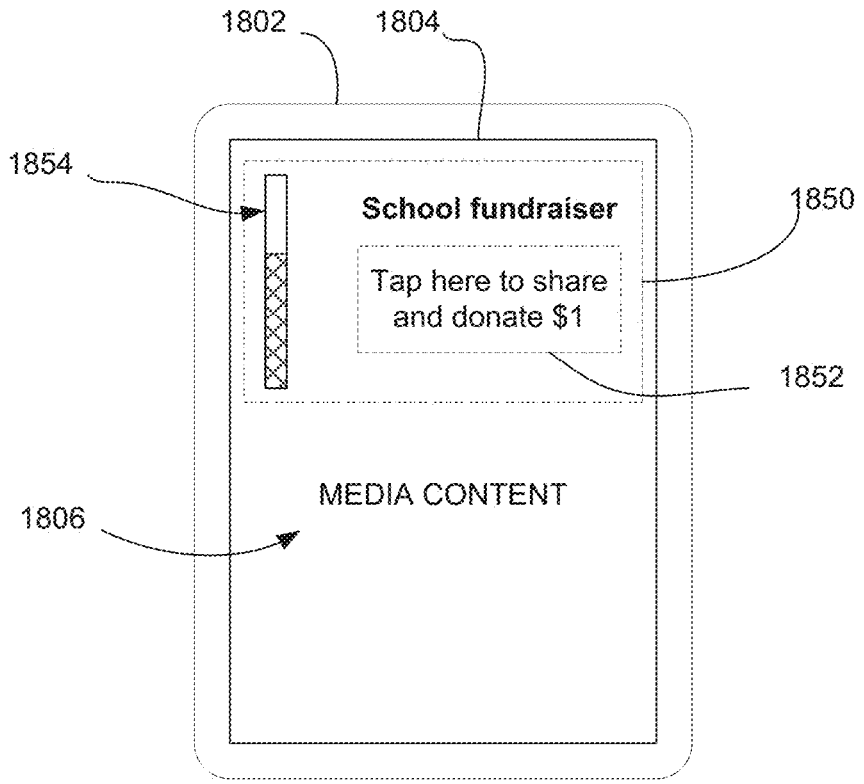
FIG. 6E shows a diagram illustrating an example of a media filter with viral content.

FIG. 6E shows a diagram illustrating an example of a viral media filter 1850. The viral media filter 1850 may include dynamic content 1854 and an actionable area 1852. For example, the dynamic content 1854 shows a progress bar and goal of a fundraising event. The progress bar is adjusted based on a latest amount raised. The actionable area 1852 may trigger the mobile device 1802 to cause a financial transaction (e.g., donation) and a communication to another mobile device (e.g., message to another mobile device using the messaging application 120). The mobile device 1802 displays the media filter 1850 on top of the media content 1806. In one example embodiment, the media filter 1850 may be implemented with the progressive use module 610, the viral use module 612, and an actionable module 614 of FIG. 6A.

Figure 7:
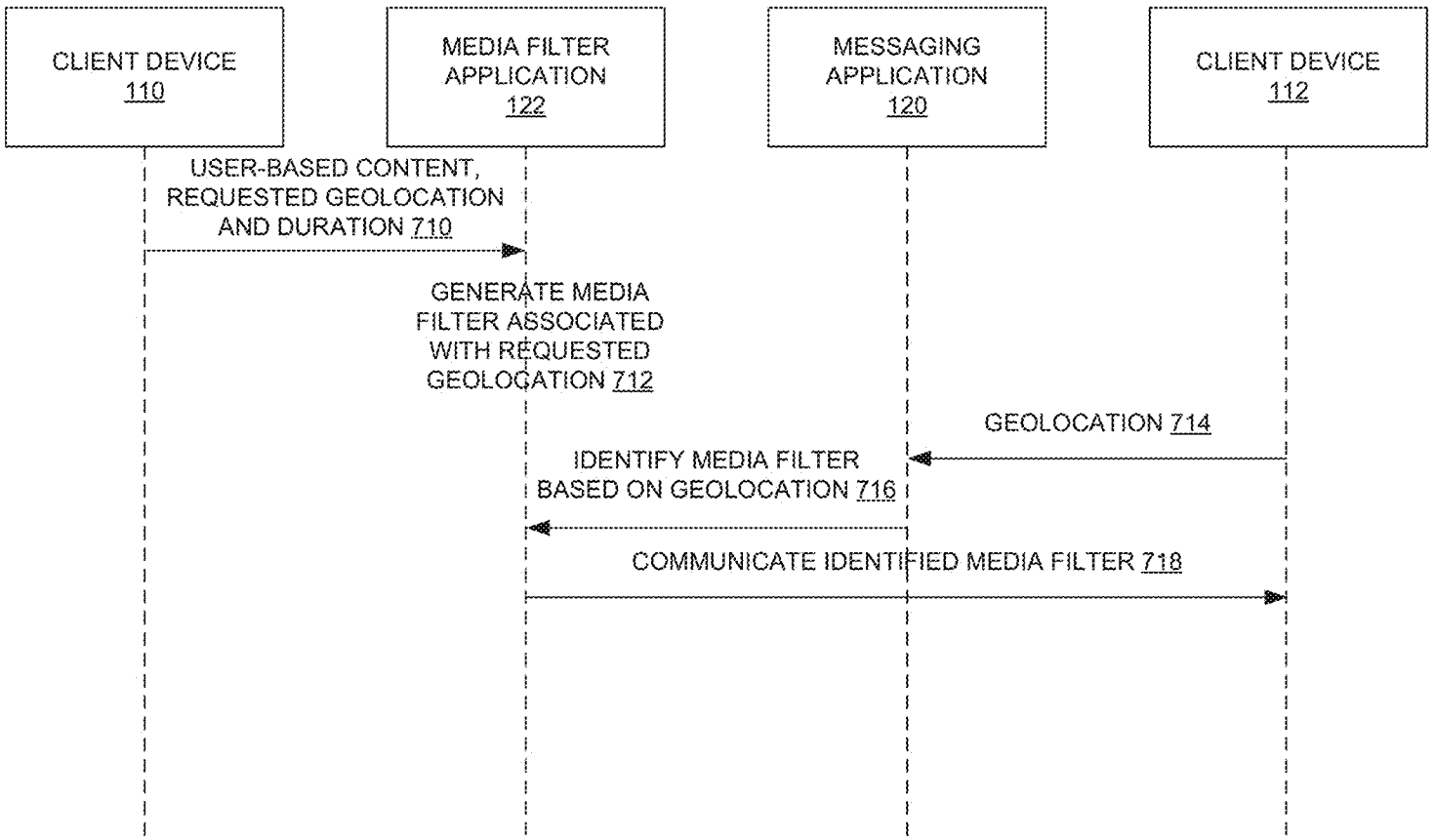
FIG. 7 shows an interaction diagram illustrating one example embodiment of an operation of the user-based media filter publication module.

FIG. 7 shows an interaction diagram illustrating one example embodiment of an operation of the user-based media filter publication module 314. At operation 710, the client device 110 of a first user uploads content and sends a requested geolocation and a requested time duration to the media filter application 122. At operation 712, the media filter application 122 generates a media filter based on the uploaded content and associates the media filter with the requested geolocation for the requested time duration. In one example embodiment, operations 710 and 712 may be implemented with the user-based media filter publication module 314 of FIG. 3.

At operation 714, the client device 112 of a second user sends geolocation information to the messaging application 120. At operation 716, the messaging application 120 identifies, from the media filter application 122, a media filter based on the geolocation of the client device 112. At operation 718, the media filter application 122 supplies the client device 112 with the identified media filter. In one example embodiment, operations 716 and 718 may be implemented with the media filter engine 306 of FIG. 3.

Figure 8:
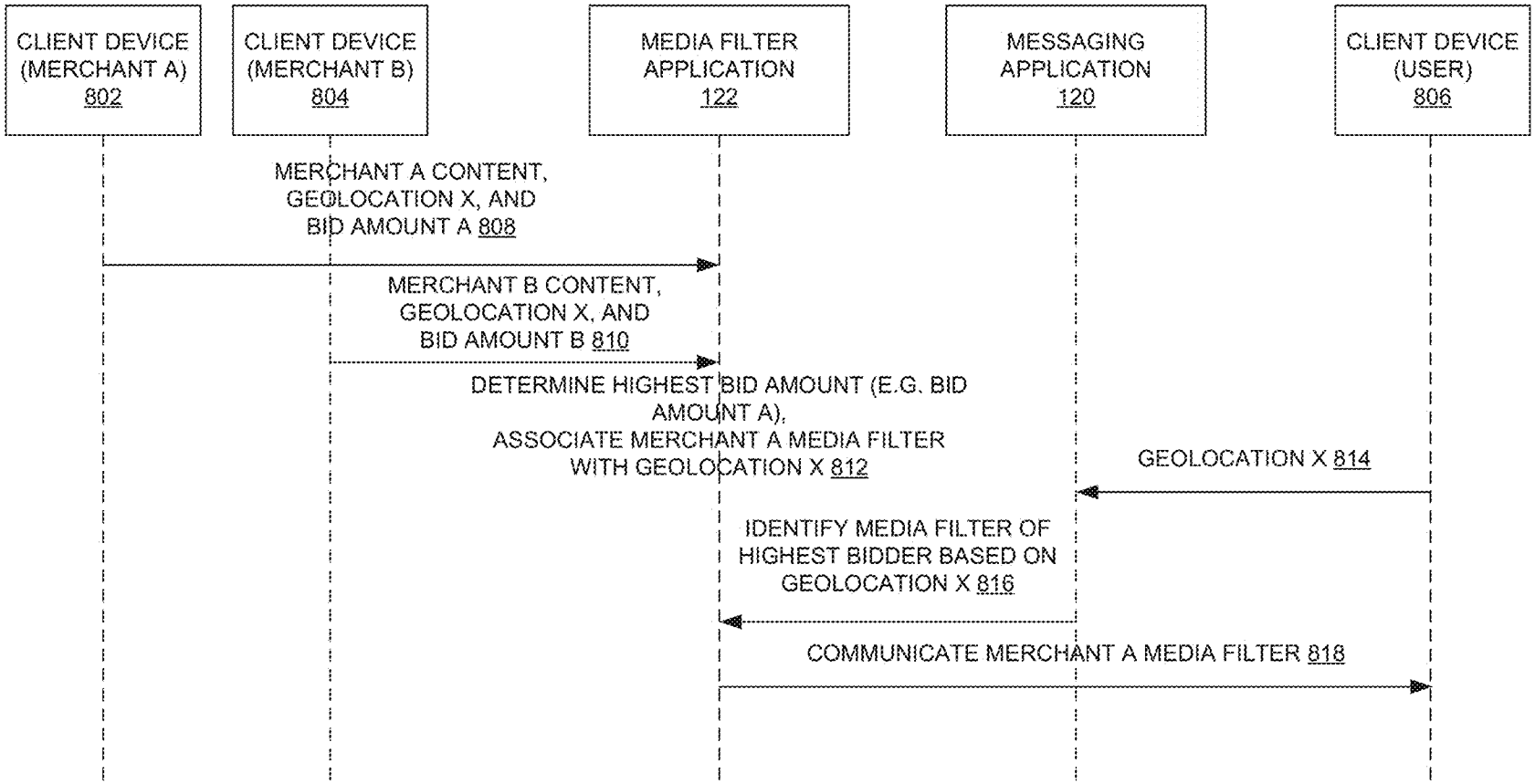
FIG. 8 shows an interaction diagram illustrating another example embodiment of an operation of the merchant-based media filter publication module.

FIG. 8 shows an interaction diagram illustrating another example embodiment of an operation of the merchant-based media filter publication module 316. At operation 808, a client device 802 of merchant A uploads content with geolocation information (e.g., geolocation X) and a bid amount (e.g., bid amount A) to the media filter application 122 to form media filter A. At operation 810, a client device 804 of merchant B uploads content with the same geolocation information (e.g., geolocation X) and a bid amount (e.g., bid amount B) to the media filter application 122 to form media filter B. At operation 812, the media filter application 122 determines a highest bidder, and associates the media filter of the highest bidder with geolocation X. For example, if bid amount A is greater than bid amount B, media filter A is provided to client devices that are located at geolocation X. In one example embodiment, operations 808, 810, 812 may be implemented with the merchant-based media filter publication module 316 of FIG. 3.

At operation 814, a client device 806 at geolocation X sends its geolocation information to the messaging application 120. At operation 816, the messaging application 120 identifies, from the media filter application 122, the media filter associated with the geolocation X. At operation 818, the media filter application 122 supplies the client device 806 with media filter A. In one example embodiment, operations 816 and 818 may be implemented with the media filter engine 306 of FIG. 3. In another example embodiment, the media filter application 122 supplies both media filters A and B to the client device 806 with instructions for the client device 806 to display media filter A first before media filter B since merchant A was the highest bidder.

Figure 9:
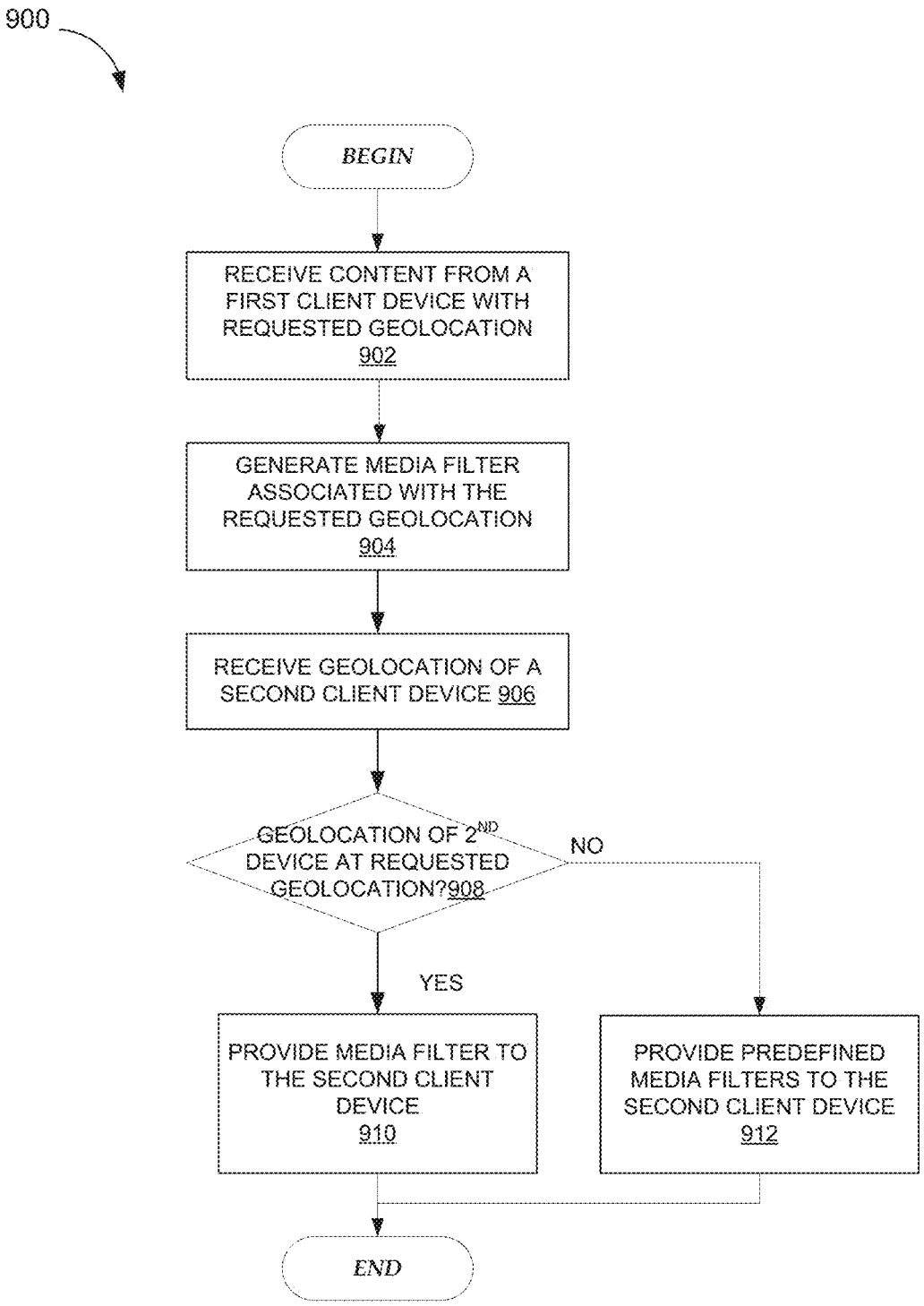
FIG. 9 shows a flow diagram illustrating one example embodiment of an operation of the user-based media filter publication module.

FIG. 9 shows a flow diagram illustrating one example embodiment of a method 900 of the user-based media filter publication module 314. At operation 902, the user-based media filter publication module 314 receives uploaded content and a requested geolocation information from a first client device. In one example embodiment, operation 902 may be implemented with the user-based content upload module 402, the user-based geolocation selection module 404, and the user-based duration selection module 406 of FIG. 4A.

At operation 904, the user-based media filter publication module 314 forms a user-based media filter that includes the uploaded content, and is associated with the requested geolocation. In one example embodiment, operation 904 may be implemented with the user-based publication engine 408 of FIG. 4A.

At operation 906, the user-based media filter publication module 314 receives geolocation information from a second client device. At operation 908, the user-based media filter publication module 314 determines whether the geolocation of the second client device is within the requested geolocation from the first client device. At operation 910, the user-based media filter publication module 314 publishes the user-based media filter from the first client device to the second client device in response to the geolocation of the second client device being within the requested geolocation from the first client device. In one example embodiment, operation 910 may be implemented with the user-based media filter module 320 of FIG. 3.

At operation 912, the media filter engine 306 supplies predefined media filters corresponding to the geolocation of the second client provided to the second device. In one example embodiment, operation 912 may be implemented with the predefined media filter module 318 of FIG. 3.

Figure 10:
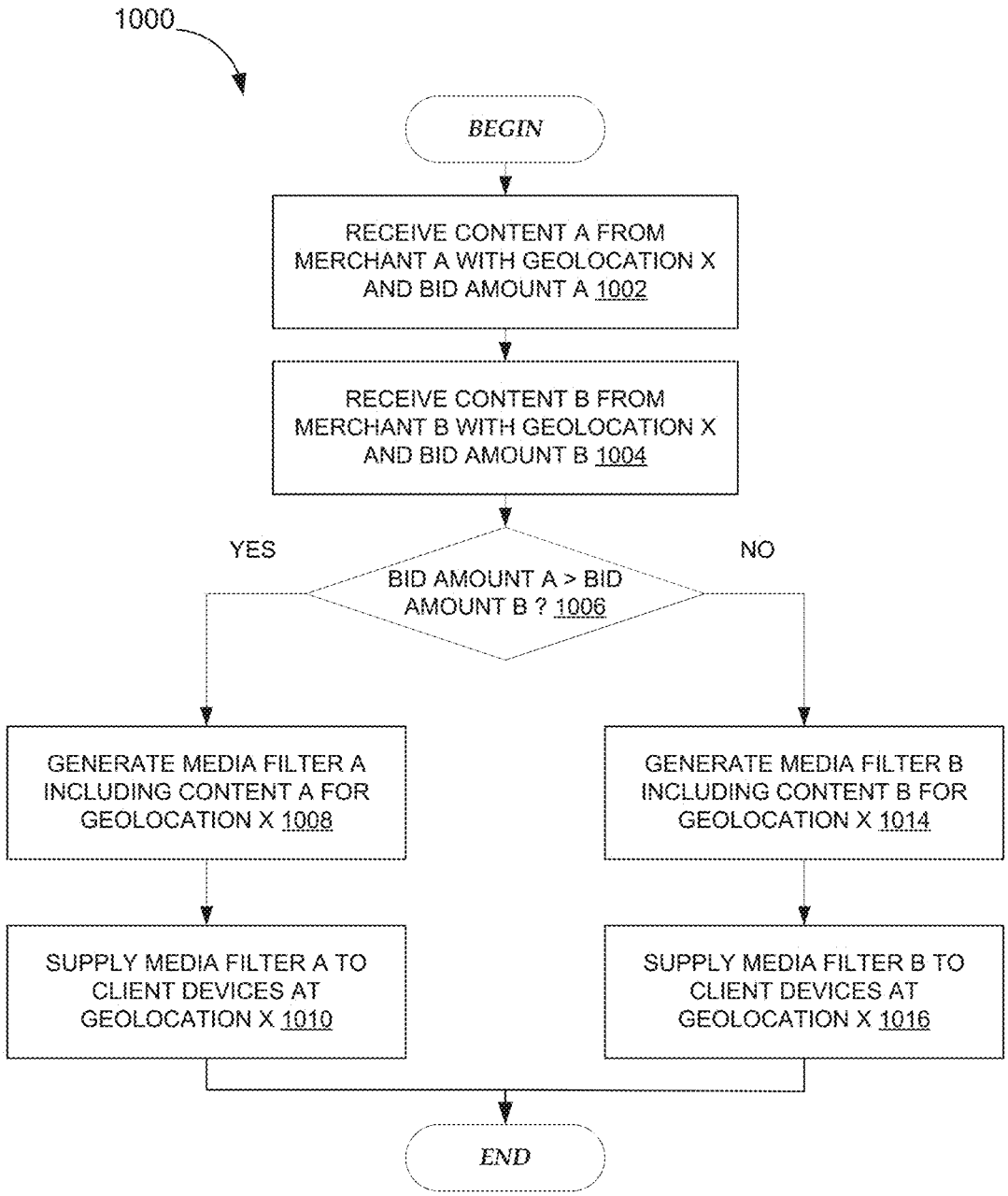
FIG. 10 shows a flow diagram illustrating one example embodiment of an operation of the merchant-based media filter publication module.

FIG. 10 shows a flow diagram illustrating one example embodiment of a method 1000 of operation for the merchant-based media filter publication module 316. At operations 1002 and 1004, the merchant-based media filter publication module 316 receives uploaded content, geolocation information, and corresponding bid amounts from merchants. For example, at operation 1002, the merchant-based content upload module 502 receives content A from merchant A. The merchant-based geolocation selection module 504 receives geolocation X from merchant A. The merchant-based bidding module 508 receives bid amount A from merchant A.

At operation 1004, the merchant-based content upload module 502 receives content B from merchant B. The merchant-based geolocation selection module 504 receives geolocation X from merchant B. The merchant-based bidding module 508 receives bid amount B from merchant B.

At operation 1006, the highest bid amount is determined. In one example embodiment, operation 1006 may be implemented with the merchant-based bidding module 508 of FIG. 6A. If bid amount A is greater than bid amount B, the merchant-based publication engine 510 generates a merchant-based media filter A based on content A and geolocation X at operation 1008. At operation 1010, the merchant-based media filter module 322 supplies merchant-based media filter A to client devices that are located at geolocation X.

If bid amount B is greater than bid amount A, the merchant-based publication engine 510 generates a merchant-based media filter B based on content B and geolocation X at operation 1014. At operation 1016, the merchant-based media filter module 322 supplies merchant-based media filter B to client devices that are located at geolocation X.

Figure 11:
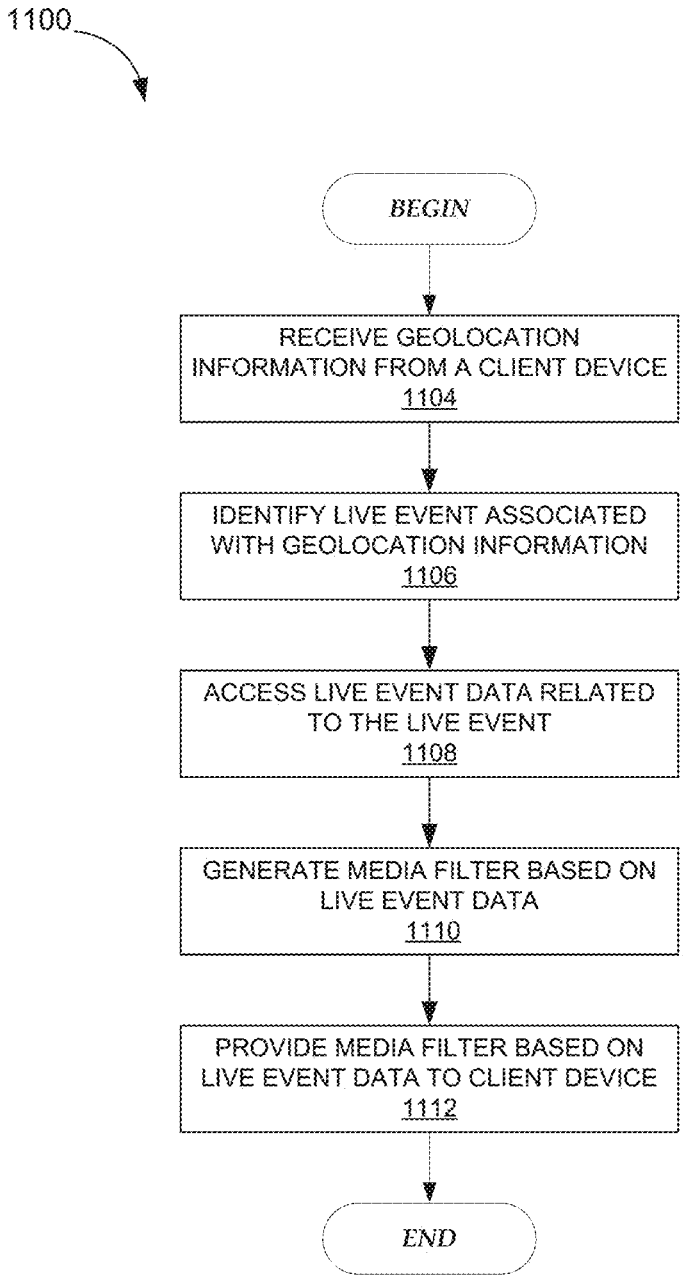
FIG. 11 shows a flow diagram illustrating one example embodiment of an operation of the live event module.

FIG. 11 shows a flow diagram illustrating one example embodiment of a method 1100 of operation for the live event module 602. At operation 1104, the live event module 602 receives geolocation information from a client device. At operation 1106, the live event module 602 identifies a live event associated with the geolocation. At operation 1108, the live event module 602 accesses live event data related to the live event. At operation 1110, the live event module 602 generates a live event media filter based on the live event data. At operation 1112, the live event module 602 supplies the live event media filter to the client device.

Figure 12:
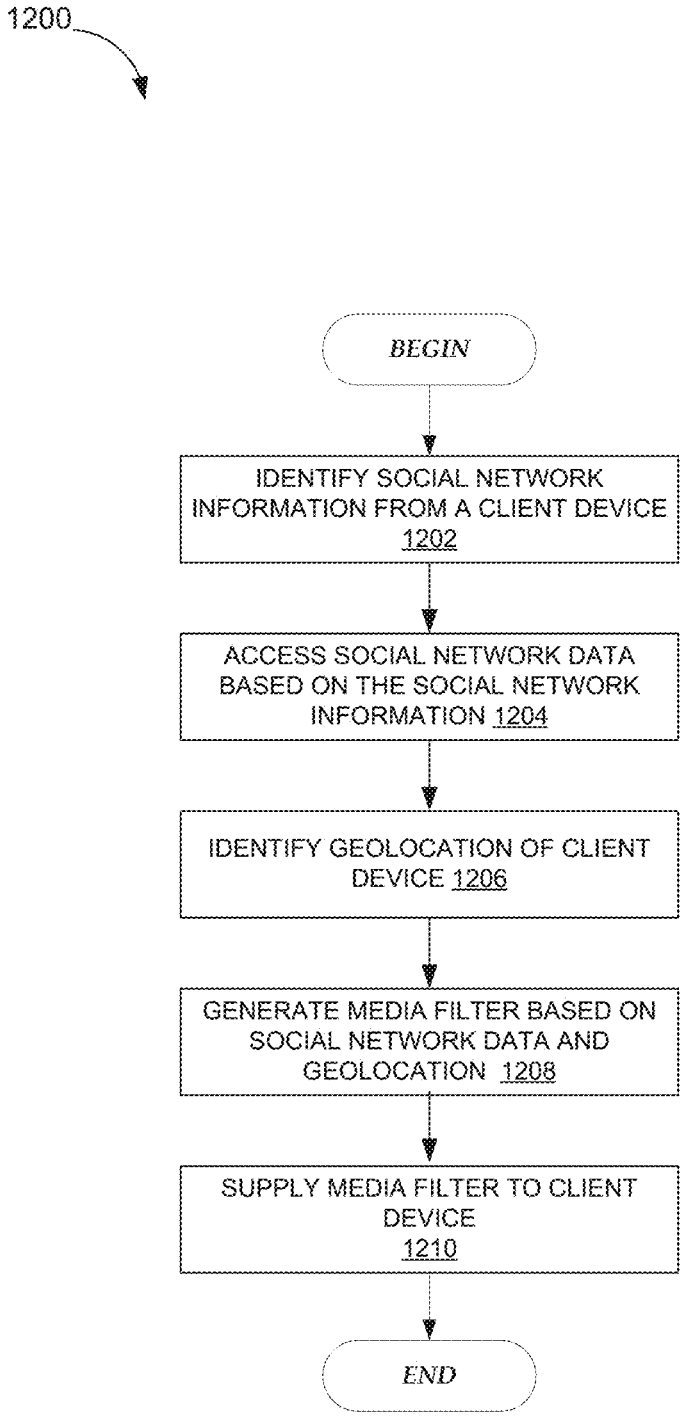
FIG. 12 shows a flow diagram illustrating one example embodiment of an operation of the social network module.

FIG. 12 shows a flow diagram illustrating one example embodiment of a method 1200 of operation for the social network module 604. At operation 1202, the social network module 604 receives social network information from a client device. At operation 1204, the social network module 604 accesses social network data from social network service providers based on social network information from the client device. At operation 1206, the social network module 604 identifies a geolocation from the geolocation information of the client device. At operation 1208, the social network module 604 generates a social network-based media filter based on the social network data and geolocation of the client device. At operation 1210, the social network module 604 supplies the social network-based media filter to the client device.

Figure 13:
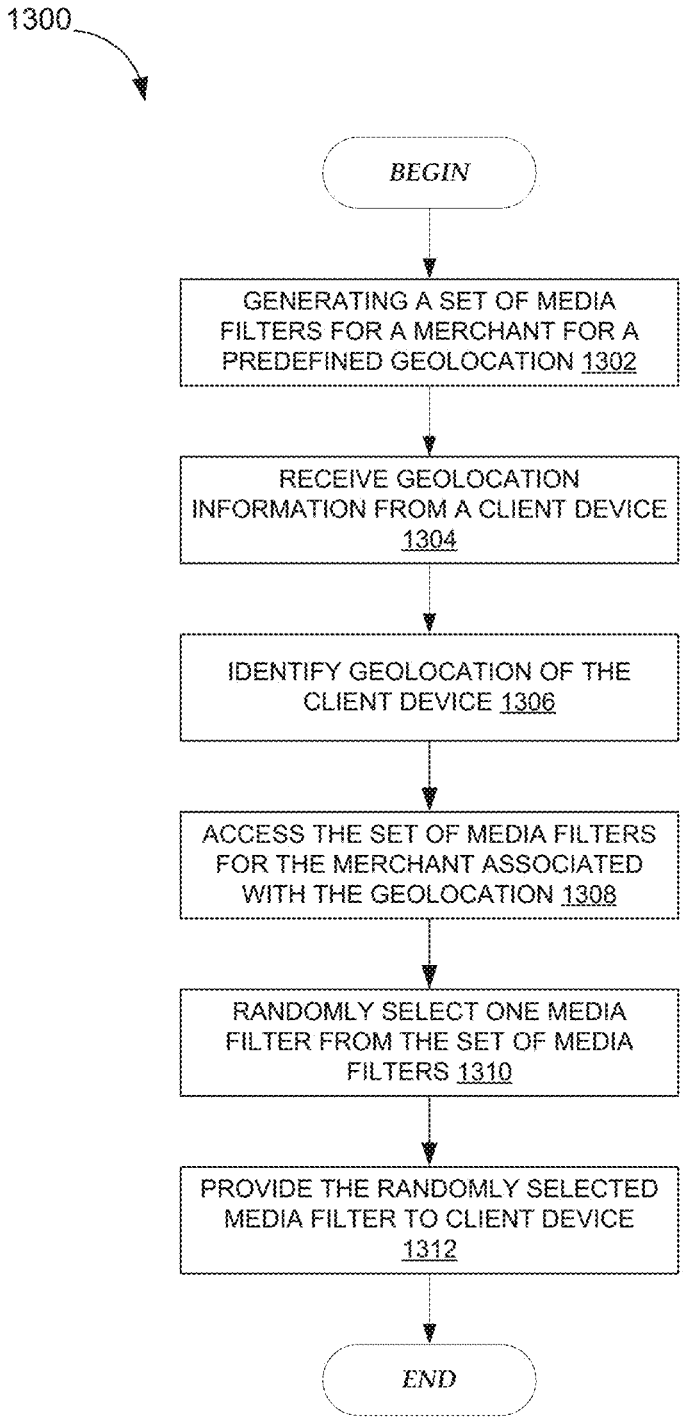
FIG. 13 shows a flow diagram illustrating one example embodiment of an operation of the promotion module.

FIG. 13 shows a flow diagram illustrating one example embodiment of a method 1300 of operation for the promotion module 606. At operation 1302, the promotion module 606 generates a set of media filters for a merchant for a predefined geolocation. At operation 1304, the promotion module 606 receives geolocation information from a client device. At operation 1306, the promotion module 606 identifies the geolocation of the client device from the geolocation information. At operation 1308, the promotion module 606 accesses the set of media filters for the merchant associated with the geolocation. At operation 1310, the promotion module 606 randomly selects at least one media filter from the set of media filters. At operation 1312, the promotion module 606 supplies the randomly selected media filter(s) to the client device.

Figure 14:
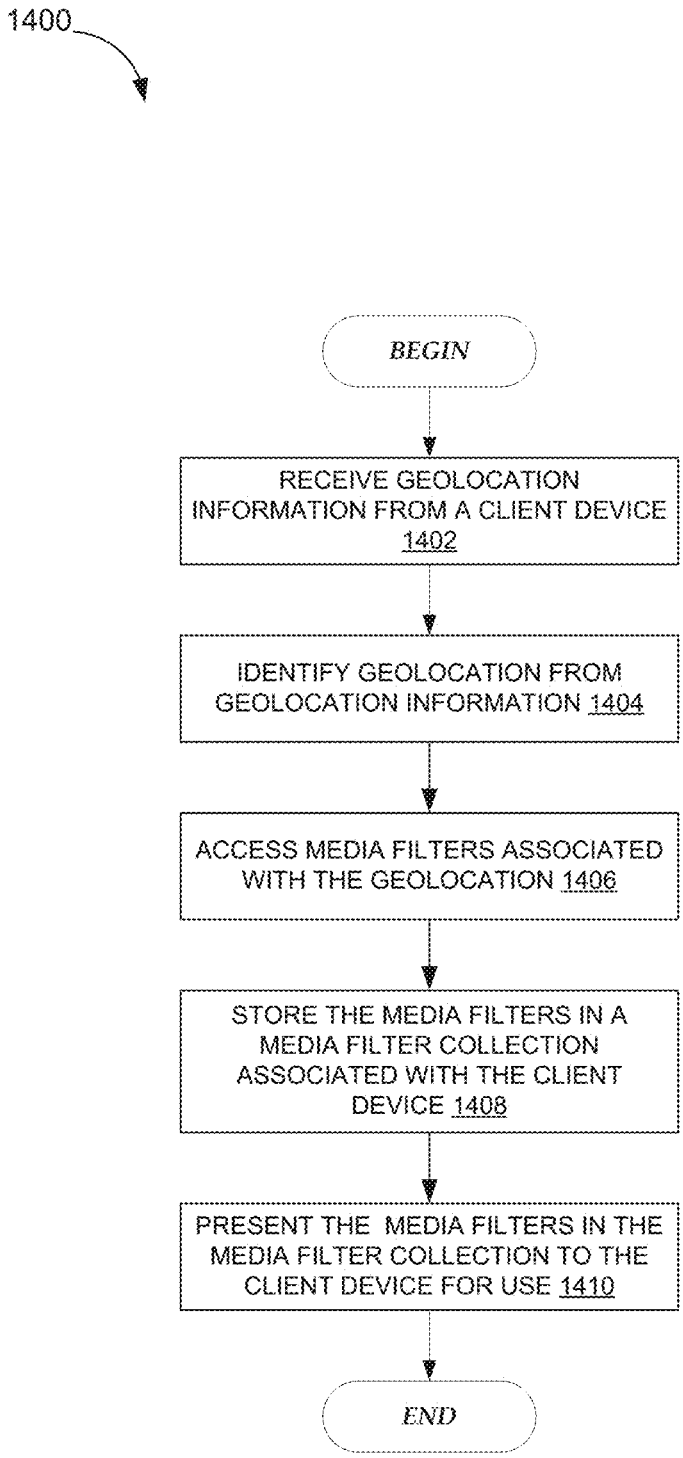
FIG. 14 shows a flow diagram illustrating one example embodiment of an operation of the collection module.

FIG. 14 shows a flow diagram illustrating one example embodiment of a method 1400 of operation for the collection module 608. At operation 1402, the collection module 608 receives geolocation information from a client device. At operation 1404, the collection module 608 determines the geolocation of the client device from the geolocation information. At operation 1406, the collection module 608 accesses media filters associated with the geolocation of the client device. At operation 1408, the collection module 608 stores the media filters in a media filter collection associated with the client device. At operation 1410, the collection module 608 presents the media filters in the media filter collection to the client device for use.

Figure 15:
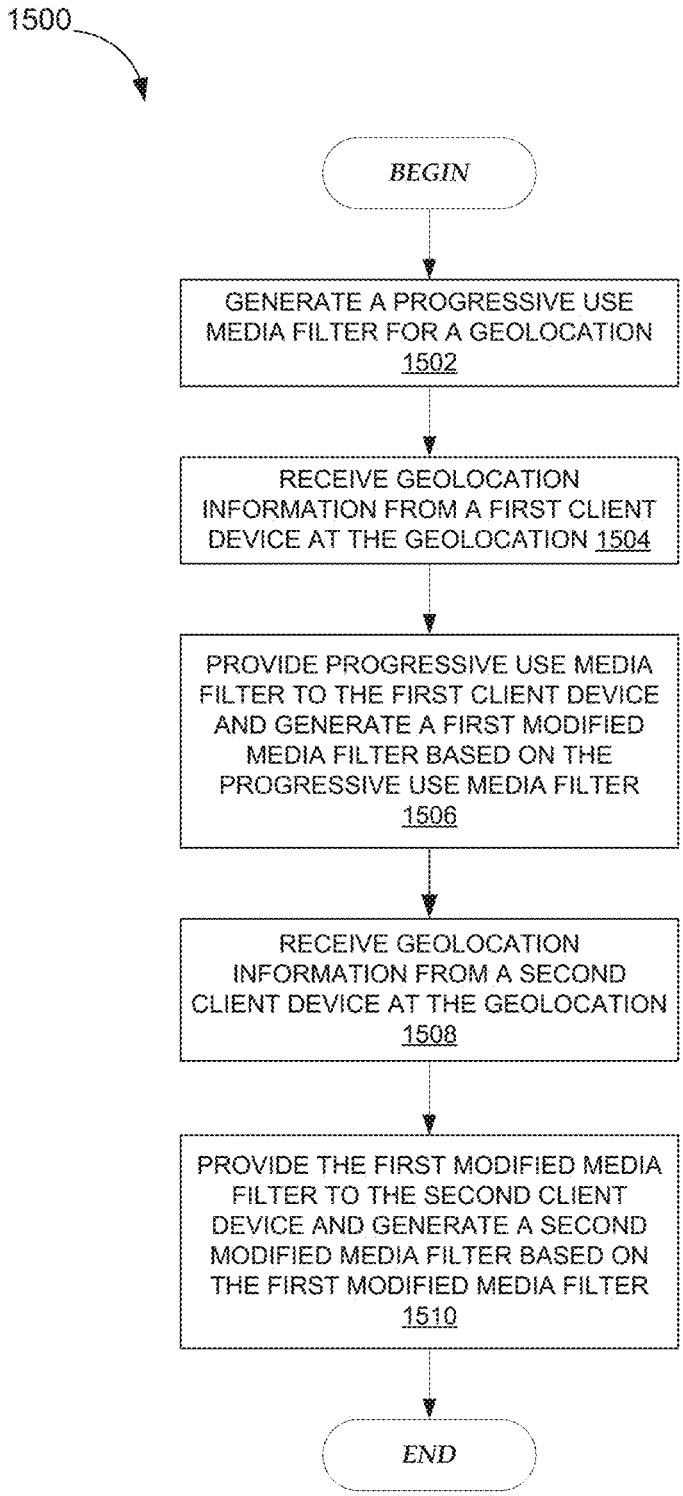
FIG. 15 shows a flow diagram illustrating one example embodiment of an operation of the progressive use module.

FIG. 15 shows a flow diagram illustrating one example embodiment of a method 1500 of operation for the progressive use module 610. At operation 1502, the progressive use module 610 generates a progressive use media filter for a geolocation. At operation 1504, the progressive use module 610 receives geolocation information from a first client device at the geolocation. At operation 1506, the progressive use module 610 supplies the progressive use media filter to the first client device, and generates a first modified media filter based on the progressive use media filter. At operation 1508, the progressive use module 610 receives geolocation information from a second client at the geolocation. At operation 1510, the progressive use module 610 supplies the first modified media filter to the second client device, and generates a second modified media filter based on the first modified media filter.

Figure 16:
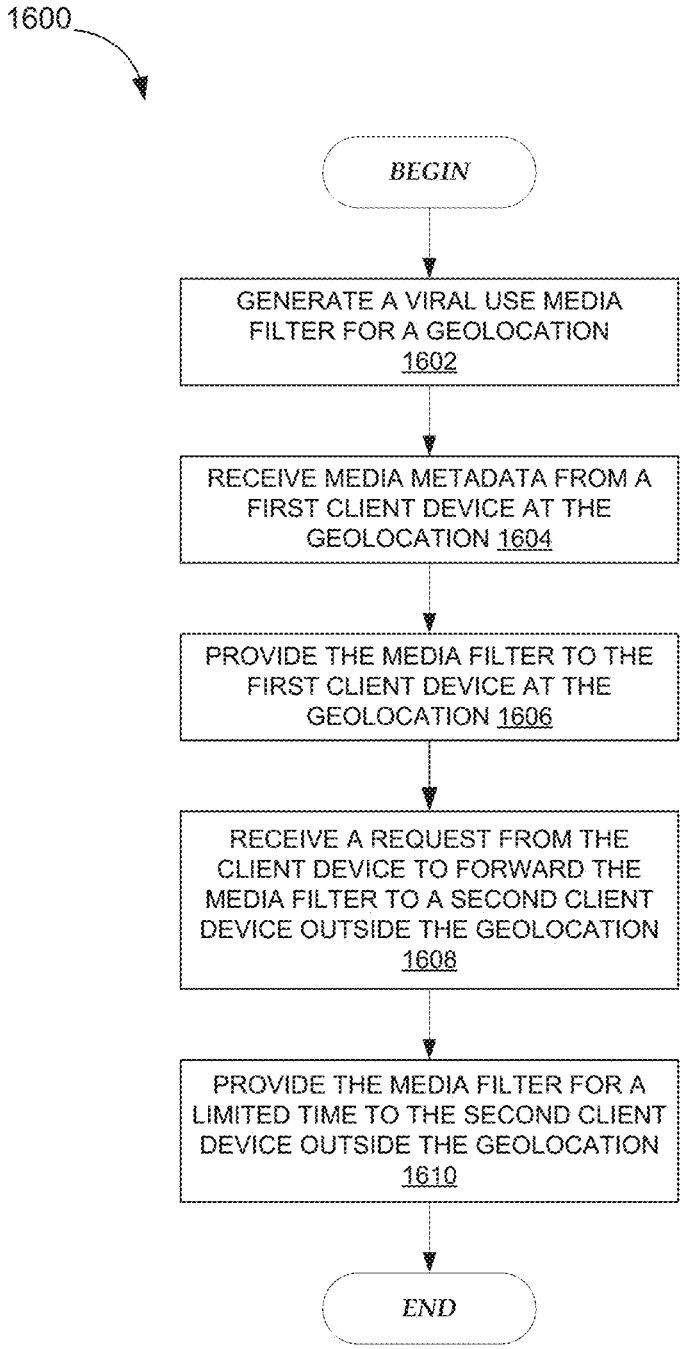
FIG. 16 shows a flow diagram illustrating one example embodiment of an operation of the viral use module.

FIG. 16 shows a flow diagram illustrating one example embodiment of a method 1600 of operation for the viral use module 612. At operation 1602, the viral use module 612 generates a media filter for a geolocation. At operation 1604, the viral use module 612 receives geolocation information from a first client device at the geolocation. At operation 1606, the viral use module 612 supplies the media filter to the first client device at the geolocation. At operation 1608, the viral use module 612 receives a request from the first client device to forward the media filter to a second client device outside the geolocation. At operation 1610, the viral use module 612 provides the media filter for a limited time to the second client device outside the geolocation.

Figure 17:
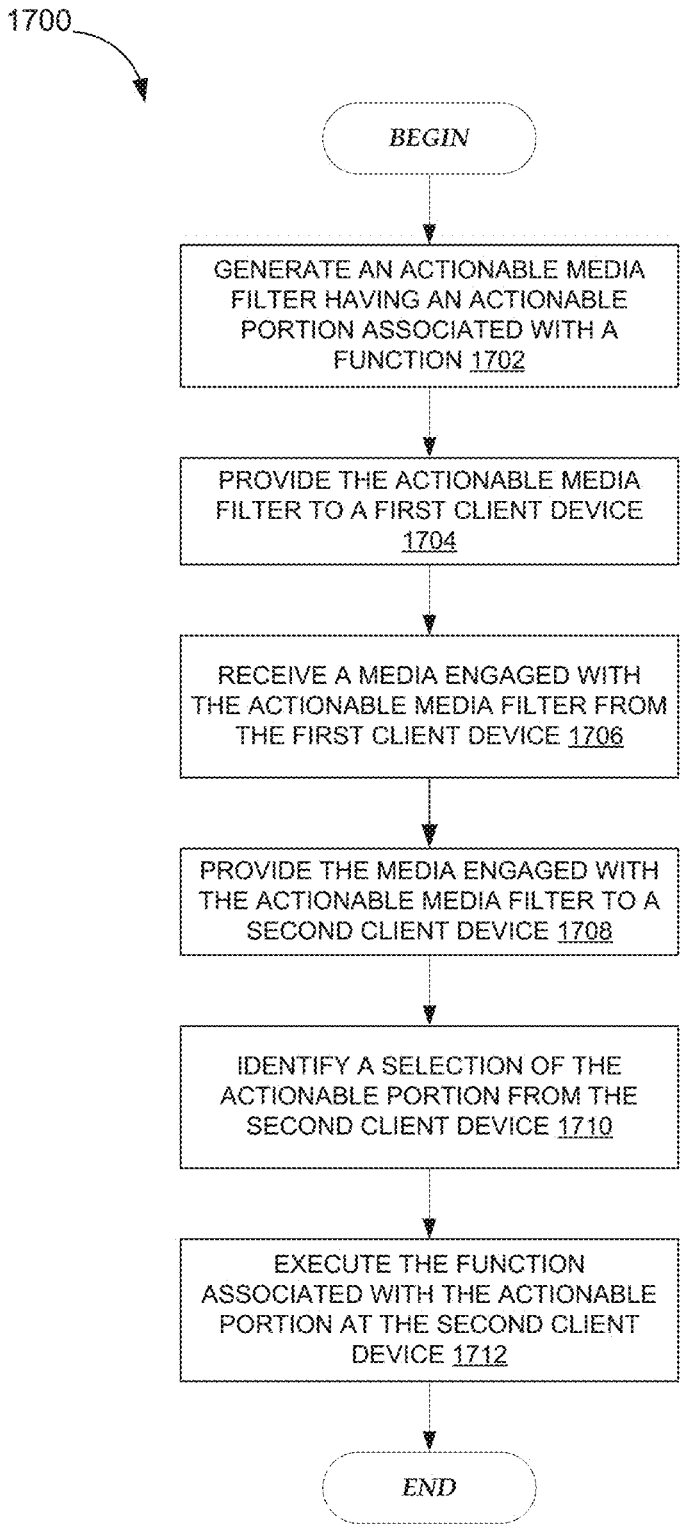
FIG. 17 shows a flow diagram illustrating one example embodiment of an operation of the actionable module.

FIG. 17 shows a flow diagram illustrating one example embodiment of a method 1700 of operation for the actionable module 614. At operation 1702, the actionable module 614 generates an actionable media filter having an actionable portion associated with a function. At operation 1704, the actionable module 614 provides the actionable media filter to a first client device. At operation 1706, the actionable module 614 receives a media item (e.g., a photo) with the media filter from the first client device. At operation 1708, the actionable module 614 supplies the media item with the media filter to the second client device. At operation 1710, the actionable module 614 identifies a selection of the actionable portion from the second client device. At operation 1712, the actionable module 614 executes a function associated with the actionable portion at the second client device.

Modules, Components and Logic

Certain embodiments are described herein as including logic or a number of components, modules, or mechanisms. Modules may constitute either software modules (e.g., code embodied (1) on a non-transitory machine-readable medium or (2) in a transmission signal) or hardware-implemented modules. A hardware-implemented module is a tangible unit capable of performing certain operations and may be configured or arranged in a certain manner. In example embodiments, one or more computer systems (e.g., a standalone, client, or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired), or temporarily or transitorily configured (e.g., programmed) to operate in a certain manner or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respectively different hardware-implemented modules at different times. Software may, accordingly, configure a processor, for example, to constitute a particular hardware-implemented module at one instance of time and to constitute a different hardware-implemented module at a different instance of time.

Hardware-implemented modules can provide information to, and receive information from, other hardware-implemented modules. Accordingly, the described hardware-implemented modules may be regarded as being communicatively coupled. Where multiples of such hardware-implemented modules exist contemporaneously, communications may be achieved through signal transmission (e.g., over appropriate circuits and buses that connect the hardware-implemented modules). In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment, or a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), with these operations being accessible via the network 104 (e.g., the Internet) and via one or more appropriate interfaces (e.g., APIs).

Electronic Apparatus and System

Example embodiments may be implemented in digital electronic circuitry, or in computer hardware, firmware, or software, or in combinations of them. Example embodiments may be implemented using a computer program product (e.g., a computer program tangibly embodied in an information carrier, e.g., in a machine-readable medium for execution by, or to control the operation of, data processing apparatus, e.g., a programmable processor, a computer, or multiple computers).

A computer program can be written in any form of programming language, including compiled or interpreted languages, and it can be deployed in any form, including as a standalone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special purpose logic circuitry (e.g., an FPGA or an ASIC).

The computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that both hardware and software architectures merit consideration. Specifically, it will be appreciated that the choice of whether to implement certain functionality in permanently configured hardware (e.g., an ASIC), in temporarily configured hardware (e.g., a combination of software and a programmable processor), or in a combination of permanently and temporarily configured hardware may be a design choice. Below are set out hardware (e.g., machine) and software architectures that may be deployed in various example embodiments.

Example Computer System

Figure 18:
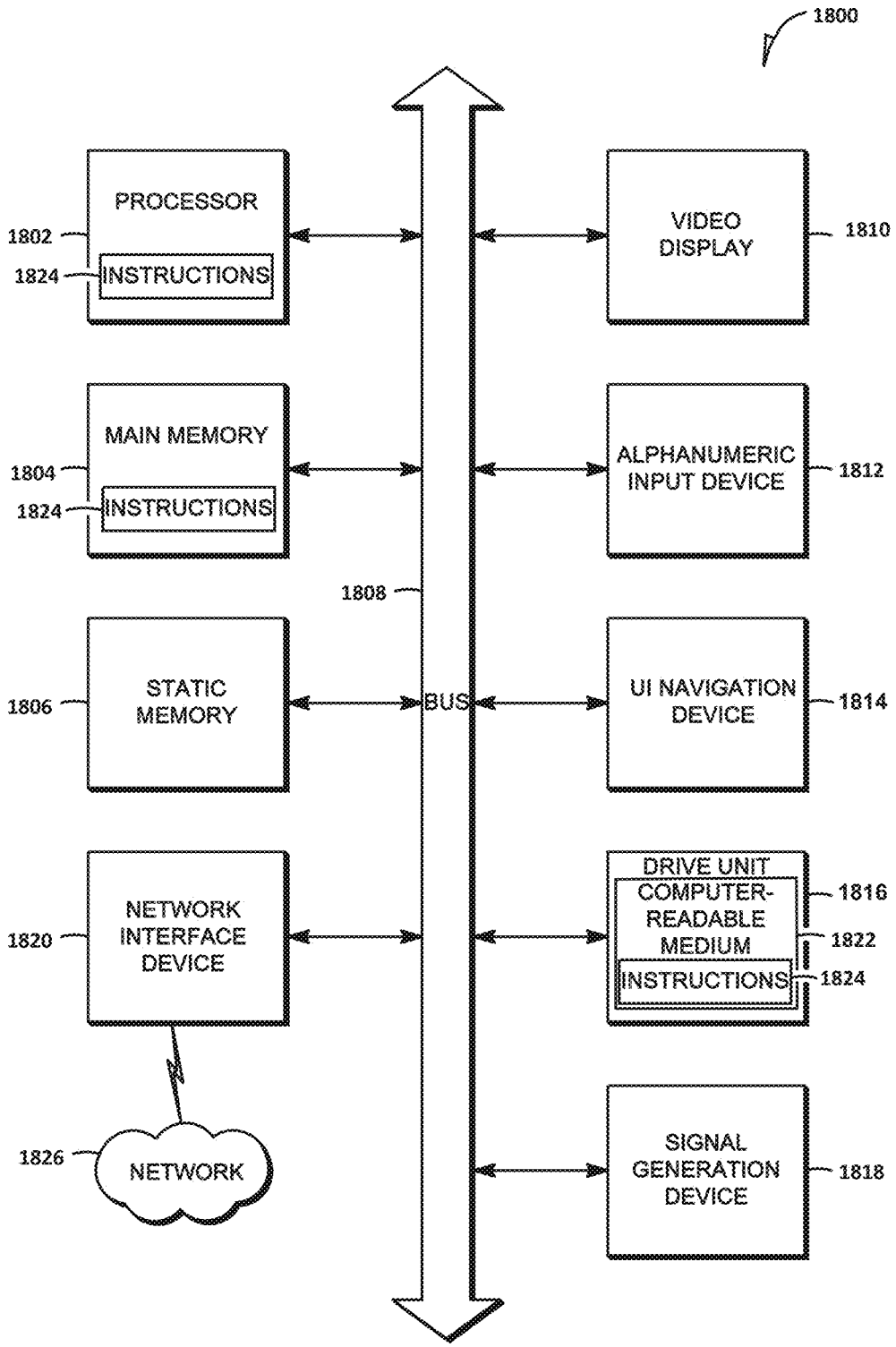
FIG. 18 shows a diagrammatic representation of machine, in the example form of a computer system, within which a set of instructions may be executed to cause the machine to perform any one or more of the methodologies discussed herein.

FIG. 18 shows a diagrammatic representation of a machine in the example form of a machine or computer system 1800 within which a set of instructions 1824 may be executed causing the machine to perform any one or more of the methodologies discussed herein. In alternative embodiments, the machine operates as a standalone device or may be connected (e.g., networked) to other machines. In a networked deployment, the machine may operate in the capacity of a server or a client machine 110 and 112 in a server-client network environment, or as a peer machine in a peer-to-peer (or distributed) network environment. The machine may be a personal computer (PC), a tablet PC, a set-top box (STB), a personal digital assistant (PDA), a cellular telephone, a web appliance, a network router, switch or bridge, or any machine capable of executing a set of instructions 1824 (sequential or otherwise) that specify actions to be taken by that machine. Further, while only a single machine is illustrated, the term "machine" shall also be taken to include any collection of machines that individually or jointly execute a set (or multiple sets) of instructions 1824 to perform any one or more of the methodologies discussed herein.

The example computer system 1800 includes a processor 1802 (e.g., a central processing unit (CPU), a graphics processing unit (GPU), or both), a main memory 1804, and a static memory 1806, which communicate with each other via a bus 1808. The computer system 1800 may further include a video display unit 1810 (e.g., a liquid crystal display (LCD) or a cathode ray tube (CRT)). The computer system 1800 also includes an alphanumeric input device 1812 (e.g., a keyboard), a UI navigation device 1814 (e.g., a mouse), a drive unit 1816, a signal generation device 1818 (e.g., a speaker), and a network interface device 1820.

The drive unit 1816 includes a computer-readable medium 1822 on which is stored one or more sets of data structures and instructions 1824 (e.g., software) embodying or utilized by any one or more of the methodologies or functions described herein. The instructions 1824 may also reside, completely or at least partially, within the main memory 1804 or within the processor 1802 during execution thereof by the computer system 1800, with the main memory 1804 and the processor 1802 also constituting machine-readable media.

The instructions 1824 may further be transmitted or received over a network 1826 via the network interface device 1820 utilizing any one of a number of well-known transfer protocols (e.g., HTTP).

While the computer-readable medium 1822 is shown in an example embodiment to be a single medium, the term "computer-readable medium" should be taken to include a single medium or multiple media (e.g., a centralized or distributed database, and/or associated caches and servers) that store the one or more sets of instructions 1824. The term "computer-readable medium" shall also be taken to include any medium that is capable of storing, encoding, or carrying a set of instructions 1824 for execution by the machine that cause the machine to perform any one or more of the methodologies of the present disclosure, or that is capable of storing, encoding, or carrying data structures utilized by or associated with such a set of instructions 1824. The term "computer-readable medium" shall, accordingly, be taken to include, but not be limited to, solid-state memories, optical media, and magnetic media.

Furthermore, the machine-readable medium is non-transitory in that it does not embody a propagating signal. However, labeling the tangible machine-readable medium "non-transitory" should not be construed to mean that the medium is incapable of movement—the medium should be considered as being transportable from one physical location to another. Additionally, since the machine-readable medium is tangible, the medium may be considered to be a machine-readable device.

Example Mobile Device

Figure 19:
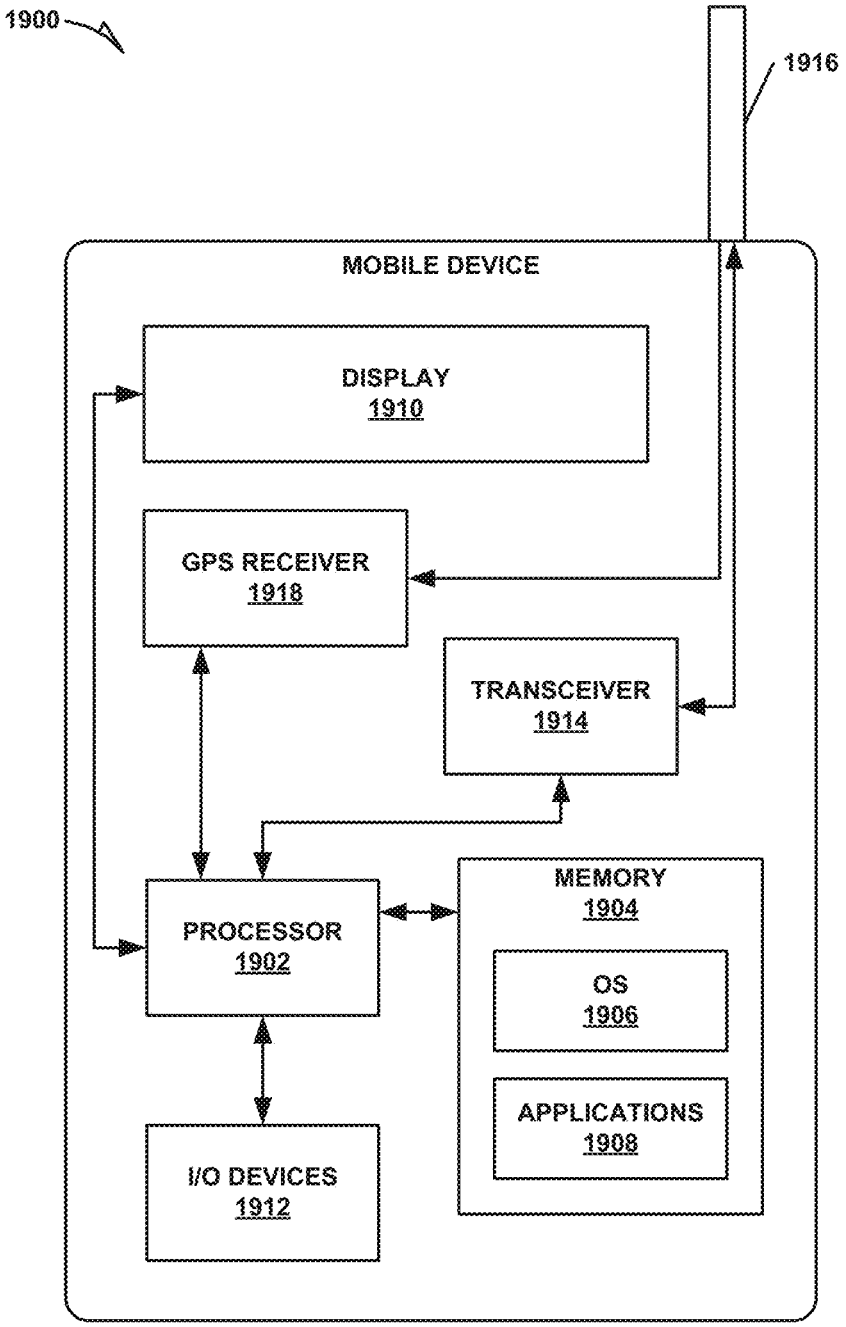
FIG. 19 is a block diagram illustrating a mobile device, according to an example embodiment.

FIG. 19 is a block diagram illustrating a mobile device 1900, according to an example embodiment. The mobile device 1900 may include a processor 1902. The processor 1902 may be any of a variety of different types of commercially available processors 1902 suitable for mobile devices 1900 (for example, an XScale architecture microprocessor, a microprocessor without interlocked pipeline stages (MIPS) architecture processor, or another type of processor 1902). A memory 1904, such as a random access memory (RAM), a flash memory, or another type of memory, is typically accessible to the processor 1902. The memory 1904 may be adapted to store an operating system (OS) 1906, as well as applications 1908, such as a mobile location enabled application that may provide location-based services (LBSs) to a user. The processor 1902 may be coupled, either directly or via appropriate intermediary hardware, to a display 1910 and to one or more input/output (I/O) devices 1912, such as a keypad, a touch panel sensor, a microphone, and the like. Similarly, in some embodiments, the processor 1902 may be coupled to a transceiver 1914 that interfaces with an antenna 1916. The transceiver 1914 may be configured to both transmit and receive cellular network signals, wireless data signals, or other types of signals via the antenna 1916, depending on the nature of the mobile device 1900. Further, in some configurations, a GPS receiver 1918 may also make use of the antenna 1916 to receive GPS signals.

Although an embodiment has been described with reference to specific example embodiments, it will be evident that various modifications and changes may be made to these embodiments without departing from the broader spirit and scope of the present disclosure. Accordingly, the specification and drawings are to be regarded in an illustrative rather than a restrictive sense. The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present invention. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present invention as represented by the appended claims. The specification and drawings are, accordingly, to be regarded in an illustrative rather than a restrictive sense.

Such embodiments of the inventive subject matter may be referred to herein, individually or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A server comprising:

one or more hardware processors comprising a media filter publication module, a messaging module, and a media filter engine, the media filter publication module configured to receive a content item and a selected geolocation from a first device, and to generate a media filter from the content item, the media filter associated with the selected geolocation;

the media filter engine configured to process a geolocation of a client device, to identify a plurality of filters comprising at least the media filter based at least in part on the geolocation of the client device, and to provide the plurality of filters comprising the media filter to the client device display of the media filter on a user interface of the client device; and the messaging module configured to receive, from the client device, a message comprising media content overlaid by the media filter, wherein the first device is different from the client device.

2. The server of claim 1, wherein the media filter publication module comprises:

a user-based content upload module configured to receive the content item;

a user-based geolocation selection module configured to receive the selected geolocation; and a user-based media filter publication engine configured to generate a user-based media filter based on the content item and the selected geolocation, the media filter engine configured to supply the client device with the user-based media filter in response to the geolocation of the client device within the selected geolocation.

3. The server of claim 2, wherein the media filter publication module further comprises:

a user-based duration selection module configured to receive an identification of a period of time associated with the content item and the selected geolocation, wherein the media filter engine is configured to supply the client device with the user-based media filter within the selected geolocation during the period of time.

4. The server of claim 1, wherein the media filter publication module comprises:

a merchant-based media content upload module configured to receive a first content item from a first merchant and a second content item from a second merchant;

a merchant-based geolocation selection module configured to receive a first geolocation information from the first merchant, and a second geolocation information from the second merchant, to identify a common geolocation based on the first geolocation information and the second geolocation information;

a merchant-based bidding module configured to receive a first bid amount from the first merchant and a second bid amount from the second merchant, and to identify a highest bid amount; and a merchant-based publication engine configured to generate a merchant-based media filter based on the content item of the merchant with the highest bid amount and the common geolocation, the media filter engine configured to supply the merchant-based media filter to the client device within the common geolocation;

wherein the media filter publication module further comprises:

a merchant-based duration selection module configured to disable the merchant based media filter after a predetermined duration has elapsed.

5. The server of claim 4, wherein the common geolocation includes a common region formed between a first geolocation from the first merchant and a second geolocation from the second merchant.

6. The server of claim 1, wherein the media filter engine further comprises:

a live event module configured to:

identify a live event associated with the geolocation of the client device;

access live event data related to the live event; and generate a live event media filter based on the live event data and the geolocation of the client device.

7. The server of claim 1, wherein the media filter engine further comprises:

a social network module configured to:

access social network data based on social network information from the client device; and generate a social network media filter based on the social network data and the social network information from the client device.

8. The server of claim 1, wherein the media filter engine further comprises:

a promotion module configured to:

generate a set of media filters including the media filter a merchant for a predefined geolocation of the merchant;

randomly select one media filter from the set of media filters; and provide the randomly selected media filter to the client device in response to the geolocation of the client device corresponding to the predefined geolocation of the merchant.

9. The server of claim 1, wherein the media filter engine further comprises:

a collection module configured to:

store previously provided media filters in a media filter collection associated with the client device; and present media filters from the media filter collection associated with the client device in response to receiving a geolocation associated with the media filters.

10. The server of claim 1, wherein the media filter engine further comprises:

a progressive module configured to:

generate a progressive use media filter for a predefined geolocation; and adjust a content of the progressive use media filter in response to a number of prior uses of the progressive use media filter.

11. The server of claim 10, wherein the progressive module is further configured to:

disable the progressive use media filter after the number of prior uses of the progressive use media filter reaches a predefined progressive use limit.

12. The server of claim 1, wherein the media filter engine further comprises:

a viral use module configured to:

generate a viral use media filter for a predefined geolocation;

provide the viral use media filter to a first client device located at the predefined geolocation;

receive a request from the first client device located at the predefined geolocation to provide the viral use media filter to a second client device located outside the predefined geolocation; and provide the viral use media filter to the second client device located outside the predefined geolocation.

13. The server of claim 1, wherein the media filter engine further comprises:

an actionable module configured to:

execute a programmable function associated with an actionable area in response to detecting a selection of the actionable area from a user of the client device.

14. The server of claim 1, wherein the media filter publication module is configured to generate a graphical user interface for displaying a map, receiving a selection of boundaries in the map, and including a geographic region formed with the selection of boundaries in the selected geolocation.

15. A method comprising:

receiving a content item and a selected geolocation from a first device;

generating, by one or more hardware processors, a media filter from the content item, the media filter associated with the selected geolocation;

receiving, from a client device, a geolocation of the client device;

identifying the media filter based on the geolocation of the client device;

communicating a plurality of media filters comprising the media filter to the client device for display of the media filter on a user interface of the client device by causing display of the media filter over media content on the user interface of the client device; and receiving, from the client device, a message comprising the media content overlaid by the media filter.

16. The method of claim 15, further comprising:

receiving an identification of a period of time associated with the content item and the selected geolocation, the media filter displayed on the user interface of the client device in response to the client device being located within the selected geolocation during the period of time.

17. The method of claim 15, further comprising:

receiving a first content item and a first geolocation information from a first merchant and a second content item and a second geolocation information from a second merchant;

identifying a common geolocation between the first geolocation information and the second geolocation information;

receiving a first bid amount from the first merchant and a second bid amount from the merchant;

identifying a highest bid amount; and generating a merchant-based media filter based on the content item of the merchant with the highest hid amount and the common geolocation, supplying the merchant-based media filter to the client device within the common geolocation.

18. The method of claim 17, further comprising:

disabling the merchant-based media filter after a predetermined duration has elapsed.

19. A non-transitory computer-readable storage medium storing a set of instructions that, when executed by a processor of a machine, cause the machine to perform operations comprising:

receiving a content item and a selected geolocation from a first device;

generating, by one or more hardware processors, a media filter from the content item, the media filter associated with the selected geolocation;

receiving, from a client device, a geolocation of the client device;

identifying the media filter based on the geolocation of the client device;

communicating a plurality of media filters comprising the media filter to the client device for display of the media filter on a user interface of the client device by causing display of the media filter over media content on the user interface of the client device; and receiving, from the client device, a message comprising the media content overlaid by the media filter.

20. The system of claim 1 wherein the selected geolocation is determined by a drawing input received via a graphic user interface of the first device, the input drawing generating a geometric shape drawn on a map by the first device; and wherein the geolocation of the client device is determined by a global positioning system (GPS) measurement taken by the client device.

* * * * *